US006013406A

United States Patent [19]

Moriki et al.

[11] Patent Number: 6,013,406

[45] Date of Patent: Jan. 11, 2000

[54] TONER FOR DEVELOPING ELECTROSTATIC IMAGES, AND IMAGE-FORMING METHOD

[75] Inventors: Yuji Moriki, Susono; Ryoichi Fujita, Odawara; Tatsuya Nakamura, Tokyo, all of Japan

[73] Assignee: Canon Kabushiki Kaisha, Tokyo, Japan

[21] Appl. No.: 09/038,032

[22] Filed: Mar. 11, 1998

[30] Foreign Application Priority Data

Mar. 11, 1997 [JP] Japan ..... 9-055722
Mar. 31, 1997 [JP] Japan ..... 9-079803

[51] Int. Cl.[7] ..... G03G 9/097

[52] U.S. Cl. ..... 430/110; 430/126

[58] Field of Search ..... 430/107, 110, 430/126

[56] References Cited

U.S. PATENT DOCUMENTS

| | | | |
|---|---|---|---|
| 2,297,691 | 10/1942 | Carlson et al. | 95/5 |
| 4,517,272 | 5/1985 | Jadwin et al. | 430/110 |
| 5,130,219 | 7/1992 | Mori et al | 430/106 |
| 5,389,487 | 2/1995 | Kawakami et al. | 430/120 |
| 5,679,490 | 10/1997 | Yachi et al. | 430/111 |
| 5,700,617 | 12/1997 | Takiguchi et al. | 430/110 |
| 5,853,939 | 12/1998 | Yanagibori et al. | 430/106 |

FOREIGN PATENT DOCUMENTS

| | | |
|---|---|---|
| 0414464 | 2/1991 | European Pat. Off. . |
| 0745906 | 12/1996 | European Pat. Off. . |
| 54-058245 | 5/1979 | Japan . |
| 6895 | 2/1980 | Japan . |
| 56-016144 | 2/1981 | Japan . |
| 56-158340 | 12/1981 | Japan . |
| 58-086558 | 5/1983 | Japan . |
| 59-21845 | 2/1984 | Japan . |
| 59-133573 | 7/1984 | Japan . |
| 59-197048 | 11/1984 | Japan . |
| 59-218460 | 12/1984 | Japan . |
| 59-219755 | 12/1984 | Japan . |
| 60-028665 | 2/1985 | Japan . |
| 60-031147 | 2/1985 | Japan . |
| 60-045259 | 3/1985 | Japan . |
| 61-057958 | 3/1986 | Japan . |
| 62-203182 | 9/1987 | Japan . |
| 63-133179 | 6/1988 | Japan . |
| 63-149669 | 6/1988 | Japan . |
| 1-020587 | 1/1989 | Japan . |
| 1-211799 | 8/1989 | Japan . |
| 1-214872 | 8/1989 | Japan . |
| 2-003073 | 1/1990 | Japan . |
| 2-204723 | 8/1990 | Japan . |
| 2-204752 | 8/1990 | Japan . |
| 2-259784 | 10/1990 | Japan . |
| 2-302772 | 12/1990 | Japan . |
| 3-039971 | 2/1991 | Japan . |
| 3-063660 | 3/1991 | Japan . |
| 3-077962 | 4/1991 | Japan . |
| 3-197971 | 8/1991 | Japan . |
| 56-099345 | 8/1991 | Japan . |
| 3-251853 | 11/1991 | Japan . |
| 3-284867 | 12/1991 | Japan . |
| 4-050886 | 2/1992 | Japan . |
| 4-081863 | 3/1992 | Japan . |
| 4-155361 | 5/1992 | Japan . |
| 4-234063 | 8/1992 | Japan . |
| 5-002287 | 1/1993 | Japan . |
| 5-002289 | 1/1993 | Japan . |
| 5-006029 | 1/1993 | Japan . |
| 5-053482 | 3/1993 | Japan . |
| 5-061383 | 3/1993 | Japan . |
| 5-088409 | 4/1993 | Japan . |
| 5-165378 | 7/1993 | Japan . |
| 69427 | 10/1993 | Japan . |
| 6-230652 | 8/1994 | Japan . |
| 51-023354 | 7/1996 | Japan . |

*Primary Examiner*—John Goodrow
*Attorney, Agent, or Firm*—Fitzpatrick, Cella, Harper & Scinto

[57] ABSTRACT

A toner for developing electrostatic images is provided. THF-soluble matter of the toner has, in molecular-weight distribution as measured by GPC, at least one peak in the molecular weight region of from 1,000 to less than 2,000 and at least one peak in the molecular weight region of from 2,000 to 300,000, and has a weight average molecular weight of from 90,000 to 2,000,000. Molecular weight integral value T in the molecular weight region of 800 or more, molecular weight integral value L in the molecular weight region of from 2,000 to 5,000 and molecular weight integral value H in the molecular weight region of 300,000 or more satisfy the relationship:

$$1 \leqq (L/T) \times 100 \leqq 15,$$

and $$3 \leqq (H/T) \times 100 \leqq 30.$$

Also an image forming method using such toner is provided.

68 Claims, 12 Drawing Sheets

TONER FOR DEVELOPING ELECTROSTATIC IMAGES, AND IMAGE-FORMING METHOD

BACKGROUND OF THE INVENTION

1. Field of the invention

This invention relates to a toner for developing electrostatic latent images, which is used to visualize electrostatic latent images, and an image-forming method making use of the toner.

2. Related Background Art

A number of methods as disclosed in U.S. Pat. No. 2,297,691 are known as electrophotography. In general, using a photosensitive member comprising a photoconductive material, copies or prints are obtained by forming an electrostatic latent image on the photosensitive member, subsequently developing the latent image by the use of a toner to form a visible image (toner image), transferring the toner image to a transfer medium (a recording medium) such as paper, and thereafter fixing the toner image onto the transfer medium by the action of heat and/or pressure.

Various methods have been proposed as methods for fixing the toner image. For example, what is widely used is a method of fixing the toner image while holding and transporting a transfer medium (such as paper) having an unfixed toner image on its surface, between a heat roller kept at a stated temperature and a pressure roller having an elastic layer and coming into pressure contact with the heat roller. In this method, however, the toner image comes into contact with the heat roller surface in a molten state under application of pressure, and hence part of the toner image may adhere and transfer to the surface of a fixing roller, tending to cause what is called an offset phenomenon, a phenomenon in which the toner having adhered to the fixing roller surface is again transferred to the next transfer medium.

Especially when images are formed using full-color toners, the offset phenomenon is liable to occur if a heat history at too high temperature is given in order to effect color formation of what is called the secondary color formed by color mixing of monochromatic toners superimposed in multiple layers and thereafter melted by heating.

In order to prevent toner from adhering to the fixing roller surface, a measure has been hitherto taken such that the roller surface is formed of a material having an excellent releasability for toner (e.g., silicone rubber or fluororesin) and, in order to prevent offset and to prevent fatigue of the roller surface, its surface is further covered with a thin film formed using a fluid having a good releasability as exemplified by silicone oil. However, this method, though effective for the prevention of the offset of toner, requires a device for feeding an anti-offset fluid, and hence has such a problem that the fixing assembly must be made complicated. Thus, it is not a preferable direction to prevent the offset by feeding the anti-offset fluid. Rather than such a measure, under existing circumstances, it is sought to provide a toner having a broad low-temperature fixing range and high anti-offset properties.

Accordingly, in order to improve the release properties of the toner, it has been put into practice to add a wax such as low-molecular-weight polyethylene or low-molecular-weight polypropylene that may well melt at the time of heating. The use of wax is effective for preventing offset, but on the other hand results in an increase in agglomerating properties of toner and tends to make charging performance unstable and cause a lowering of running performance.

Accordingly, as other methods, it is variously attempted to improve binder resins.

For example, a method is known in which the glass transition temperature (Tg) and molecular weight of a binder resin in toner are made higher to improve the melt viscoelasticity of the toner. Such a method, however, causes such a problem that the improvement in anti-offset properties may result in an insufficient fixing performance to deteriorate fixing performance in low-temperature fixing, i.e., low-temperature fixing performance, which is required for the achievement of high-speed copying and energy saving.

From the above viewpoint, in order to improve the low-temperature fixing performance of toners, it is necessary to decrease the viscosity of toner at the time of its melting and increase the contact area with a fixing substrate. For this reason, it is required to lower the Tg and molecular weight of binder resins to be used.

The low-temperature fixing performance and the anti-offset properties conflict with each other in some phase, and hence it is very difficult to provide toners satisfying these performances at the same time.

To solve this problem, for example, a toner comprising a vinyl polymer cross-linked to an appropriate degree by adding a cross-linking agent and a molecular-weight modifier is proposed, as disclosed in Japanese Patent Publication No. 51-23354. In Japanese Patent Publication No. 55-6895, a toner is proposed which has as a constituent unit an $\alpha,\beta$-unsaturated ethylene monomer and has a broad molecular-weight distribution so as for the ratio of a weight-average molecular weight to a number-average molecular weight (Mw/Mn) to be 3.5 to 4.0. A toner having a blend type resin comprising a vinyl polymer whose Tg, molecular weight and gel content are specified is also proposed.

The toners according to these proposals certainly have a broader fixing temperature range between the lowest fixing temperature (the lowest temperature at which the fixing is possible) and the offset temperature (the temperature at which the offset begins to occur). There, however, has been such a problem that it is difficult to make their fixing temperature sufficiently low when a satisfactory anti-offset performance is imparted to the toner and on the other hand the anti-offset performance comes to be insufficient when importance is attached to the low-temperature fixing performance.

For example, Japanese Patent Application Laid-open No. 56-158340 discloses a toner having a binder resin comprised of a low-molecular-weight polymer and a high-molecular-weight polymer. In practice, it is difficult for this binder resin to be incorporated with a cross-linking component. Hence, in order to improve anti-offset properties, it is necessary to make the high-molecular-weight polymer have a large molecular weight or to increase the proportion of the high-molecular-weight polymer. This takes a course toward a great lowering of pulverizability of resin compositions, and makes it hard to obtain satisfactory results in practical use.

With regard to a toner comprising a blend of a low-molecular-weight polymer and a cross-linked polymer, Japanese Patent Application Laid-open No. 58-86558 discloses a toner having as main resin components a low-molecular-weight polymer and an insoluble infusible high-molecular-weight polymer. According to such a means, the fixing performance of toners and the pulverizability of resin compositions are considered to be improved. However, the low-molecular-weight polymer has a ratio of weight-average molecular weight/number-average molecular weight (Mw/Mn) as small as 3.5 or less and the insoluble infusible high-molecular-weight polymer is in a proportion as large as 40 to 90% by weight, and hence it is difficult to satisfy both of the anti-offset properties of toners and the pulverizability of resin compositions. In fact, it is very difficult to produce toners well satisfying the fixing performance and the anti-offset properties, unless a fixing assembly having a system for feeding the anti-offset fluid is used.

Moreover, the use of the insoluble infusible high-molecular-weight polymer in a large quantity may result in a very high melt viscosity when materials are heat-kneaded in the production of toner, and hence the materials must be heat-kneaded at a temperature much higher than usual instances, so that additives undergo thermal decomposition to make the toner have low performances. The above toner has such a problem.

Japanese Patent Application Laid-open No. 56-16144 discloses a toner containing a binder resin component having, in its molecular-weight distribution as measured by GPC (gel permeation chromatography), at least one peak value in each of the regions of a molecular weight of from $10^3$ to $8\times10^4$ and a molecular weight of from $10^5$ to $2\times10^6$. In this instance, the binder resin component can have a superior pulverizability, and the toner is superior in anti-offset properties and fixing performance, can be well prevented from causing its filming or melt-adhesion to photosensitive members and can have a superior developing performance. However, it is required to more improve the anti-offset properties and fixing performance of the toner. In particular, it is difficult for this resin to cope with nowaday's severe demands while more improving the fixing performance and keeping or improving other various performances.

Thus, it is very difficult to achieve the performances concerning the fixing of toners (i.e., low-temperature fixing performance and anti-offset properties) at a high level.

As means for preventing the offset phenomenon, for example, Japanese Patent Applications Laid-Open Nos. 1-214872, 2-204752, 2-204723, 3-77962, 3-284867 and 4-81863 also disclose toners containing a binder resin and a wax, having superior fixing performance and anti-offset properties. For example, Japanese Patent Application Laid-Open No. 5-6029 discloses a toner having, in its molecular-weight distribution as measured by GPC, less than 15% of a molecular-weight region of 5,000 or less, not less than 5% of a molecular-weight region of 5,000,000 or more, and a main peak in the region of molecular weight of from 5,000 to 100,000, and having a weight average molecular weight of 5,000,000 or more. In this instance, the toner can have superior low-temperature fixing performance and anti-offset properties, be well prevented from causing its filming or melt-adhesion to photosensitive members and have a superior developing performance.

In the categorization of toner production processes, the above means of preventing offset is achieved by the pulverization process, i.e., a process in which a colorant comprising a dye or pigment is melt-kneaded with a thermosetting resin so as to be uniformly dispersed therein, the product obtained is thereafter pulverized by means of a fine grinding mill, and the pulverized product obtained is classified by means of a classifier so as to have the desired toner particle diameters. However, the anti-offset properties can be more effectively improved even by the suspension polymerization process, i.e., a process in which a polymerizable monomer, a colorant and a polymerization initiator, further optionally together with a cross-linking agent, a charge control agent and other additives are uniformly dissolved or dispersed to prepare a monomer composition, and the monomer composition is dispersed in a continuous phase containing a dispersion stabilizer, e.g., in an aqueous phase, by means of a suitable agitator to carry out polymerization reaction so as to have the desired toner particle diameters. For example, Japanese Patent Application Laid-open No. 5-88409 discloses a toner having what is called the core/shell structure wherein a low-softening substance is covered with a shell resin, which is obtained by uniformly dissolving or dispersing the low-softening substance in the monomer composition, also setting the polarity of the low-softening substance in the monomer to be smaller than that of the main monomer, and still also adding in a small quantity a resin or monomer having a great polarity. In this instance, a toner that may hardly cause the filming onto photosensitive members or any contamination of the surfaces of toner carrying members (developing sleeves) and has superior running performance and developing performance, can be obtained without damaging the low-temperature fixing performance.

However, recent copying machines and printers are strongly demanded to be made small-sized, light-weight and highly reliable, and toners are also severely demanded to have higher performances. For example, it is sought to provide a toner with superior performances that may more hardly cause the filming onto photosensitive members or any contamination of the surfaces of toner carrying materials or members such as carriers and sleeves and has superior running performance and developing performance, without damaging the low-temperature fixing performance.

Japanese Patent Applications Laid-Open Nos. 59-21845, 59-218460, 59-219755, 60-28665, 60-31147, 60-45259, 60-45260 and 3-197971 disclose toners having a superior fixing performance, in which insoluble matters of toners, which are insoluble in solvents such as THF (tetrahydrofuran) and toluene, are specified. Under existing circumstances, however, these are sought to be more improved from the point of view of the achievement of both of the low-temperature fixing performance and the running performance.

Japanese Patent Applications Laid-Open Nos. 60-31147 and 3-197971 discloses toners in which the molecular weights of their soluble matters are also specified. Under existing circumstances, however, these are sought to be more improved in the running performance.

Japanese Patent Application Laid-Open No. 3-251853 discloses a toner obtained by suspension polymerization, the toner having a plurality of peaks in its molecular-weight distribution, where the peak of the smallest molecular weight is located at 50,000 or less and the peak of the largest molecular weight is located at 200,000 or more. Under existing circumstances, however, this is sought to be more improved in the low-temperature fixing performance.

Japanese Patent Application Laid-Open No. 3-39971 discloses a color toner having, in its molecular-weight distribution as measured by GPC, a peak Mp1 in the region of molecular weight of from 500 to 2,000, a peak Mp2 in the region of molecular weight of from 10,000 to 100,000, and having a weight-average molecular weight (Mw) of from 10,000 to 80,000 a number-average molecular weight (Mn) of from 1,500 to 8,000 and a ratio of Mw/Mn of not less than 3 can obtained. In this instance, a color toner that has superior anti-offset properties and can form sharp color images with a high chroma can be obtained. However, it has become necessary to provide a toner that may more hardly cause the filming onto photosensitive members or any contamination of the surfaces of toner carrying materials or members such as carriers and sleeves.

Meanwhile, in conventional electrophotographic processes, toner particles not transferred to the transfer medium after the transfer step and having remained on the surface of a photosensitive member are commonly removed from the surface of the photosensitive member through a cleaning step making use of a cleaning means. Blade cleaning, fur brush cleaning or roller cleaning is used as the cleaning means. From the viewpoint of apparatus, the whole image-forming apparatus must be made larger in order for the apparatus to have the cleaning means. This has been a bottleneck in attempts to make apparatus compact.

From the viewpoint of ecology, a cleanerless system or toner reuse system that may produce no waste toner is long-awaited in the sense of effective utilization of toners.

For example, Japanese Patent Publication No. 5-69427 discloses a technique called "cleaning-at-development" (cleaning simultaneously performed at the time of development) or "cleanerless" system. In such a method, one image is formed at one rotation of the photosensitive member so that any effect of transfer residual toner does not appear on the same image. Japanese Patent Applications Laid-Open Nos. 64-20587, 2-259784, 4-50886 and 5-165378 disclose methods in which the transfer residual toner is dispersed or driven off by a drive-off member to make it into non-patterns so that it may hardly appear on images even when the surface of the same photosensitive member is utilized several times for one image. There, however, has been a problem of image deterioration. Japanese Patent Application Laid-Open No. 5-2287 discloses a constitution in which the toner charge quantity around the photosensitive member is specified so that any positive memory or negative memory caused by the transfer residual toner may not appear on images. It, however, does not disclose any specific constitution as to how to control the toner charge quantity.

In Japanese Patent Applications Laid-Open Nos. 59-133573, 62-203182, 63-133179, 2-302772, 4-155361, 5-2289, 5-53482 and 5-61383, which disclose techniques relating to the cleanerless system, it is proposed, in relation to imaging exposure, to make exposure using light having a high intensity or to use a toner capable of transmitting light having an exposure wavelength. However, only making exposure intensity higher may bring about a blur in dot formation of a latent image itself to cause an insufficient isolated-dot reproducibility, resulting in images having a poor resolution in respect of image quality, in particular, images lacking in gradation in graphic images.

As for the means making use of the toner capable of transmitting light having an exposure wavelength, the transmission of light certainly has a great influence on the fixed toner having been made smooth to have no particle-particle boundaries, but, as mechanisms of screening exposure light, it has less influence because it more chiefly concerns the scattering of light on the toner particle surfaces than the coloring of toner itself. Moreover, colorants of toners must be selected in a narrower range, and besides, at least three types of exposure means having different wavelengths are required when full-color formation is intended. This goes against making apparatus simple, which is one of the features of the cleaning-at-development.

Contact charging carried out by bringing a charging member into contact with the photosensitive member and contact transfer carried out by bringing a transfer member into contact with the photosensitive member interposing a transfer medium between them may commonly generate less ozone and is a system preferable from the viewpoint of ecology. The transfer member serves also as a transport member for transfer mediums, and the system has such a feature that the apparatus can be easily made compact. If, however, the cleaning is not sufficient at the developing zone, the charging member and the transfer member are liable to be contaminated, tending to cause image stain, transfer medium back stain, or blank areas caused by poor transfer (middle portions of line areas are not transferred), due to poor charging of the photosensitive member, and this further accelerates image deterioration. There have been such problems.

In addition, in the cleaning-at-development, in which no cleaning assembly is substantially provided, it is essential for the system to be so set up that the surface of a latent image bearing member is rubbed with the toner and a toner carrying member. This may cause toner deterioration, deterioration of the toner carrying member surface and deterioration or wear of the latent image bearing member surface as a result of long-term service, which leave a problem of deterioration of running performance that has not been well solved in the prior art, and it has been sought to bring out a technique for improving the running performance.

In particular, it has been considered necessary to better prevent the latent image bearing member surface, i.e., the photosensitive member surface, from contamination with toner. In the past, to solve such a problem, it has been proposed to impart releasability or lubricity to the toner or photosensitive member. For example, Japanese Patent Publication No. 57-13868, Japanese Patent Applications Laid-Open Nos. 54-58245, 59-197048, 2-3073 and 3-63660 and U.S. Pat. No. 4,517,272 disclose a method in which a silicone compound is incorporated in the toner. Japanese Patent Application Laid-Open No. 56-99345 discloses a method in which a lubricating substance as typified by a fluorine-containing compound is incorporated in the surface layer of a photosensitive member.

However, there is no example where these methods are applied in the system called cleanerless or cleaning-at-development, having substantially no cleaning assembly.

In recent years, various organic photoconductive materials have been brought out as photoconductive materials of electrophotographic photosensitive members. In particular, photosensitive members of a function-separated type in which a charge generation layer and a charge transport layer are formed in superposition have been put into practical use, and are mounted on image-forming apparatus such as copying machines, printers and facsimile machines. As charging means in such electrophotography, means utilizing corona discharging have been used. Since, however, the use of corona discharging generates ozone in a large quantity, the appratus must have a filter, and there have been such a problem that the apparatus must be made large in size and the running cost increases.

As techniques for solving such problems, charging methods have been proposed in which a charging member such as a roller or a blade is brought into contact with the surface of the photosensitive member so as to form a narrow space in the vicinity of the contact portion, and the discharge as can be explained by what is called the Paschen's law is formed so that the generation of ozone can be prevented as much as possible. In particular, a roller charging system making use of a charging roller as the charging member is preferably used in view of the stability of charging.

Specifically, in the roller charging system, the charging is carried out by discharge from the charging member to the member to be charged, and hence the charging takes place upon application of a voltage above a certain threshold value. For example, when a charging roller is brought into pressure contact with an OPC (organic photoconductor) photosensitive member with a 25 $\mu$m thick photosensitive layer, the surface potential of the photosensitive member begins to rise upon application of a voltage of about 640 kV or above, and at voltages above a threshold value the photosensitive member surface potential linearly increases at a slope of 1 with respect to the applied voltage. This threshold value voltage is hereinafter defined as charging starting voltage Vth. Namely, in order to obtain a photosensitive member surface potential Vd, a DC voltage of Vd+Vth which is higher than necessary must be applied to the charging roller. However, the resistivity of the contact charging member varies depending on environmental variations, and hence it has been difficult to control the potential of the photosensitive member at the desired value.

Thus, in order to achieve more uniform charging, as disclosed in Japanese Patent Application Laid-open No. 63-149669, AC charging is used which is a method of applying to the contact charging member a voltage produced by superimposing an AC component having a peak-to-peak voltage of 2×Vth or above, on a DC voltage corresponding to the desired Vd. This method aims at a potential-leveling effect which is attributable to AC, where the potential of the member to be charged converges on Vd, the middle of a peak of AC potential, and may hardly be affected by external disturbance such as environmental variations.

However, even in such contact charging assemblies, their fundamental charging mechanism utilizes the phenomenon of discharging from the charging member to the photosensitive member. Hence, as previously stated, the voltage necessary for charging must be at a value beyond the surface potential of the photosensitive member. When AC charging is carried out for the purpose of achieving uniform charging, the electric field of AC voltage may remarkably cause vibration and noise of the charging member and photosensitive member, and the discharge may remarkably cause deterioration of the surface of the photosensitive member. This involves another problem.

Japanese Patent Application Laid-Open No. 61-57958 discloses an image-forming method in which a photosensitive member having a conductive protective film is charged using conductive fine particles. This publication discloses that a photosensitive member having a semiconductive protective film having a resistivity of from $10^7$ to $10^{13}$ Ω.cm is used as the photosensitive member and this photosensitive member is charged using conductive fine particles having a resistivity of $10^{10}$ Ω.cm or below, whereby the photosensitive member can be evenly and uniformly charged by discharging, without injection of charges into the photosensitive layer, and good images can be reproduced. According to this method, the vibration and noise in the AC charging can be prevented. However, since the photosensitive member is charged by discharging, the deterioration of the photosensitive member surface, caused by the discharging, may still occur, and also it has been necessary to use a high-voltage power source. Hence, it has been sought to carry out charging by direct injection of charges into the photosensitive member.

Japan Hardcopy '92 Papers, p.287, "Contact Charging Performance Using Conductive Roller", discloses a method in which a voltage is applied to a contact charging member such as a charging roller, a charging brush or a charging magnetic brush, and charges are injected into trap levels present at the photosensitive member surface to carry out contact injection charging. This method is a method in which charges are injected into a dark-portion insulating photosensitive member by means of a low-resistivity charging member to which a voltage has been applied, and has been conditioned on a sufficiently low resistivity of the charging member and also on its surface to which a material (such as conductive filler) providing the charging member with conductivity is sufficiently laid bare.

Hence, it is reported also in the above publication that aluminum foil or an ion-conductive charging member made to have a sufficiently low resistivity in an environment of high humidity is preferable as the charging member. Studies made by the present inventors have revealed that the resistivity of charging members at which charges can be sufficiently injected into photosensitive members is $1\times10^3$ Ω.cm or below and, at a resistivity higher than that, a difference begins to occur between applied voltage and charge potential to cause problems on the convergence of charge potential.

However, when the charging member having such a low resistivity is actually used, excess leak currents may flow from the contact charging member to scratches and pinholes produced on the photosensitive member surface to tend to cause faulty charging around them, expansion of the pinholes and electrification failure of the charging member.

To prevent such problems, it is necessary to make the charging member have a resistivity of about $1\times10^4$ Ω.cm or above. However, as stated previously, the charging member having this resistivity leads to such an inconsistency that the performance of charge injection into the photosensitive member may lower and no sufficient charging is effected.

Accordingly, with regard to contact type charging assemblies or image-forming methods making use of such charging assemblies, it has been sought to solve the above problems, i.e., to achieve both of the conflicting performances one of which is to achieve good charging performance by charge injection that has not been achieved unless low-resistivity charging members are used and the other of which is to prevent the photosensitive member surface from pinhole leak which has not been prevented in low-resistivity charging members.

In the image-forming method making use of the contact charging, any faulty charging due to contamination (toner-spent) of the charging member causes faulty images, tending to cause a problem on running performance. Thus, also in the charging carried out by injecting charges into the photosensitive member, it has been a pressing need for enabling many-sheets to be printed that the influence of the faulty charging due to contamination of the charging member is prevented.

An example using the contact charging and applied to the system called cleanerless or cleaning-at-development is seen in Japanese Patent Applications Laid-Open Nos. 4-234063 and 6-230652. These publications disclose an image-forming method in which the cleaning to remove transfer residual toner from the photosensitive member is also carried out simultaneously in a back-exposure simultaneous developing system.

However, the proposals in these publications are applicable to an image-forming process in which a charge potential and a developing applied bias are formed at low electric fields. In image formation under a higher electric field charging-developing applied bias, which is conventionally applied in electrophotographic apparatus, leak may occur to cause faulty images such as lines and dots.

A method is also proposed in which the toner having adhered to the charging member is moved to the photosensitive member at the time of non-image formation so that any harmful influence from adhesion of the transfer residual toner can be prevented. However, the proposal does not mention anything about improvement in the recovery rate, in the developing step, of the toner moved to the photosensitive member, and about any effect on development that may be caused by the collection of toner in the developing step.

In addition, if the effect of cleaning the transfer residual toner is insufficient at the time of development, the subsequent toner participates in development on the photosensitive member on which the transfer residual toner is present, and hence an image formed thereat may have a higher density than its surroundings to cause positive ghost. Also, if the transfer residual toner is in a too large quantity, it may not be completely collected at the development part to cause positive memory on images. No fundamental solution of these problems has been achieved.

Light screening caused by the transfer residual toner especially causes a problem when the photosensitive member is repeatedly used on one sheet of transfer medium, i.e., when the length corresponding to one round of the photosensitive member is smaller than the length in the moving direction of the transfer medium. Since the charging, exposure and development must be performed in such a state the transfer residual toner is present on the photosensitive member, the potential at the photosensitive member surface portion where the transfer residual toner is present can not be completely dropped to make development contrast insufficient, which, in reverse development, appears on images as negative ghost, having a lower density than the surroundings. The photosensitive member having finished electrostatic transfer stands charged in a polarity reverse to the polarity of toner charge on the whole, where, because of any deterioration of charge injection performance in the photosensitive member as a result of long-term service, the transfer residual toner not controlled to have the normal charge polarity in the charging member may leak from the charging member during image formation to intercept exposure light, so that latent images are disordered and any desired potential can be attained, causing negative memory on images. It is sought to make fundamental solution of these problems.

SUMMARY OF THE INVENTION

An object of the present invention is to provide a toner for developing electrostatic images, that may hardly cause filming on the photosensitive member or contamination of the surfaces of toner carrying materials or members such as carriers and sleeves, without damaging low-temperature fixing performance, and has superior anti-offset properties and running performance.

Another object of the present invention is to provide a toner for developing electrostatic latent images, that has superior charging stability without dependence on environmental differences such as temperature difference and humidity difference.

Still another object of the present invention is to provide a toner for developing electrostatic latent images, that can form sharp color OHP (overhead projection) images.

Still another object of the present invention is to provide a toner for developing electrostatic latent images, that can form color images without requiring any fixing oil.

A further object of the present invention is to provide an image-forming method making use of a charging member that can maintain a good charging performance also in many-sheet running.

A still further object of the present invention is to provide an image-forming method that can maintain a good charging performance over a long period of time, in an image-forming method making use of an electrophotographic photosensitive member and a member for injection-charging the photosensitive member and having the step of charging the photosensitive member by applying a voltage thereto from the injection charging member.

A still further object of the present invention is to provide an image-forming method that can simultaneously achieve both the conflicting performances one of which is to achieve good charging performance by charge injection and the other of which is to prevent the photosensitive member surface from pinhole leak which has not been preventable in low-resistivity contact charging members.

A still further object of the present invention is to provide an image-forming method that enables high-speed image formation, having a high process speed.

To achieve the above objects, the present invention provides a toner for developing electrostatic images, comprising a binder resin, a colorant and a release agent, wherein;

THF(tetrahydrofuran)-soluble matter of said toner, in its molecular-weight distribution as measured by gel permeation chromatography (GPC), has at least one peak in the region of molecular weight of from 1,000 to less than 2,000 and at least one peak in the region of molecular weight of from 2,000 to 300,000, and has a weight-average molecular weight (Mw) of from 90,000 to 2,000,000, where a molecular-weight integral value (T) in the region of molecular weight of 800 or more, a molecular-weight integral value (L) in the region of molecular weight of from 2,000 to 5,000 and a molecular-weight integral value (H) in the region of molecular weight of 300,000 or more satisfy the following relationship:

$$1 \leqq (L/T) \times 100 \leqq 15,$$

$$3 \leqq (H/T) \times 100 \leqq 30.$$

The present invention also provides an image-forming method comprising the steps of;

electrostatically charging the surface of a latent image bearing member for holding thereon an electrostatic latent image;

forming an electrostatic latent image on the surface of the latent image bearing member thus charged;

developing the electrostatic latent image by the use of a toner to form a toner image; wherein said toner comprises a binder resin, a colorant and a release agent, and, THF-soluble matter of said toner, in its molecular-weight distribution as measured by gel permeation chromatography (GPC), has at least one peak in the region of molecular weight of from 1,000 to less than 2,000 and at least one peak in the region of molecular weight of from 2,000 to 300,000, and has a weight-average molecular weight (Mw) of from 90,000 to 2,000,000, where a molecular-weight integral value (T) in the region of molecular weight of 800 or more, a molecular weight integral value (L) in the region of molecular weight of from 2,000 to 5,000 and a molecular-weight integral value (H) in the region of molecular weight of 300,000 or more satisfy the following relationship:

$$1 \leqq (L/T) \times 100 \leqq 15,$$

$$3 \leqq (H/T) \times 100 \leqq 30;$$

transferring to a recording medium the toner image formed by development; and fixing to the recording medium the toner image thus transferred.

DESCRIPTION OF THE PREFERRED EMBODIMENTS

Figure 1:
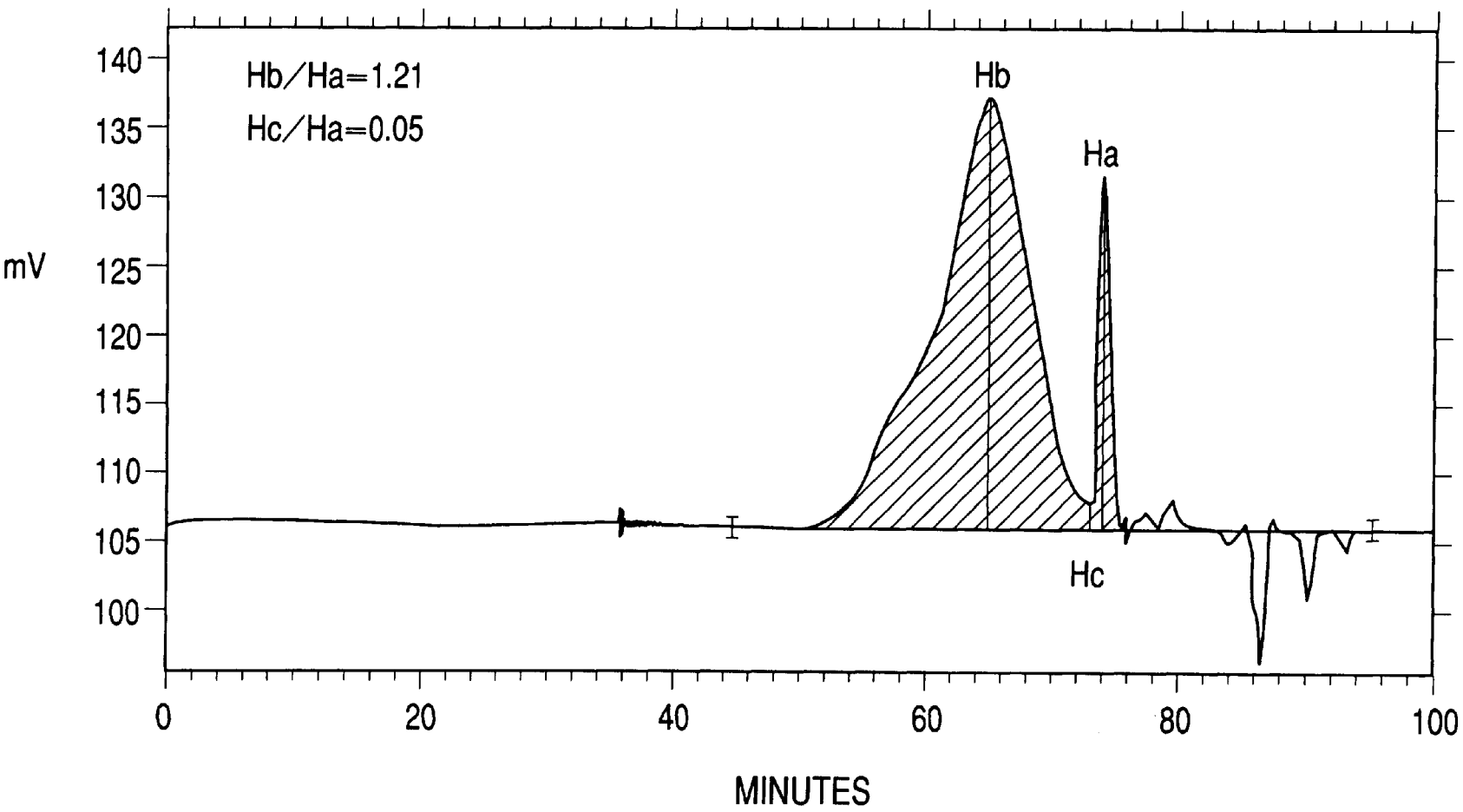
FIG. 1 shows a chart (chromatogram) of molecular-weight distribution as measured by GPC of magenta toner particles in Example 12.

In general, in order to impart fixing properties to toners, resins may be used which can abruptly decrease in viscosity at a temperature higher than room temperature, i.e., at a fixing temperature to become fluid on the transfer medium such as paper and partly permeate into the transfer medium and also can quickly recover the viscosity at about room temperature to become fixed to the transfer medium, and pigments may be dispersed in such resins; the resins thus obtained may be used as a primary constituent of toners. Such resins are called binder resins. In order to impart anti-offset properties to toners, low-softening substances which begin to abruptly decrease in viscosity at temperatures of from room temperature to fixing temperature, have much better fluidity than the binder resin at the fixing temperature and also can be present between binder resins and fixing rollers with ease may be used as a secondary constituent of toners. Such low-softening substances are called release agents.

The present inventors made extensive studies on toners containing binder resins and release agents. As a result, they have discovered that it is optimum for a binder resin to have, in its molecular-weight distribution as measured by GPC, a main peak in the region of molecular weight of from 2,000 to 300,000. If the binder resin has a main peak in the region of molecular weight of less than 2,000, it may contaminate the surfaces of toner carrying materials or members such as carriers and sleeves or cause filming on the surfaces of photosensitive members. If the binder resin has a main peak in the region of molecular weight more than 300,000, the toner may have a poor low-temperature fixing performance.

In addition, the present inventors made extensive studies on waxes as the release agents. As a result, they have discovered that it is optimum for a wax to have, in its molecular-weight distribution as measured by GPC, a main peak in the region of molecular weight f from 1,000 to less than 2,000. If the wax has a main peak in the region of molecular weight less than 1,000, the wax may exude from the toner to the outside at room temperature, so that the toner may have poor running performance and storage stability. If the wax has a main peak in the region of molecular weight of 2,000 or more, no sufficient fluidity can be exhibited even at fixing temperature to make it difficulty for the wax to be present between the binder resin and the fixing roller in a sufficient quantity.

These binder resin and wax have peak tops at different positions in the measurement by GPC. If a component constituting the portion forming a valley between these peak tops is present in the toner in a continuous fashion in the measurement by GPC and in a large quantity, it is difficult to functionally separate the fixing properties and the release properties. That is, the function on fixing properties that is attributable to the binder resin and the function on release properties that is attributable to the wax are cancelled each other to become less effective, so that the toner may have poorness in both the fixing performance and the anti-offset properties. Moreover, such a toner stands tended to contaminate the photosensitive member and the contact charging member, contact transfer member and toner carrying material or member that come into contact with the photosensitive member.

If on the other hand the component constituting the portion forming a valley between these peak tops is not present in the measurement by GPC, the function on fixing properties that is attributable to the binder resin and the function on release properties that is attributable to the wax are by no means cancelled each other. However, in such an instance, the wax and the binder resin are not so readily compatible with each other that the wax component and the binder resin component may separate from each other, so that the toner may have poor running performance and storage stability.

As a result of extensive studies, the present inventors have discovered that a toner having the proportion of a molecular-weight integral value (L) in the region of molecular weight of from 2,000 to 5,000 to the molecular-weight integral value (T) in the region of molecular weight of 800 or more, $(L/T)\times100$, of from 1 to 15, and preferably from 1 to 7, is a toner that can maintain a good low temperature fixing performance and may hardly cause the filming to photosensitive members and the contamination of the surfaces of toner carrying materials or members such as carriers and sleeves.

More specifically, regarding the component in the region of molecular weight of from 2,000 to 300,000 as a binder resin component and the component in the region of molecular weight of from 1,000 to less than 2,000 as a release agent component, sharp distributions are shown in the molecular-weight distributions at the respective peaks when the toner has the respective peaks in the respective molecular-weight regions. Thus, the quantity of presence of the binder resin component in the region of molecular weight of from 2,000 to 5,000 can be an essential component for the toner to be fixed onto paper even at a low energy at the time of fixing-temperature down especially when high-speed copying or continuous paper feeding is carried out. In the case when the distribution of the binder resin component stands continuous to the distribution of the release agent component, the respective effective components may be cancelled each other as stated above if the component constituting the portion forming a valley between the peak tops is present in a too large quantity. Accordingly, the quantity of presence of the component constituting the portion forming a valley between the peak tops must be in a specific proportion.

If the value of (L/T)×100 is more than 15, it is difficult to functionally separate the binder resin component and the release agent component, so that the fixing function and the release function may be cancelled each other to become less effective, making it difficult to achieve both the fixing performance and the anti-offsetting properties at a high level. If the value of (L/T)×100 is less than 1, the binder resin component and the release agent component tend to separate to make the toner have an unstable charging performance.

A high-molecular-weight component in the region of molecular weight of 300,000 or more makes the toner durable and imparts running performance and storage stability to the toner, but its presence in a large quantity may make the fixing temperature higher, undesirably. As a result of extensive studies, the present inventors have discovered that a toner having the proportion of a molecular-weight integral value (H) in the region of molecular weight of 300,000 or more to a molecular-weight integral value (T) in the region of molecular weight of 800 or more, (H/T)×100, of from 3 to 30, and preferably from 5 to 25, has a superior running performance without damaging fixing temperature characteristics.

Such a component in the region of molecular weight of 300,000 or more, which is commonly grouped into a high-molecular-weight component, may not only adversely affect the fixing performance when it is present in a large quantity but also has a possibility of bringing about an unstableness in the manufacture of toners. Accordingly, in a GPC chromatogram chart, the high-molecular-weight component in the vicinity of the above range is considered preferable when it is smaller in proportion and has an oblong distribution at the peak. It, however, shows conflicting properties in respect of storage stability of toner and surface strength of toner particles themselves, and hence it stands difficult to effectively bring out the both properties.

However, in the present invention, the low-molecular-weight region of the binder resin component in the molecular-weight distribution, to which the fixing properties of the toner will be greatly attributable, has been found to be concerned with an improvement in fixing performance as stated above. Accordingly, for the high-molecular-weight component for keeping the above storage stability and surface strength, it is very useful to be present in the above specific amount.

If the value of (H/T)×100 is more than 30, the toner may have a low fixing performance and also, because of a great change in charge quantity of the toner, offset tends to occur when images are outputted while forming toner images in multiple layers. If the value of (H/T)×100 is less than 3, the toner may seriously cause blocking after it is left over a long period time, or tends to contaminate the charging member.

In the present invention, a binder resin component in the region of molecular weight of 100,000 or more is also a component acting on the anti-blocking properties and storage stability of the toner. Accordingly, the toner may have the proportion of a molecular-weight integral value (M) in the region of molecular weight of 100,000 or more to the molecular-weight integral value (T) in the region of molecular weight of 800 or more, (M/T)×100, of from 10 to 50, and more preferably from 15 to 40. This is preferable in view of the advantages that the toner can satisfy the above performances and also can stably maintain its fluidity to achieve good charging performance.

If the above value of (M/T)×100 is more than 50, the colorant and the charge control agent can not be well dispersed when the toner is produced to make it difficult for them to be uniformly dispersed in the toner particles, resulting in a difficulty in achieving the desired charge quantity. If the value of (M/T)×100 is less than 10, offset tends to occur on the high-temperature side.

In the present invention, in the region of molecular weight of from 800 to 3,000, the toner may also particularly preferably have Mw/Mn of not more than 3.0.

In the present invention, the toner may preferably have, in its molecular-weight distribution, the ratio of height (Hb) of a peak top in the region of molecular weight of from 2,000 to 300,000 to height (Ha) of a peak top in the region of molecular weight of from 1,000 to less than 2,000, (Hb/Ha), of from 0.70 to 1.30, and more preferably from 0.75 to 1.25.

The relationship in such a height ratio (Hb/Ha) means that the presence of the low-softening substance release agent component in a large quantity makes it possible for the toner to keep more preferable release properties to heat-fixing rollers. In this instance, reflecting the state that the molecular-weight distribution of the above binder resin component is sharply curved on the side of low molecular weight, the release agent component does not act inhibitory to the molecular weight of the binder resin component, and hence it becomes possible for the toner to exhibit high release properties to the heat-fixing rollers.

If the value of Hb/Ha is less than 0.70, the wax (release agent) tends to flow outside the toner under conditions of normal temperature, so that the toner may have poor running performance and storage stability. If the value of Hb/Ha is more than 1.30, the wax can not be in a sufficient content, so that the toner may have poor anti-offset properties, and offset tends to occur especially when unfixed toner images constituted of multiple layers in the formation of full-color images are pressed at the part of the heat-fixing rollers.

In the molecular-weight distribution, the toner may also preferably have the ratio of height (Hc) at a molecular weight minimum value present between the peak top in the region of molecular weight of from 2,000 to 300,000 and the peak top in the region of molecular weight of from 1,000 to less than 2,000 to the height (Ha) of the peak top in the region of molecular weight of from 1,000 to less than 2,000, (Hc/Ha), of from 0.01 to 0.15, more preferably from 0.01 to 0.10, still more preferably from 0.01 to 0.07 and much more preferably from 0.02 to 0.07.

If the value of Hc/Ha is less than 0.01, the wax and the binder resin are not so readily compatible with each other that the wax component and the binder resin component may separate from each other, so that the toner may have poor running performance and storage stability. If the value of Hc/Ha is more than 0.15, the binder resin and the wax can be functionally separated with difficulty, i.e., the function the binder resin has and the function the wax has are cancelled each other to become less effective, so that the toner may have a poorness in both the fixing performance and the anti-offset properties.

In the present invention, in molecular-weight distribution as measured by GPC of THF-soluble matter of the toner, the toner also has a weight-average molecular weight (Mw) of from 90,000 to 2,000,000, and preferably from 100,000 to 1,500,000.

If the toner has a weight-average molecular weight (Mw) less than 90,000, the toner may have low anti-blocking properties and besides may cause filming to the photosensitive member surface. If the toner has a weight-average molecular weight more than 2,000,000, offset tends to occur on the side of high temperature or the colorant tends to be not well dispersed, to cause a lowering of image quality and besides make it difficult to obtain uniform toner particles when the toner is produced.

In the present invention, in molecular-weight distribution as measured by GPC of toluene-soluble matter of the toner, the toner may also preferably have a number-average molecular weight (Mn) of from 8,200 to 700,000, and more preferably from 8,300 to 500,000.

If the toner has a number-average molecular weight (Mn) less than 8,200, the toner may lack in storage stability to tend to have a poor fluidity. If the toner has a number-average molecular weight (Mn) more than 700,000, the toner may have a low production stability to make it difficult to obtain uniform toner particles, and the triboelectricity of the toner may be affected.

As to Mw/Mn, which indicates the breadth of molecular-weight distribution, the toner may preferably have an Mw/Mn of from 4 to 15, and more preferably from 5 to 13.

If the value of Mw/Mn is less than 4, the toner tends to have low anti-blocking properties. If the value of Mw/Mn is more than 15, the binder resin component may have slow melting properties, and hence, especially when used as a color toner, the sharp-melt properties necessary for sufficient color formation may be damaged to make it difficult to achieve faithful color reproducibility, and also may have low mixing properties to other color toners.

In the present invention, the molecular-weight distribution as measured by GPC of toluene-soluble matter of the toner using THF (tetrahydrofuran) as a solvent is measured under the following conditions.

The toner is beforehand extracted with a toluene solvent for 20 hours by means of a Soxhlet extractor. Thereafter, the extract obtained is put in a rotary evaporator to evaporate off the toluene, and then solubilized in THF (tetrahydrofuran). Thereafter, the mixture is passed through a sample-treating filter (pore size: 0.3 to 0.5 $\mu$m; e.g. MAISHORI DISK H-25-5, available from Toso Co., Ltd., or EKIKURO DISK 25CR, available from German Science Japan, Ltd., may be used). The solution obtained is used as the sample for GPC. Concentration of the sample is controlled to be 0.5 to 5 mg/ml as resin component.

In a GPC measuring apparatus, columns are stabilized in a heat chamber of 40° C. To the columns kept at this temperature, THF as a solvent is flowed at a flow rate of 1 ml per minute, and about 100 $\mu$l of THF sample solution is injected thereinto to make measurement. In measuring the molecular weight of the sample, the molecular weight distribution ascribed to the sample is calculated from the relationship between the logarithmic value of a calibration curve prepared using several kinds of monodisperse polystyrene standard samples and the count number (retention time). As the standard polystyrene samples used for the preparation of the calibration curve, it is suitable to use samples with molecular weights of from 100 to 10,000,000, which are available from, e.g., Toso Co., Ltd. or Showa Denko KK., and to use at least about 10 standard polystyrene samples. An RI (refractive index) detector is used as a detector. Columns may be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H(Hxl), G2000H(Hxl), G3000H(Hxl), G4000H(Hxl), G5000H (Hxl), G6000H(Hxl), G7000H(Hxl) and TSK guard column, available from Toso Co., Ltd.

From the GPC molecular-weight distribution obtained in the manner described above, the molecular-weight integral value (T) in the region of molecular weight of 800 or more, the molecular-weight integral value (L) in the region of molecular weight of from 2,000 to 5,000, the molecular-weight integral value (M) in the region of molecular weight of 100,000 or more, and the molecular-weight integral value (H) in the region of molecular weight of 300,000 or more are calculated.

From the GPC molecular-weight distribution obtained in the manner described above, the ratio of height (Hb) of the peak top in the region of molecular weight of from 2,000 to 300,000 to height (Ha) of the peak top in the region of molecular weight of from 1,000 to less than 2,000, (Hb/Ha), and the ratio of height (Hc) at the molecular weight minimum value present between the peak top in the region of molecular weight of from 2,000 to 300,000 and the peak top in the region of molecular weight of from 1,000 to less than 2,000 to the height (Ha) of the peak top in the region of molecular weight of from 1,000 to less than 2,000, (Hc/Ha), are calculated in the following way.

Perpendicular lines are dropped toward the base line, from the respective maximum values in the region of molecular weight of from 1,000 to less than 2,000 and in the region of molecular weight of from 2,000 to 300,000 of the resulting molecular-weight distribution. The length of a perpendicular line drawn from the highest peak (the peak top) in the region of molecular weight of from 2,000 to 300,000 is regarded as the height (Hb) of the peak top in the region of molecular weight of 2,000 or more. Also, the length of a perpendicular line drawn from the highest peak (the peak top) in the region of molecular weight of from 1,000 to less than 200,000 is regarded as the height (Ha) in the region of molecular weight of from 1,000 to less than 2,000.

A perpendicular line is dropped toward the base line, from the molecular weight minimum value present between the peak top in the region of molecular weight of from 2,000 to 300,000 and the peak top in the region of molecular weight of from 1,000 to less than 2,000 of the resulting molecular weight distribution, and the length of a perpendicular line drawn from the lowest point (the bottom point) in the above region is regarded as the height (Hc) at the molecular weight minimum value present between the peak top in the region of molecular weight of from 2,000 to 300,000 and the peak top in the region of molecular weight of from 1,000 to less than 2,000.

Using these Ha, Hb and Hc, the Hb/Ha and Hc/Ha are calculated.

In the present invention, the resin component of the toner may also contain a toluene-insoluble matter (i.e., a gel component). This is preferable in view of an improvement in the anti-offset properties at the time of fixing and also the readiness to deform the toner when melted for fixing.

In the present invention, the resin component of the toner may preferably contain the toluene-insoluble matter in an amount of from 2 to 30% by weight, and more preferably from 3 to 25% by weight, based on the weight of the resin component. If the resin component of the toner contains the toluene-insoluble matter in an amount less than 2% by weight, the release properties may be damaged and hence the toner may become fluid (flow out) at the time of high-temperature fixing. If it contains the toluene-insoluble matter in an amount more than 30% by weight, the toner may deform with difficulty when melted for fixing and may have a poor low-temperature fixing performance.

In the present invention, the content of the toluene-insoluble matter in the resin component of the toner is a value determined in the following manner. The weight of the colorant and charge control agent is first subtracted from the weight of an extraction residue obtained after the toner is extracted for 20 hours with a toluene solvent by the use of the Soxhlet extractor used in the above GPC measurement to obtain a difference value therebetween. The obtained value of the weight is then divided by the weight obtained by subtracting the weight of the colorant and charge control agent from the weight of the toner before the Soxhlet extraction, and the quotient is then multiplied by 100.

Stated specifically, the content of toluene-insoluble matter of the resin component in the present invention is determined by the following measurement.

A sample (1 g) is precisely weighed on a cylindrical filter paper (No. 86R, available from Toyo Roshi K.K.). This sample is immersed in 1 liter of toluene, followed by extraction for 20 hours in a boiled state. The filter paper obtained after the extraction is dried and thereafter weighed. The content of the toluene-insoluble matter is calculated according to the following expression.

$$\text{Toluene-insoluble matter (gel content)}=(W_2-W_0)/(W_1-W_0)\times 100\ (\%)$$

$W_0$: Weight (g) of the cylindrical filter paper.

$W_1$: Weight (g) of the extracted layer (sample+cylindrical filter paper).

$W_2$: Weight (g) of the cylindrical filter paper after extraction and drying.

When components other than the resin component are contained in the sample, the toluene-insoluble matter is calculated using weight $W_1'$ and weight $W_2'$ given by subtracting the weight of the components other than the resin component from the weight $W_1$ and weight $W_2$, respectively.

The releasing agent low-softening substance used in the toner for developing electrostatic images may include polymethylene waxes such as paraffin wax, polyolefin wax, microcrystalline wax and Fischer-Tropsch wax; amide waxes; higher fatty acids; long-chain alcohols; ester waxes; and derivatives thereof such as graft compound s and block compounds. These may preferably be those from which low-molecular-weight components have been removed and having a sharp maximum endothermic peak in the DSC endothermic curve.

Waxes preferably usable are straight-chain alkyl alcohols having 15 to 100 carbon atoms, straight-chain fatty acids, straight-chain acid amides, straight-chain esters or montan type derivatives. Any of these waxes from which impurities such as liquid fatty acids have been removed are also preferred.

Waxes more preferably usable may include low-molecular-weight alkylene polymers obtain ed by radical polymerization of alkylenes under a high pressure or polymerization thereof in the presence of a Ziegler catalyst or any other catalyst under a low pressure; alkylene polymers obtained by thermal decomposition of high-molecular-weight alkylene polymers; those obtained by separation and purification of low-molecular-weight alkylene polymers formed as by-products when alkylenes are polymerized; and polymethylene waxes obtained by extraction fractionation of specific components from distillation residues of hydrocarbon polymers obtained by the Arge process from a synthetic gas comprised of carbon monoxide and hydrogen, or synthetic hydrocarbons obtained by hydrogenation of distillation residues. Antioxidants may be added to these waxes.

The release agent used in the present invention may preferably have a maximum endothermic peak within a temperature range of from 40 to 120° C., more preferably from 40 to 90° C., and still more preferably from 45 to 85° C., in the the DSC endothermic curve. If it has a maximum endothermic peak of below 40° C., the release agent may have a weak self-cohesive force, resulting in poor high-temperature anti-offset properties, undesirably. If it has a maximum endothermic peak of above 120° C., the toner may have a higher fixing temperature, and also the release agent may deposit in the course of granulation to disorder the suspension system, undesirably.

The release agent may preferably be a sharp-melt release agent whose maximum endothermic peak has a half width of preferably within 10° C., and more preferably within 5° C.

In the present invention, the DSC measurement of the release agent is made according to ASTM D3418-8. Stated specifically, using, e.g., DSC-7, manufactured by Perkin Elmer Co., the temperature at the detecting portion of the device is corrected on the basis of melting points of indium and zinc, and an empty pan is set as a control, to make measurement at a rate of temperature rise of 10° C./min at temperatures of from 30° C. to 200° C.

As the release agent, an ester wax chiefly composed of an esterified compound of a long-chain alkyl alcohol having 15 to 45 carbon atoms with a long-chain alkyl carboxylic acid having 15 to 45 carbon atoms is preferred in view of the transparency on OHP sheets and the low-temperature fixing performance and high-temperature anti-offset properties at the time of fixing.

In the present invention, the release agent may preferably be contained in an amount of from 3 to 40 parts by weight, and more preferably from 5 to 35 parts by weight, based on 100 parts by weight of the binder resin of the toner, in view of anti-offset properties and stability at the time of toner production.

If the release agent is in a content less than 3 parts by weight, it is difficult to obtain sufficient high-temperature anti-offset properties, and also offset of an image first-time fixed (on the surface) may occur at the second-time fixing (on the back) when images are fixed on both sides of a recording medium. If it is in a content more than 40 parts by weight, when the toner is produced, toner components tend to melt-adhere to the inside of a toner production apparatus when toner particles are produced by the pulverization process, and particles can not be well formed at the time of granulation and also toner particles formed tend to agglomerate one another when toner particles are produced by the polymerization process.

From the viewpoint of running performance of the toner, the release agent may preferably be encapsulated into toner particles. As a specific method for encapsulating the release agent, the polarity of materials in an aqueous medium may be set smaller on the release agent than on the main polymerizable monomers, and also a resin or polymerizable monomer having a great polarity may be added in a small quantity, whereby toner particles can be obtained which have a core/shell structure wherein the core surfaces of the release agent are covered with shell resin.

As a specific method of confirming the core/shell structure of the toner particles, the toner particles are well dispersed in a cold-setting epoxy resin, followed by curing in an environment of temperature 40° C. for 2 days, and the cured product obtained is dyed with triruthenium tetraoxide optionally in combination with triosmium tetraoxide, thereafter samples are cut out in slices by means of a microtome having a diamond cutter to observe the cross sections of toner particles using a transmission electron microscope (TEM). In the present invention, it is preferable to use the triruthenium tetraoxide dyeing method in order to form a contrast between the materials by utilizing some difference in crystallinity between the release agent used and the resin constituting the shell.

The toner of the present invention may preferably be a polymerization toner obtained by a polymerization process in which toner particles are produced by polymerizing a polymerizable monomer composition. This is because the polymerization toner can be free from the problems of cut of molecular chains of high-molecular-weight components, pulverizability and so forth that may be caused in the steps of melt-kneading and pulverization when toners are produced by pulverization and the proportion of the respective components which is characteristic of the present invention can be controlled with ease.

In the case when the toner particles are produced by polymerization, the particle size distribution and particle diameter of the toner particles may be controlled by a method in which the types and amounts of a sparingly water-soluble inorganic salt and a dispersant having the action of protective colloids, added in an aqueous medium, are changed; or by controlling mechanical device conditions used at the time of granulation carried out in an aqueous medium, e.g., the conditions for agitation (such as the peripheral speed of a rotor, pass times and the shape of agitating blades) and the shape of a reaction vessel, or controlling the concentration of solid matter in the aqueous medium; whereby the particle size distribution and particle diameter can be appropriately controlled.

The polymerizable monomer used in the present invention may include styrene type monomers such as styrene, o-, m- or p-methylstyrene, and m- or p-ethylstyrene; acrylic or methacrylic acid monomers; acrylic or methacrylic acid ester monomers such as methyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and ene monomers such as butadiene, isoprene, cyclohexene, acrylo- or methacrylonitrile and acrylic acid amide, any of which may preferably be used.

Any of these polymerizable monomers may be used alone, or usually used in the form of an appropriate mixture of monomers so mixed that the theoretical glass transition temperature (Tg) as described in a publication POLYMER HANDBOOK, 2nd Edition, pp.139–192 (John Wiley & Sons, Inc.) ranges from 40° to 80° C. If the theoretical glass transition temperature is lower than 40° C., problems may arise in respect of storage stability or running stability of the toner. If on the other hand the theoretical glass transition temperature is higher than 80° C., the fixing point of the toner may become higher. Especially in the case of color toners used to form full-color images, the color mixing performance of the respective color toners at the time of fixing may lower, resulting in a poor color reproducibility, and also the transparency of OHP images may seriously lower. Thus, such temperatures are not preferable.

When the toner particles having the core/shell structure are produced by polymerization, it is particularly preferable to add a polar resin. As the polar resin used in the present invention, copolymers of styrene with acrylic or methacrylic acid, maleic acid copolymers, polyester resins and epoxy resins are preferably used. The polar resin may particularly preferably be those not containing in the molecule any unsaturated groups that may react with polymerizable monomers.

In the present invention, the surfaces of the toner particles may be further provided with outermost shell resin layers. Such outermost shell resin layers may preferably have a glass transition temperature so set as to be higher than the glass transition temperature of the shell-forming shell resin layer in order to more improve blocking resistance, and may also preferably be cross-linked to such an extent that the fixing performance is not damaged. The outermost shell resin layers may preferably be incorporated with a polar resin and a charge control agent in order to improve charging performance.

There are no particular limitations on how to provide the outermost shell resin layers. For example, the layers may be provided by a method including the following.

1) A method in which, at the latter half or after the completion of polymerization reaction, a monomer composition prepared by dissolving or dispersing the polar resin, the charge control agent, a cross-linking agent and so forth as occasion calls is added in the reaction system, and adsorbed on polymerization particles, followed by addition of a polymerization initiator to carry out polymerization.

2) A method in which emulsion polymerization particles or soap-free polymerization particles produced from a monomer composition containing the polar resin, the charge control agent, a cross-linking agent and so forth as occasion calls are added in the reaction system, and are caused to cohere to the surfaces of polymerization particles, optionally followed by heating to fix them.

3) A method in which emulsion polymerization particles or soap-free polymerization particles produced from a monomer composition containing the polar resin, the charge control agent, a cross-linking agent and so forth as occasion calls are caused to fix in a dry process, mechanically to the surfaces of toner particles.

As the polar resin, polyester resins are preferred.

As for colorants used in the present invention, carbon black, magnetic materials, and colorants toned in black by the use of yellow, magenta and cyan chromatic colorants shown below are used as black colorants.

As a yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As a magenta colorant, condensation azo compounds, diketopyropyyrole compounds, anthraquinone compounds, quinacridone compounds, basic dye lake compounds, naphthol compounds, benzimidazole compounds, thioindigo compounds and perylene compounds are used. Stated specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are particularly preferable.

As a cyan colorant used in the present invention, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may be particularly preferably used.

These colorants may be used alone, in the form of a mixture, or in the state of a solid solution.

In the case of color toners, the colorants used in the present invention are selected taking account of hue angle, chroma, brightness, weatherability, transparency on OHP films and dispersibility in toner particles. The colorant may preferably be used in an amount of from 1 to 20 parts by weight based on 100 parts by weight of the binder resin.

In the case when a magnetic material is used as the black colorant, it may preferably be used in an amount of from 40 to 150 parts by weight based on 100 parts by weight of the binder resin, which is different from instances where other colorants are contained.

As charge control agents, known agents may be used. In the case when color toners are formed, it is particularly preferable to use charge control agents that are colorless, make toner charging speed higher and are capable of stably maintaining a constant charge quantity. In the case when the polymerization method is used to obtain the toner particles, charge control agents having neither polymerization inhibitory action nor solubilizates in the aqueous dispersion medium are particularly preferred.

As specific compounds, they may include, as negative charge control agents, metal compounds of salicylic acid, naphthoic acid, dicarboxylic acids or derivatives of these, polymer type compounds having a sulfonic acid or carboxylic acid in the side chain, boron compounds, urea compounds, silicon compounds, and carixarene, any of which may be used. As positive charge control agents, they may include quaternary ammonium salts, polymer type compounds having such a quaternary ammonium salt in the side chain, guanidine compounds, and imidazole compounds, any of which may be used.

The charge control agent may preferably be used in an amount of from 0.5 to 10 parts by weight based on 100 parts by weight of the binder resin. In the present invention, however, the addition of the charge control agent is not essential. For example, in the case when two-component development is employed, the triboelectric charging with a carrier may be utilized, and also in the case when one-component development is employed, the triboelectric charging with a blade member or sleeve member may be intentionally utilized. In either case, the charge control agent need not necessarily be contained in the toner particles.

The polymerization initiator used in the present invention may include, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroxyperoxide, 2,4-dichlorobenzoyl peroxide and lauroyl peroxide.

The polymerization initiator may usually be used in an amount of from 0.5 to 20% by weight, preferably 0.5 to 10% by weight based on the weight of the polymerizable monomers, which varies depending on the component ratio intended in the present invention. The polymerization initiator may a little vary in type depending on the methods for polymerization, and may be used alone or in the form of a mixture, making reference to its 10-hour half-life period temperature.

In order to positively or intentionally synthesize the resin component in the region of molecular weight of 300,000 or more by using the initiator in a smaller quantity so that the initiator acting as a chain transfer agent can be in a smaller quantity, the toner of the present invention may be obtained by adding a polymer having a top peak in the region of molecular weight of from 2,000 to 5,000, to a reaction system which has been made sure that a polymer with a molecular weight of from 2,000 to 5,000 little grows. Such a polymer may be added to the monomer composition in an appropriate quantity before the granulation is carried out. The toner may also be obtained by carrying out polymerization at a temperature of, e.g., 40° C. or above, and preferably from 50 to 90° C., for a certain time to synthesize a high-molecular-weight product at the first half of the polymerization reaction, and thereafter raising the temperature at a mild temperature gradient to synthesize a low-molecular weight product at the latter-half of the polymerization reaction. In either instance, the concentration of dissolved oxygen in the aqueous medium at the time of the polymerization reaction should be strictly controlled so as to be preferably from 0.1 to 0.8 mg/liter. The concentration of dissolved oxygen can be controlled by bubbling nitrogen into the aqueous medium.

In the present invention, in order to control the molecular-weight distribution of the resin components of the toner, it is also preferable to further add any known cross-linking agent, chain transfer agent and polymerization inhibitor.

In the case when the suspension polymerization is used to produce the toner of the present invention, any of organic compounds and inorganic compounds may be used as the dispersant. The dispersant may include, e.g., as the inorganic compounds, calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As the organic compounds, it may include, e.g., polyvinyl alcohol, gelatin, methyl cellulose, methyl hydroxypropyl cellulose, ethyl cellulose, carboxymethyl cellulose sodium salt, and starch.

Any of these stabilizers may preferably be used in an amount of from 0.2 to 10.0 parts by weight based on 100 parts by weight of the polymerizable monomer composition.

As these dispersants, those commercially available may be used as they are. In order to obtain dispersed particles having a fine and uniform particle size, however, fine particles of the inorganic compound may be formed in the dispersion medium under high-speed agitation. For example, in the case of calcium phosphate, an aqueous sodium phosphate solution and an aqueous calcium chloride solution may be mixed under high-speed agitation to obtain a fine-particle dispersant preferable for the suspension polymerization.

In these dispersants, 0.001 to 0.1 parts by weight of a surface active agent may be used in combination. Stated specifically, commercially available nonionic, anionic or cationic surface active agents may be used. For example, those preferably used are sodium dodecylbenzenesulfate, sodium tetradecylsulfate, sodium pentadecylsulfate, sodium octylsulfate, sodium oleate, sodium laurate, potassium stearate and calcium oleate.

In the present invention, the polymerization toner can be produced by the following process: A monomer composition comprising polymerizable monomers and added therein the release agent, the colorant, the charge control agent, the polymerization initiator and other additives, having been uniformly dissolved or dispersed by means of a mixing machine such as a homogenizer or an ultrasonic dispersion machine, is dispersed in an aqueous medium containing a dispersion stabilizer, by means of a dispersion machine such as a homomixer, followed by granulation. Granulation is stopped at the stage where droplets formed of the monomer composition have come to have the desired toner particle size. After the granulation, agitation may be carried out to such an extent that the state of particles is maintained and the particles can be prevented from settling by the acton of the dispersion stabilizer. The polymerization may be carried out at a polymerization temperature set at 40° C. or above, usually from 50° to 90° C. In the present invention, for the purpose of controlling the molecular weight distribution, the temperature may be raised at the latter half of the polymerization, and also the aqueous medium may be removed in part from the reaction system at the latter half of the reaction or after the reaction has been completed, in order to remove unreacted polymerizable monomers, by-products and so forth. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the monomer composition.

Besides the above polymerization process, the toner of the present invention may also be produced by what is called the pulverization process, in which the binder resin, the release agent, the colorant, the charge control agent and other additives are uniformly dispersed by means of a dispersion machine such as a pressure kneader or extruder or a media dispersion machine, thereafter the dispersed materials are pulverized using a mechanical pulverizer or using an impact pulverizer where the materials are collided against a target in a jet stream, so as to be finely pulverized to have the desired toner particle diameters, and thereafter the pulverized product is further brought to a classification step to make its particle size distribution sharp to produce toner particles.

For the purpose of imparting various toner properties, an external additive may be externally added to the toner particles. Such an external additive may preferably have an average particle diameter not larger than 1/10 of the weight average particle diameter of the toner particles, in view of the running performance of the toner. The average particle diameter of this external additive refers to a number average particle diameter obtained by observing the toner particles on an electron microscope.

As the external additive, the following material may be used, for example.

It may include metal oxides such as aluminum oxide, titanium oxide, strontium titanate, cerium oxide, magnesium oxide, chromium oxide, tin oxide and zinc oxide; nitrides such as silicon nitride; carbides such as silicon carbide; metal salts such as calcium sulfate, barium sulfate and calcium carbonate; fatty acid metal salts such as zinc stearate and calcium stearate; carbon black; and silica.

Any of these external additives may preferably be used in an amount of from 0.01 to 10 parts by weight, and more preferably from 0.05 to 5 parts by weight, based on 100 parts by weight of the toner particles. These external additives may be used alone or may be used in combination of two or more. An external additive having been subjected to hydrophobic treatment is more preferred.

In the present invention, the toner particles may preferably have a weight-average particle diameter (D4) of from 4 to 10 μm, and more preferably from 5 to 8 μm, in view of an advantage that finer latent image dots for achieving a higher image quality can be faithfully reproduced. If the toner particles have a weight-average particle diameter (D4) smaller than 4 μm, toner transfer efficiency may lower to cause the transfer residual toner in a large quantity on the photosensitive member surface, tending to cause uneven images or tending to cause melt-adhesion of toner to the photosensitive member. If the toner particles have a weight-average particle diameter (D4) larger than 10 μm, the fine-dot reproducibility may lower to cause a lowering of image quality and also to tend to cause melt-adhesion of toner to various members, due to in-machine toner scatter.

The weight-average particle diameter of the toner particles may be measured using Coulter Counter Model TA-II or Coulter Multisizer (manufactured by Coulter Electronics, Inc.). In the present invention, it is measured using Coulter Counter Model TA-II (manufactured by Coulter Electronics, Inc.). An interface (manufactured by Nikkaki k.k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of not smaller than 2 μm by means of the above Coulter Counter Model TA-II, using an aperture of 100 μm as its aperture. Then the volume-based, weight average particle diameter (D4: the middle value of each channel is used as the representative value for each channel) according to the present invention, determined from volume distribution, is determined.

The toner of the present invention as described above may be used as a one-component developer, or the toner may be blended with carrier particles so as to be used as a two-component developer.

As the carrier particles for the two-component developer, magnetic metals such as surface-oxidized or unoxidized iron, nickel, copper, zinc, cobalt, manganese, chromium and rare earth elements, alloys thereof, oxides thereof, and ferrite may be used. There are no particular limitations on their production process.

For the purpose of charge control and so forth, it is also preferable to coat the surfaces of the carrier particles with a coating material having a resin. As methods therefor, any conventional known methods may be used, as exemplified by a method in which the coating material having a resin is dissolved or suspended in a solvent and the resultant solution or suspension is coated to make it adhere to the carrier particles. In order to make the coat layers stable, a method in which the coating material is dissolved in a solvent and the resultant solution is coated is preferred.

The coating material coated on the surfaces of carrier particles may differ depending on the materials for toners. It is preferable to use, e.g., aminoacrylate resins, acrylic resins or copolymers of any of these resins with styrene resins.

As a resin for forming a negatively chargeable coating material, silicone resins, polyester resins, fluorine resins, polytetrafluoroethylene, monochlorotrifluoroethylene polymers and polyvinylidene fluoride are preferred, which are positioned on the negative side in the triboelectric series, but not necessarily limited to these. The coat quantity (coverage) of any of these compound may be appropriately determined so as to achieve a satisfactory charging performance of the carrier. In usual instances, it may preferably be in the range of from 0.1 to 30% by weight, and more preferably from 0.3 to 20% by weight.

Materials for the carrier used in the present invention are typified by ferrite particles composed of 98% or more of Cu—Zn—Fe [compositional ratio: (5 to 20):(5 to 20):(30 to 80)], but there are no particular limitations so long as the performance of the carrier is not damaged. The carrier may also be in the form of a resin carrier constituted of a binder resin, a metal oxide and a magnetic metal oxide.

The carrier may preferably have an average particle diameter of from 35 to 65 $\mu$m, and more preferably from 40 to 60 $\mu$m. Also, good images can be formed when, in volume distribution, particles with particle diameters of 26 $\mu$m or smaller are in a content of from 2 to 6%, particles with particle diameters of from 35 to 43 $\mu$m are in a content of from 5 to 25% and particles with particle diameters of 74 $\mu$m or larger are in a content of not more than 2%.

The above carrier particles and toner particles may be mixed in such a proportion as to be from 2 to 9% by weight, and preferably from 3 to 8% by weight, as a toner concentration in the two-component developer, within the range of which good results can be obtained. If the toner is in a concentration less than 2% by weight, images may have too low a density to be tolerable for practical use. If it is in a concentration more than 9% by weight, fog and in-machine scatter may more occur to shorten the service lifetime of the developer.

The average particle diameter of the carrier can be measured using a commercially available, particle size distribution dry measuring system. Stated specifically, a dry-dispersion apparatus RODOS (manufactured by Nippon Denshi K.K.) is fitted to a laser diffraction particle size distribution measuring device HEROS (manufactured by Nippon Denshi K.K.). Samples are measured three times under conditions of a dispersion pressure of 3.0 bar, and an average value of 50% particle diameters based on volume distribution is regarded as the average particle diameter.

The image-forming method employing the toner of the present invention will be described below with reference to the accompanying drawings.

Figure 7:
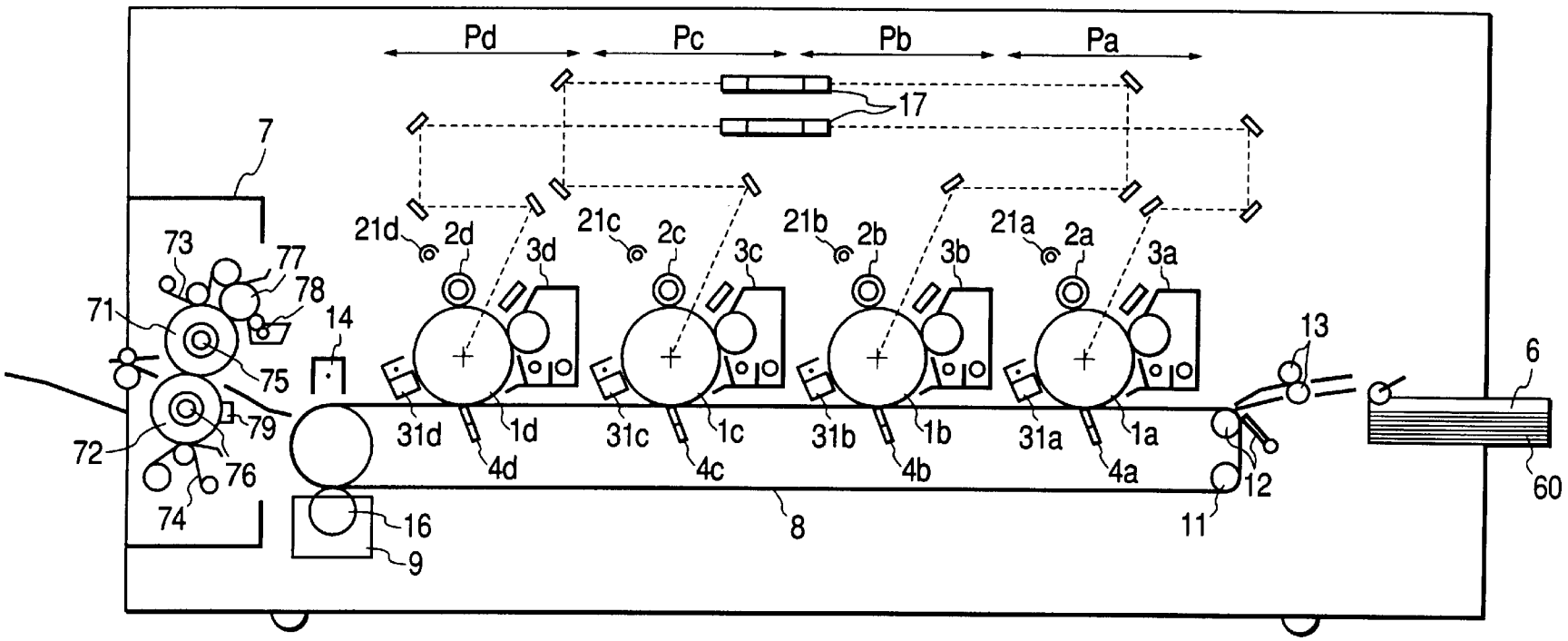
FIG. 7 is a schematic illustration of an image-forming apparatus used in the present invention.

FIG. 7 schematically illustrates an image-forming apparatus that can carry out the image-forming method of the present invention.

The main body of the image-forming apparatus is provided side by side with a first image-forming unit Pa, a second image-forming unit Pb, a third image-forming unit Pc and a fourth image-forming unit Pd, and images with respectively different colors are formed on a transfer medium through the processes of latent image formation, development and transfer.

Figure 8:
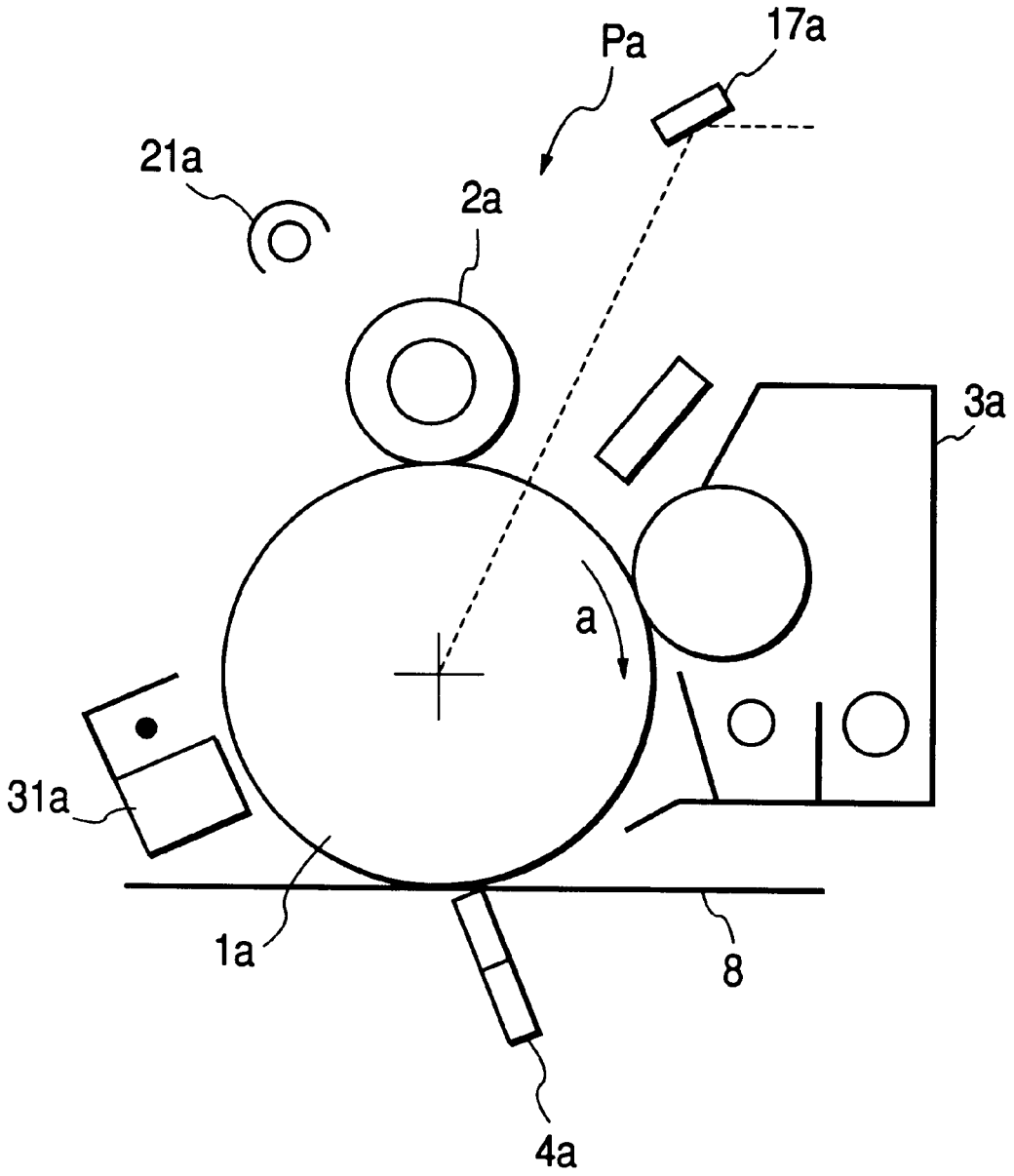
FIG. 8 is a schematic illustration of a first image-forming unit.

The respective image-forming unit provided side by side in the image-forming apparatus are each constituted as described below taking the first image-forming unit Pa as an example, shown in FIG. 8.

The first image-forming unit Pa has an electrophotographic photosensitive drum 1*a* as a latent image bearing member. This photosensitive drum 1*a* is rotatingly moved in the direction of an arrow a. Reference numeral 2*a* denotes a primary charging assembly as a charging means, and a charging roller is used which is in contact with the photosensitive drum 1*a*. Reference numeral 17*a* denotes a polygon mirror through which laser light is scanned rotatingly, serving as a latent image-forming means for forming an electrostatic latent image on the photosensitive drum 1*a* whose surface has been uniformly charged by means of the primary charging assembly 2*a*. Reference numeral 3*a* denotes a developing assembly as a developing means for developing the electrostatic latent image held on the photosensitive drum 1*a*, to form a color toner image, which holds a color toner. Reference numeral 4*a* denotes a transfer blade as a transfer means for transferring the color toner image formed on the surface of the photosensitive drum 1*a*, to the surface of a recording medium 6 serving as a transfer medium, transported by a belt-like recording medium carrying member 8. This transfer blade 4*a* comes into touch with the back of the recording medium carrying member 8 and can apply a transfer bias.

Reference numeral 21*a* denotes an erase exposure assembly as a charge elimination means for destatitizing the surface of the photosensitive drum 1*a*.

In this first image-forming unit Pa, a photosensitive member of the photosensitive drum 1*a* is uniformly charged by the primary charging assembly 2*a*, and thereafter the electrostatic latent image is formed on the photosensitive member by the latent image-forming means 17*a*. The electrostatic latent image is developed by the developing assembly 3*a* using a color toner. The toner image thus formed by development is transferred to the surface of the recording medium 6 by applying transfer bias from the transfer blade 4*a* coming into touch with the back of the belt-like recording medium carrying member 8 transporting the recording medium 6, at a first transfer zone (the position where the photosensitive member and the recording medium come into contact).

The color toner present on the photosensitive member may be removed from the surface of the photosensitive member by a cleaning means such as a cleaning blade brought into touch with the photosensitive member surface, but is collected by the developing means at the time of development. Thus, the photosensitive member having thereon the transfer residual toner is destatitized by the erase exposure assembly 21*a*, and the above image-forming process is again carried out.

In the image-forming apparatus, the second image-forming unit Pb, third image-forming unit Pc and fourth image-forming unit Pd, constituted in the same way as the first image-forming unit Pa but having different color toners held in the developing assemblies are provided side by side as shown in FIG. 7. For example, a magenta toner is used in the first image-forming unit Pa, a cyan toner in the second image-forming unit Pb, a yellow toner in the third image-forming unit Pc and a black toner in the fourth image-forming unit Pd, and the respective color toners are successively transferred to the recording medium at the transfer zones of the respective image-forming units. In this course, the respective color toners are superimposed while making registration, on the same recording medium during one-time movement of the recording medium. After the transfer is completed, the recording medium 6 is separated from the surface of the recording medium carrying member 8 by a separation charging assembly 14, and then sent to a fixing assembly 7 by a transport means such as a transport belt, where a final full-color image is formed by only-one-time fixing.

The fixing assembly 7 has a fixing roller 71 and a pressure roller 72 in pair. The fixing roller 71 and the pressure roller 72 both have heating means 75 and 76, respectively, in the insides. Reference numerals 73 and 74 each denote a web for removing any stains on the fixing roller and pressure roller; and 77, a coating roller as an oil application means for coating a releasing oil 78 such as silicone oil on the surface of the fixing roller 71.

The unfixed color toner images transferred onto the recording medium 6 are passed through the pressure contact area between the fixing roller 71 and the pressure roller 72, whereupon they are fixed onto the recording medium 6 by the action of heat and pressure.

In FIG. 7, the recording medium carrying member 8 is an endless belt-like member. This belt-like member is moved in the direction of an arrow e by a drive roller 10. Reference numeral 9 denotes a transfer belt cleaning device; 11, a belt follower roller; and 12, a belt charge eliminator. Reference numeral 13 denotes a pair of resist rollers for transporting to the recording medium carrying member 8 the recording medium 6 kept in the recording medium holder 60. Reference numeral 17 denotes a polygon mirror. Through this polygon mirror, laser light emitted from a light source device (not shown) is scanned, where the scanning light whose light flux has been changed in direction by a reflecting mirror is shed on the generatrix of the photosensitive drum through an fθ lens to form latent images corresponding to image signals.

In the present invention, as the charging means for primarily charging the photosensitive member, a contact charging member that carries out charging in contact with the photosensitive member, as exemplified by a roller, a blade or a magnetic bruch, may preferably be used in view of the advantage that the quantity of ozone generated at the time of charging can be controlled. A non-contact charging member such as a corona charging assembly may also be used, which carries out charging in non-contact with the photosensitive member.

As the transfer means, the transfer blade coming into touch with the back of the recording medium carrying member may be replaced with a contact transfer means that comes into contact with the back of the recording medium carrying member and can directly apply a transfer bias, as exemplified by a roller type transfer roller.

The above contact transfer means may also be replaced with a non-contact transfer means that performs transfer by applying a transfer bias from a corona charging assembly provided in non-contact with the back of the recording medium carrying member, as commonly used.

However, in view of the advantage that the quantity of ozone generated at the time of charging can be controlled, it is preferable to use the contact transfer means.

In the above image-forming apparatus, an image-forming method is employed which is of the type the toner image formed on the latent image bearing member is directly transferred to the recording medium without using any intermediate transfer member.

An image-forming method in which the toner image formed on the latent image bearing member is primarily transferred to an intermediate transfer member and the toner image transferred to the intermediate transfer member is secondarily transferred to the recording medium will be described below on an image-forming apparatus shown in FIG. 9.

Figure 9:
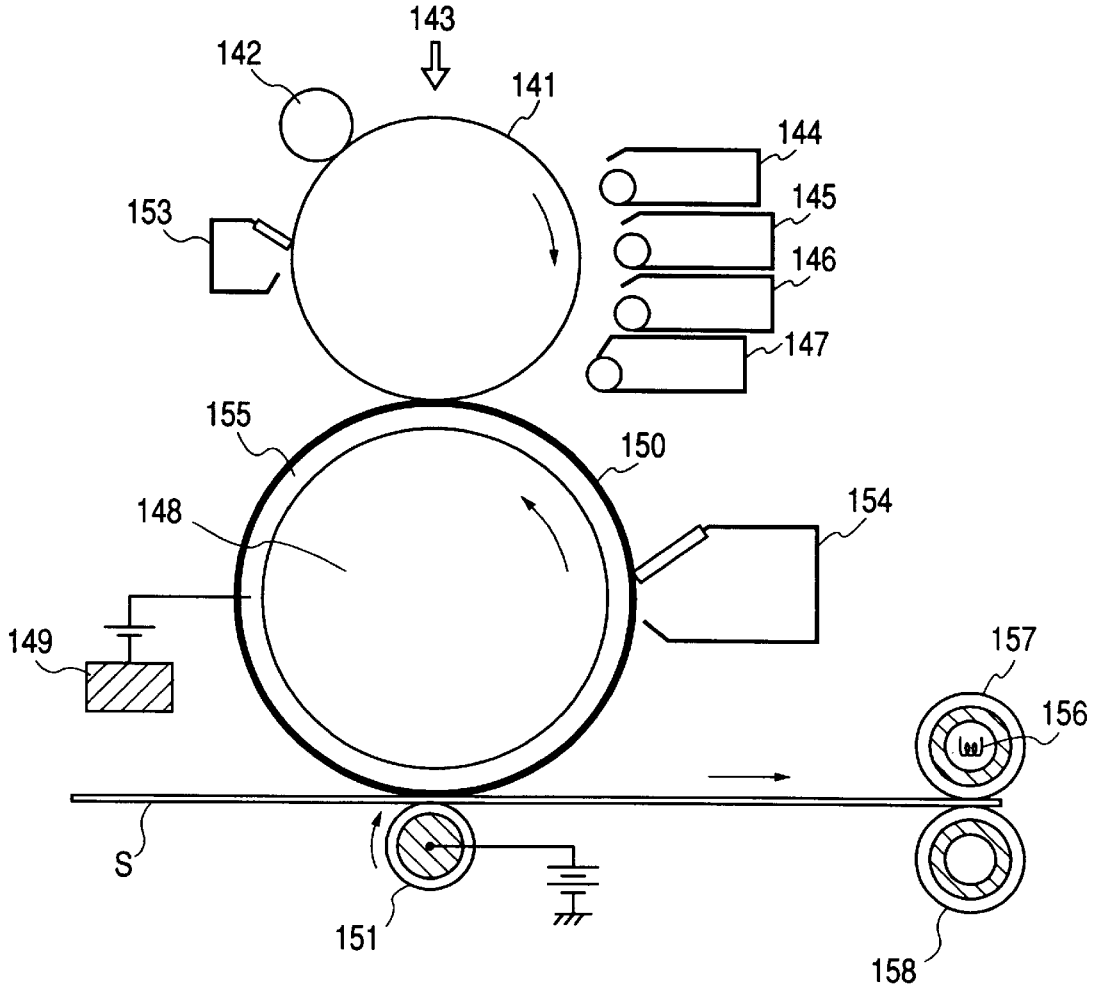
FIG. 9 is a schematic illustration showing another example of an image-forming apparatus used in the present invention.

In the apparatus shown in FIG. 9, the surface of a photosensitive drum 141 is made to have surface potential by a charging roller 142 set opposingly to the photosensitive drum 141 serving as the latent image bearing member and rotated in contact with it, and electrostatic latent images are formed by an exposure means 143. The electrostatic latent images are developed by developing assemblies 144, 145, 146 and 147 using four color toners, a magenta toner, a cyan toner, a yellow toner and a black toner, to form toner images. The toner images are transferred to an intermediate transfer member 148 for each color, and are repeatedly transferred several times to form a multiple toner image.

As the intermediate transfer member 148, a drum member is used, where a member on the periphery of which a holding member has been stuck, or a member comprising a substrate and provided thereon a conductivity-providing member such as an elastic layer (e.g., nitrile-butadiene rubber) in which carbon black, zinc oxide, tin oxide, silicon carbide or titanium oxide has been well dispersed may be used. A belt-like intermediate transfer member may also be used.

The intermediate transfer member 148 may preferably be constituted of an elastic layer 150 having a hardness of from 10 to 50 degrees (JIS K6301), or, in the case of a transfer belt, constituted of a support member 155 having an elastic layer 150 having this hardness at the transfer area where toner images are secondarily transferred to the recording medium.

To transfer toner images from the photosensitive drum 141 to the intermediate transfer member 148, a bias is applied from a power source 149 to a core metal 155 serving as a support member of the intermediate transfer member 148, so that transfer currents are formed and the toner images are transferred. Corona discharge from the back of the holding member or belt, or roller charging may be utilized.

The multiple toner image on the intermediate transfer member 148 is one-time transferred to the recording medium S by a transfer means 151. As the transfer means, a corona charging assembly or a contact electrostatic transfer means making use of a transfer roller or a transfer belt may be used.

The recording medium S having the toner image is sent to a heat fixing assembly having a fixing roller 157 as a fixing member having a heating element 156 in its inside and a pressure roller 158 coming into contact with this fixing roller 157, and is passed through a contact nip between the fixing roller 157 and the pressure roller 158, so that the toner image is fixed to the recording medium S.

The constitution of a developing assembly usable in the present invention will be described below in detail with reference to the accompanying drawings.

In the present invention, either of a contact development system and a non-contact jumping development system may be used, the former being a system in which a developer carried on a developer carrying member is brought into contact with the surface of a photosensitive member in the developing zone, and the latter being a system in which a developer carried on a developer carrying member is caused to fly from the developer carrying member to the surface of a photosensitive member in the developing zone, which developer carrying member is so set as to leave a gap that may make the photosensitive member and a developer layer come into non-contact.

The contact development system may include a developing method making use of the two-component developer having a toner and a carrier and developing method making use of the one-component developer.

Figure 10:
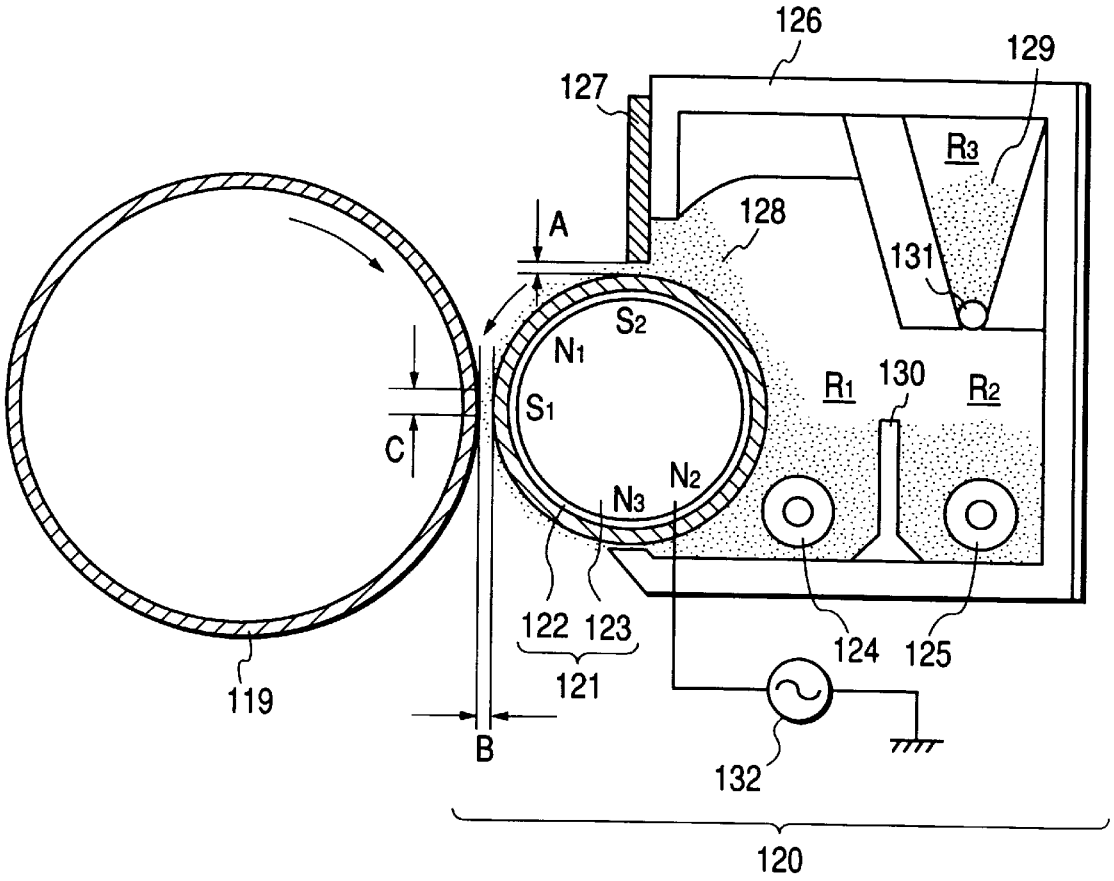
FIG. 10 is a schematic illustration of an image-forming apparatus making use of a two-component developer.

As to the contact two-component developing method, a two-component developer having a toner and a magnetic carrier may be used in, e.g., a developing assembly 120 as shown in FIG. 10 to carry out development.

The developing assembly 120 has a developing container 126 for holding a two-component developer 128, a developing sleeve 121 as a developer carrying member for carrying thereon the two-component developer 128 held in the developing container 126 and for transporting it to the developing zone, and a developing blade 127 as a developer layer thickness regulating means for regulating the layer thickness of a toner layer formed on the developing sleeve 121.

The developing sleeve 121 is internally provided with a magnet 123 in its non-magnetic sleeve substrate 122.

The inside of the developing container 126 is partitioned into a developing chamber (first chamber) R1 and an agitator chamber (second chamber) R2 by a partition wall 130. At the upper part of the agitator chamber R2, a toner storage chamber R3 is formed on the other side of the partition wall 130. The developer 128 is held in the developing chamber R1 and agitator chamber R2, and a replenishing toner (non-magnetic toner) 129 is held in the toner storage chamber R3. The toner storage chamber R3 is provided with a supply opening 131 so that the replenishing toner 129 is dropwise supplied through the supply opening 131 into the agitator chamber R2 in the quantity corresponding to the toner consumed.

A transport screw 124 is provided in the developing chamber R1. As the transport screw 124 is rotatingly driven, the developer 128 held in the developing chamber R1 is transported in the longitudinal direction of the developing sleeve 121. Similarly, a transport screw 125 is provided in the agitator chamber R2 and, as the transport screw 125 is rotated, the toner having dropped from the supply opening 131 into the agitator chamber R2 is transported in the longitudinal direction of the developing sleeve 121.

The developer 128 is a two-component developer comprising a non-magnetic toner and a magnetic carrier.

The developing container 126 is provided with an opening at its part adjacent to a photosensitive drum 119, and the developing sleeve 121 protrudes outward from the opening, where a gap is formed between the developing sleeve 121 and the photosensitive drum 119. The developing sleeve 121, formed of a non-magnetic material, is provided with a bias applying means 132 for applying a bias voltage.

The magnet roller serving as a magnetic field generating means fixed inside the developing substrate 122, that is, a magnet 123 has a developing magnetic pole S1, a magnetic pole N3 positioned at its downstream, and magnetic poles N2, S2 and N1 for transporting the developer 128. The magnet 123 is provided inside the sleeve substrate 122 in such a way that the developing magnetic pole S1 faces the photosensitive drum 119. The developing magnetic pole S1 forms a magnetic field in the vicinity of the developing zone defined between the developing sleeve 121 and the photosensitive drum 119, where a magnetic brush is formed by the magnetic field.

The developer-regulating blade 127 provided above the developing sleeve 121 to control the layer thickness of the developer 128 on the developing sleeve 121 is made of a non-magnetic material such as aluminum or SUS 316 stainless steel. The distance A between an end of the non-magnetic blade 127 and the face of the developing sleeve 121 is 300 to 1,000 $\mu$m, and preferably 400 to 900 $\mu$m. If this distance is smaller than 300 $\mu$m, the magnetic carrier may be caught between them to tend to make the developing layer uneven, and also the developer necessary for carrying out good development can not be coated on the sleeve, bringing about the problem that only developed images with a low density and much unevenness can be obtained. In order to prevent uneven coating (what is called the blade clog) due to unauthorized particles included in the developer, the distance may preferably be 400 $\mu$m or larger. If it is more than 1,000 $\mu$m or larger, the quantity of the developer coated on the developing sleeve 121 increases to enable no desired regulation of the developer layer thickness, bringing about the problems that the magnetic carrier particles adhere to the photosensitive drum 119 in a large quantity and also the circulation of the developer and the control of the developer by the non-magnetic blade 127 may become ineffective to tend to cause fog because of a shortage of triboelectricity of the toner.

The development by this two-component developing assembly 120 may preferably be carried out while applying an alternating electric field and in such a state that a magnetic brush formed of the toner and the magnetic carrier comes into touch with the latent image bearing member (e,g, a photosensitive drum) 119. A distance B between the developer carrying member (developing sleeve) 121 and the photosensitive drum 119 (distance between S-D) may preferably be from 100 to 1,000 $\mu$m. This is desirable for preventing carrier adhesion and improving dot reproducibility. If it is smaller (i.e., the gap is narrower) than 100 $\mu$m, the developer tends to be insufficiently fed, resulting in a low image density. If it is larger than 1,000 $\mu$m, the magnetic line of force from the magnet S1 may broaden to make the magnetic brush have a low density, resulting in a poor dot reproducibility, or to weaken the force of binding the carrier, tending to cause carrier adhesion.

The alternating electric field may preferably be applied at a peak-to-peak voltage of from 500 to 5,000 V and a frequency of from 500 to 10,000 Hz, and preferably from 500 to 3,000 Hz, which may each be applied under appropriate selection. In this instance, the waveform used may be selected from triangular waveform, rectangular waveform, sinusoidal waveform, or waveform with a varied duty ratio. If the applied voltage is lower than 500 V, a sufficient image density can be attained with difficulty, and fog toner at non-image areas may not be well collected in some cases. If it is higher than 5,000 V, the latent image may be disordered through the magnetic brush to cause a lowering of image quality.

Use of a two-component developer having a toner well charged enables application of a low fog take-off voltage (Vback), and enables the photosensitive member to be low charged in its primary charging, thus the photosensitive member can be made to have a longer lifetime. The Vback, which may depend on the development system, may preferably be 150 V or below, and more preferably 100 V or below.

As contrast potential, a potential of from 200 V to 500 V may preferably be used so that a sufficient image density can be achieved.

If the frequency is lower than 500 Hz, electric charges may be injected into the carrier, in relation also to the process speed, so that carrier adhesion may occur or latent images may be disordered to cause a lowering of image quality. If it is higher than 10,000 Hz, the toner can not follow up the electric field to tend to cause a lowering of image quality.

In order to carry out development promising a sufficient image density, achieving a superior dot reproducibility and free of carrier adhesion, the magnetic brush on the developing sleeve 121 may preferably be made to come into touch with the photosensitive drum 119 at a width (developing nip C) of from 3 to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. As methods for adjusting the developing nip, the nip width may appropriately be adjusted by adjusting the distance A between the developer-regulating blade 127 and the developing sleeve 121, or by adjusting the distance B between the developing sleeve 121 and the photosensitive drum 119.

The transfer residual toner on the photosensitive member is collected at the time of development, by the magnetic brush formed of the toner and the carrier.

Figure 11:
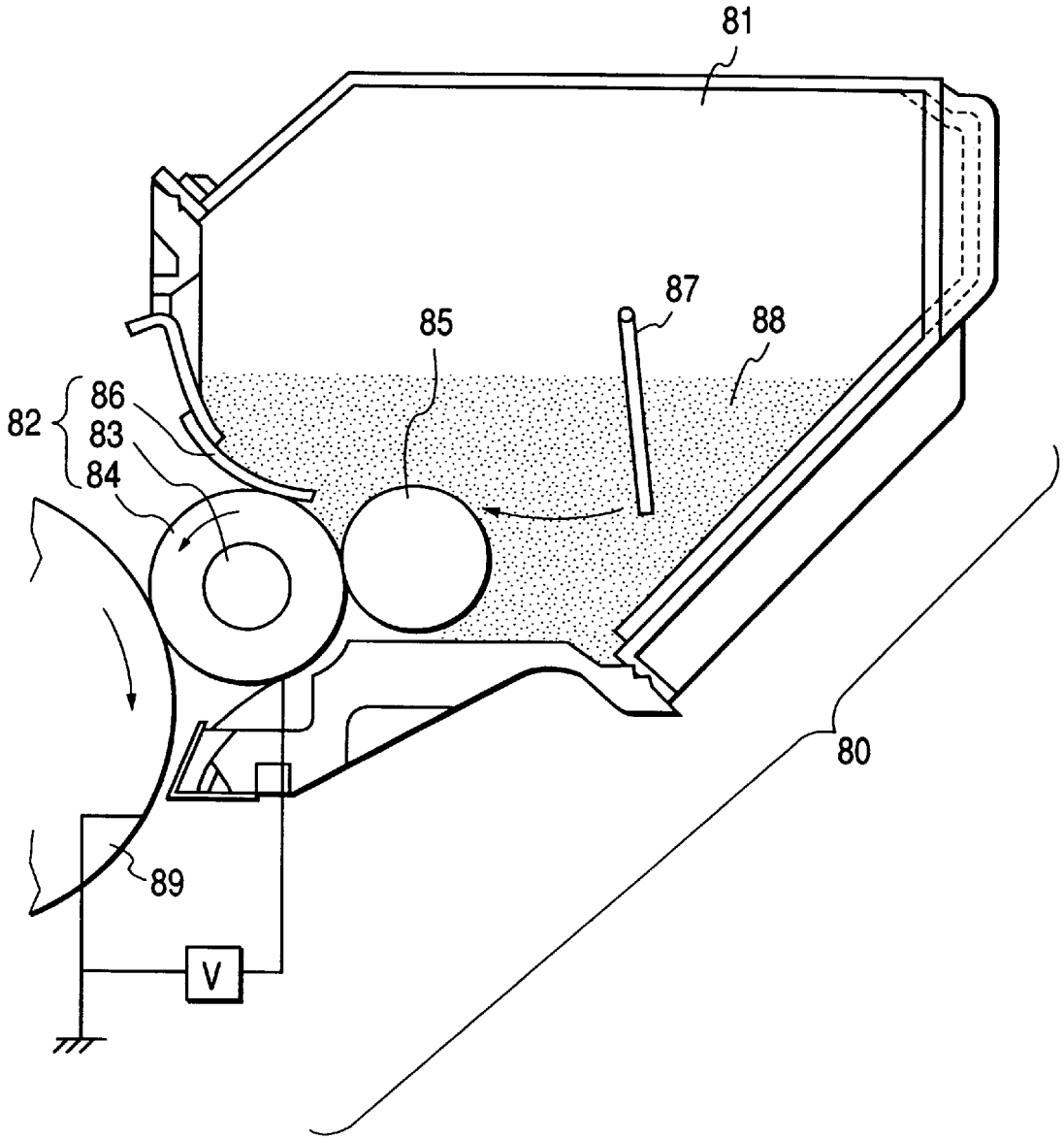
FIG. 11 is a schematic illustration of a developing assembly that embodies contact one-component development.

As for the contact one-component developing method, a non-magnetic toner may be used in, e.g., a developing assembly 80 as shown in FIG. 11 to carry out development.

The developing assembly 80 has a developing container 81 for holding a one-component developer 88 having a magnetic or non-magnetic toner, a developer carrying member 82 for carrying thereon the one-component developer 88 held in the developing container 81 and for transporting it to the developing zone, a feed roller 85 for feeding a developer onto the developer carrying member, an elastic blade 86 as a developer layer thickness regulating member for regulating the layer thickness of a developer layer formed on the developer carrying member, and an agitating member 87 for agitating the developer 88 held in the developing container 81.

As the developer carrying member 82, an elastic roller may preferably be used which has an elastic layer 84 formed of a rubber having an elasticity, such as silicone rubber, or formed of an elastic member such as resin.

This elastic roller 82 comes into pressure contact with the surface of a photosensitive member (drum) 89 serving as a latent image bearing member and acts to develop an electrostatic latent image formed on the photosensitive member by the use of the one-component developer 88 coated on the surface of the elastic roller and also collects unnecessary one-component developer 88 present on the photosensitive member after transfer.

In the present invention, the developer carrying member substantially comes into contact with the photosensitive member surface. This means that the developer carrying member comes into contact with the photosensitive member when the one-component developer is removed from the developer carrying member. Here, images free of any edge effect can be formed by the aid of an electric field acting across the photosensitive member and the developer carrying member through the developer and simultaneously the photosensitive member surface is cleaned. The surface, or the vicinity of the surface, of the elastic roller serving as the developer carrying member must have a potential to have the electric field across the photosensitive member surface and the elastic roller surface. Thus, a method may be used in which the elastic rubber of the elastic roller is controlled to have a resistance in a medium-resistance region so as to keep the electric field while preventing its conduction with the photosensitive member surface, or a thin-layer dielectric layer is provided on the surface layer of a conductive roller. It is also possible to use a conductive resin sleeve comprising a conductive roller coated with an insulating material on its outer-surface side coming into contact with the photosensitive member surface, or to use an insulating sleeve so made up that a conductive layer is provided on its inner-surface side not coming into contact with the photosensitive member surface.

This elastic roller carrying the one-component developer may be rotated in the same direction as the photosensitive drum, or may be rotated in the direction reverse thereto. When the former is rotated in the same direction as the latter, it may be rotated at a peripheral speed greater by more than 100% with respect to the peripheral speed of the photosensitive drum. If it is rotated at a peripheral speed greater by 100% or less, a problem may occur on image quality such that line images have a poor sharpness. The higher the peripheral speed is, the larger the quantity of the developer fed to the development zone is and the more frequently the developer is attached on and detached from electrostatic latent images. Thus, the developer at the unnecessary areas is scraped off and the developer is imparted to the necessary areas; this is repeated, whereupon images faithful to the electrostatic latent images are formed. More preferably, the elastic roller may be rotated at a peripheral speed greater by 100% or more.

The developer layer thickness regulating member 86 may not be limited to the elastic blade so long as it can elastically come into pressure contact with the surface of the developer carrying member 82, and may be replaced with an elastic roller.

The elastic blade or elastic roller may be comprised of a rubber elastic material such as silicone rubber, urethane rubber and NBR, a synthetic resin elastic material such as polyethylene terephthalate, or a metal elastic member such as stainless steel or steel, any of which may be used. A composite of some of these may also be used.

In the case of the elastic blade, the elastic blade is, at its upper-edge side base portion, fixedly held on the side of the developer contained and is so provided that its blade inner-face side (or its outer-face side in the case of the adverse direction) is, at its lower-edge side, brought into touch with the sleeve surface under an appropriate elastic pressure in such a state that it is deflected against the elasticity of the blade in the fair direction or adverse direction of the rotation of the developing sleeve.

A feed roller 85 is comprised of a foamed material such as polyurethane foam, and is rotated at a relative speed that is not zero in the fair direction or adverse direction with respect to the developer carrying member so that the one-component developer can be fed onto the developer carrying member and also the developer remaining on the developer carrying member after transfer (the developer not participated in development) can be taken off.

In the developing zone, when the electrostatic latent image on the photosensitive member is developed by the use of the one-component developer carried on the developer carrying member, a DC and/or AC development bias may preferably be applied across the developer carrying member and the photosensitive member (drum) to carry out development.

The non-contact jumping development system will be described below.

The non-contact jumping development system may include a developing method making use of a one-component developer having a magnetic toner or non-magnetic toner.

Figure 12:
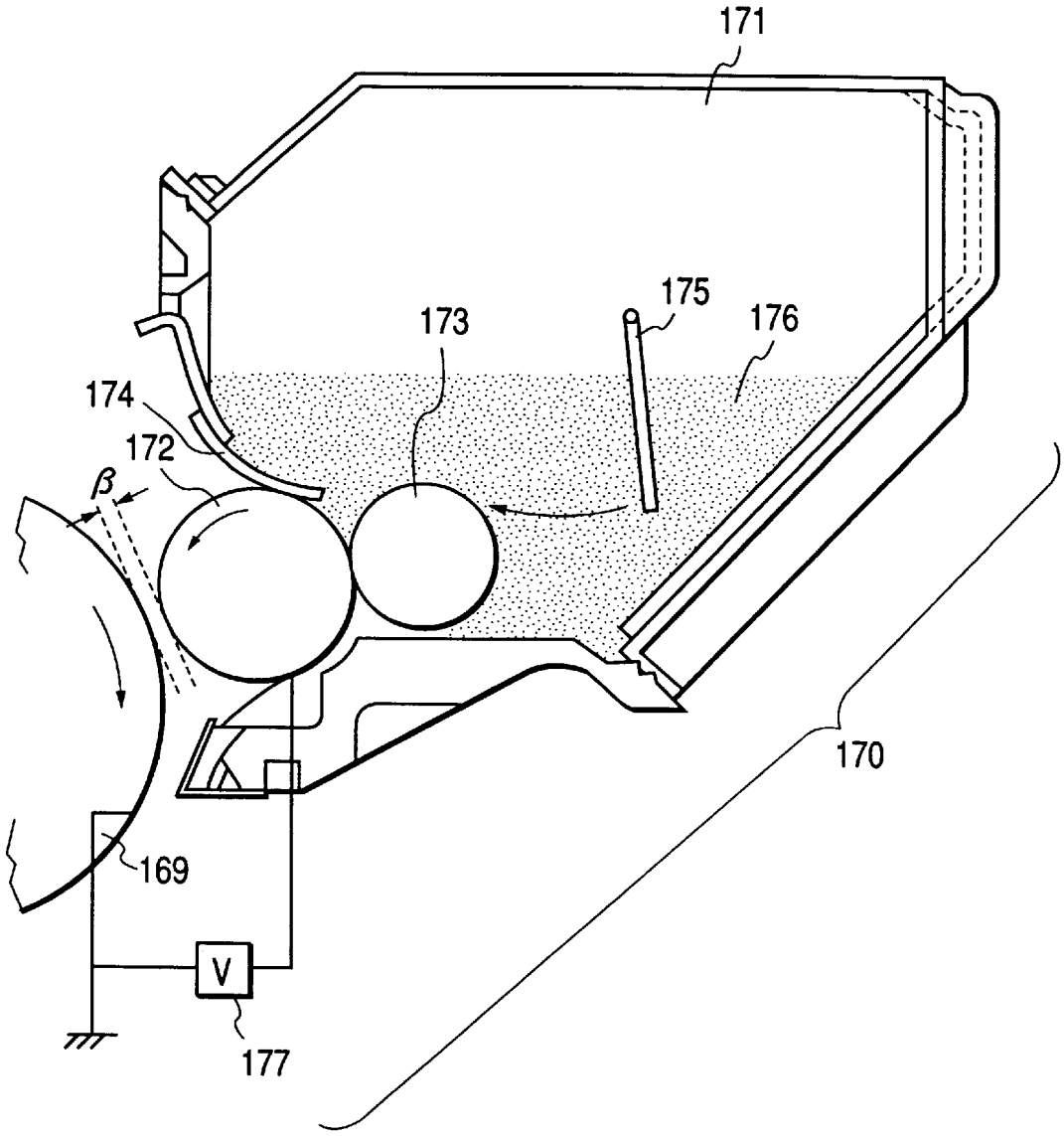
FIG. 12 is a schematic illustration of a developing assembly that embodies non-contact one-component development.

Herein, the developing method making use of a one-component non-magnetic developer having a non-magnetic toner will be described with reference to a schematic view of its constitution as shown in FIG. 12.

A developing assembly 170 has a developing container 171 for holding the one-component non-magnetic developer 176 having a non-magnetic toner, a developer carrying member 172 for carrying thereon the one-component non-magnetic developer 176 held in the developing container 171 and for transporting it to the developing zone, a feed roller 173 for feeding the one-component non-magnetic developer onto the the developer carrying member, an elastic blade 174 as a developer layer thickness regulating member for regulating the thickness of a developer layer formed on the developer carrying member, and an agitating member 175 for agitating the one-component non-magnetic developer 176 held in the developing container 171.

Reference numeral 169 denotes an electrostatic latent image bearing member, on which latent images are formed by an electrophotographic processing means or electrostatic recording means (not shown). Reference numeral 172 denotes a developing sleeve serving as the developer carrying member, and is comprised of a non-magnetic sleeve made of aluminum or stainless steel.

The developing sleeve may be prepared using a crude pipe of aluminum or stainless as it is, and may preferably be prepared by spraying glass beads on it to uniformly rough the surface, by mirror-finishing its surface or by coating its surface with a resin.

The one-component non-magnetic developer 176 is reserved in the developing container 171, and is fed onto the developer carrying member 172 by the feed roller 173. The feed roller 173 is comprised of a foamed material such as polyurethane foam, and is rotated at a relative speed that is not zero in the fair direction or adverse direction with respect to the developer carrying member so that the developer can be fed onto the developer carrying member and also the developer remaining on the developer carrying member 172 after transfer (the developer not participated in development) can be taken off. The one-component non-magnetic developer fed onto the developer carrying member 172 is coated thereon uniformly and in thin layer by the elastic blade 174 serving as the developer layer thickness regulating member.

It is effective for the elastic member to be brought into touch with the developer carrying member at a pressure of from 0.3 to 25 kg/m, and preferably from 0.5 to 12 kg/cm, as a linear pressure in the generatrix direction of the developer carrying member. If the touch pressure is smaller than 0.3 kg/m, it is difficult to uniformly coat the one-component non-magnetic developer, resulting in a broad charge quantity distribution of the one-component non-magnetic developer to cause fog or black spots around line images. If the touch pressure is greater than 25 kg/m, a great pressure is applied to the one-component non-magnetic developer to cause deterioration of the one-component non-magnetic developer and occurrence of agglomeration of the one-component non-magnetic developer, thus such a pressure is not preferable, and also not preferable because a great torque is required in order to drive the developer carrying member. That is, the adjustment of the touch pressure to 0.3 to 25 kg/m makes it possible to effectively loosen the agglomeration of one-component non-magnetic developer and makes it possible to effect instantaneous rise of the charge quantity of one-component non-magnetic developer.

As the developer layer thickness regulating member, an elastic blade or an elastic roller may be used, and it is preferable to use those made of a material of triboelectric series, suited for electrostatically charging the developer to the desired polarity.

In the present invention, silicone rubber, urethane rubber or styrene-butadiene rubber is preferred. An organic resin layer may also be provided which is formed of a resin such as polyamide, polyimide, nylon, melamine, melamine cross-linked nylon, phenol resin, fluorine resin, silicone resin, polyester resin, urethane resin or styrene resin. A conductive rubber or conductive resin may be used, and a filler such as metal oxide, carbon black, inorganic whisker or inorganic fiber and a charge control agent may be further dispersed in the rubber or resin of the elastic blade. This is preferable because appropriate conductivity and charge-providing properties can be imparted to the blade and the one-component non-magnetic developer can be appropriately charged.

In this non-magnetic one-component developing method, when the one-component non-magnetic developer is coated in thin layer on the developing sleeve, it is preferable in order to achieve a sufficient image density that the thickness of the one-component non-magnetic developer on the developing sleeve is set smaller than a gap length p where the developing sleeve faces the latent image bearing member and an alternating electric field is applied to this gap. More specifically, an alternating electric field or a development bias formed by superimposing a direct current electric field on an alternating electric field is applied across the developing sleeve 172 and the latent image bearing member 169 by a bias power source 177 shown in FIG. 12. This facilitates the movement of the one-component non-magnetic developer from the developing sleeve to the latent image bearing member to enable formation of images with a much better quality.

The step of charging for the primary charging of the surface of the latent image bearing member by the use of the contact charging member used in the above image-forming method will be described below in detail.

In the present invention, for the primary charging of the surface of the latent image bearing member by contact charging, a voltage is applied to a photosensitive member having a charge injection layer having a volume resistivity of from $10^8$ to $10^{15}$ Ω.cm at its surface while bringing into contact with it a contact charging member whose volume resistivity as measured by dynamic resistance measurement made by bringing the contact charging member into contact with a conductor rotary-member substrate is within the range of from $10^4$ Ω.cm to $10^{10}$ Ω.cm in the applied electric field range of from 20 to V1 (V/cm) when an electric field which is higher between $|V-VD|/d$ and $|V|/d$ is regarded as the V1 (V/cm). Here, V is a voltage applied to the contact charging member, VD is a potential on the surface of the photosensitive member at the time of its rush into the nip between the photosensitive member and the contact charging member, and d is a distance between a voltage-applied part of the contact charging member and the photosensitive member.

Such constitution according to the present invention which makes use of the contact charging member and the photosensitive member as described above makes it possible to make a charging start voltage Vh small and to charge the photosensitive member to have a charged electric potential of as much as almost 90% or more of the voltage applied to the contact charging member. For example, when a DC voltage of from 100 to 2,000 V as an absolute value is applied to the contact charging member, the electrophotographic photosensitive member having a charge injection layer can be made to have a charged electric potential of 80% or more, or further 90% or more, of the applied voltage. In contrast thereto, the charged electric potential of a photosensitive member, attained by conventional charging that utilizes discharging, is almost 0 V when the applied voltage is 640 V or below. When the applied voltage is above 640 V, only a charged electric potential of a value given by subtracting 640 V from the applied voltage is attained at best.

Thus, in the present invention, a medium-resistance contact charging member is used in order to prevent pinhole leak from occurring or prevent the contact charging member from sticking to the photosensitive member, and concurrently a charge injection layer for assisting the injection of charges into the photosensitive member is provided on the surface of the photosensitive member as a means for improving charge-injection charging efficiency on the photosensitive member. Such constitution is preferred.

The charge injection layer may be a layer constituted of a material obtained by dispersing light-transmitting and conductive particles in an insulating binder so as to have a medium resistance, a layer constituted of an insulating binder mixed or copolymerized with a highly light-transmitting resin having an ion conductivity, or a layer constituted solely of a resin having a medium resistance and a photoconductivity, any of which can be considered usable. The charge injection layer constituted of any of these may preferably have a resistivity of about $10^8$ to $10^{15}$ Ω.cm.

Under the constitution as described above, it is possible to achieve both the charging by charge injection that has not hitherto taken place unless the contact charging member has a resistivity of $10^3$ Ω.cm or below and the prevention of pinhole leak that has not been able to achieve unless it on the other hand has a resistivity of $10^4$ Ω.cm or above.

In the present invention, in order to simultaneously satisfy the good performance of the charging by charge injection that has not hitherto taken place unless the contact charging member having a low resistivity is used and the prevention of leak due to pinholes on the photosensitive member that has not been able to achieve if the the contact charging member having a low resistivity is used and also in order to achieve a sufficient potential convergence, the contact charging member that comes into contact with the photosensitive member having the charge injection layer and carries out charging by injection of charges may preferably have a volume resistivity within the range of from $10^4$ Ω.cm to $10^{10}$ Ω.cm in the above applied electric field range of from 20 to V1 (V/cm).

The volume resistivity is measured in an environment of 23° C./65% RH.

In general, the resistivity of charging members varies depending on electric fields applied to the charging members. In particular, resistivity decreases when a high electric field is applied and increases when a low electric field is applied, thus its dependence on applied electric fields is seen.

In the instance where the photosensitive member is charged by injecting charges into it, when the surface to be charged, of the photosensitive member has rushed into the nip between the photosensitive member and the contact charging member (on the upstream side as viewed from the contact charging member), the difference in voltage between the charged electric potential of the photosensitive member surface before its rush into the nip and the voltage applied to the contact charging member is so great that the contact charging member has a high applied electric field. However, once the photosensitive member charged-surface has passed the nip, charges are injected into the photosensitive member and the charges are gradually eliminated at the nip, so that the potential on the photosensitive member gradually approaches the value of 0 V and hence the electric field applied to the contact charging member becomes smaller correspondingly. Namely, it follows that the electric field applied to the contact charging member in the step of charging the photosensitive member is different on the upstream side and downstream side of the nip portion of the contact charging member, and the electric field applied to the contact charging member is high on its upstream side and low on its downstream side.

Thus, in an instance where the photosensitive member has passed the step of eliminating charges, e.g., pre-exposure, before the charging step is carried out, the potential on the surface of the photosensitive member at the time of its rush into the nip between the photosensitive member and the contact charging member is substantially 0 V, and hence the applied electric field on the upstream side substantially depends on the voltage applied to the contact charging member. However, in an instance where such a charge eliminating step is not provided, it depends on the applied voltage and polarity at the time of charging and transfer, i.e., depends on the potential on the photosensitive member after transfer and the voltage applied to the contact charging member.

More specifically, in the instance where the photosensitive member is charged by injecting charges into it, if the volume resistivity of the contact charging member is, e.g., a value exceeding $10^{10}$ Ω.cm in the applied electric field range of $0.3\times|V|/d$ (V/cm) or below in the applied voltage of 30% of the voltage applied to the contact charging member even when it is within the range of from $10^4$ Ω.cm to $10^{10}$ Ω.cm at a certain point of applied electric field, the charging by charge injection on the downstream side of the nip between the photosensitive member and the contact charging member is so greatly poor that, although the charging is well done up to 70% of the applied voltage, charges of the remaining 30% can not be well injected. Thus, the charges are injected into the photosensitive member with difficulty and the photosensitive member can not be charged to the desired potential, resulting in faulty charging. Namely, this means that the volume resistivity in the application of a low electric field greatly affects the performance of charge injection into the photosensitive member.

Accordingly, it is necessary to use the contact charging member whose volume resistivity as measured by dynamic resistance measurement made by bringing the contact charging member into contact with a conductor rotary-member substrate is within the range of from $10^4$ Ω.cm to $10^{10}$ Ω.cm in the applied electric field range of from 20 to V1 (V/cm) when an electric field which is higher between $|V-VD|/d$ and $|V|/d$ is regarded as the V1 (V/cm). Thus, a potential substantially equivalent to the applied voltage can be attained on the photosensitive member.

If on the other hand the contact charging member has a volume resistivity below $10^4$ Ω.cm in the applied electric field in the voltage applied thereto, excessive leak currents may flow from the contact charging member into the scratches or pinholes produced at the photosensitive member surface, to cause faulty charging on the surroundings, expansion of pinholes, and electrification failure of the contact charging member. Since the scratches or pinholes on the photosensitive member surface stand bare to the surface, the potential on the photosensitive member is 0 V, and hence the maximum applied electric field concerning the contact charging member depends on the voltage applied to the contact charging member.

Namely, even controlling the volume resistivity of the contact charging member within the range of from $10^4$ Ω.cm to $10^{10}$ Ω.cm at a certain point of applied electric field may result in faulty charging and a poor breakdown strength.

Accordingly, the volume resistivity must be within the range of from $10^4$ Ω.cm to $10^{10}$ Ω.cm in the applied electric field range of from 20 to V1 (V/cm) when an electric field which is higher between i) the applied electric field that depends on the voltage difference between the potential of the photosensitive member on the upstream side of the nip between it and the contact charging member and ii) the applied electric field that depends on the voltage applied to the contact charging member when the pre-exposure step is provided or the scratches or pinholes are present at the surface of the photosensitive member, is regarded as the V1 (V/cm). The distance (d) between the voltage-applied part of the contact charging member and the photosensitive member is preferably from 300 $\mu$m to 800 $\mu$m in view of obtaining good chargeability.

The greater the width of the nip between the photosensitive member and the contact charging member is, the larger the area of contact between the photosensitive member and the contact charging member is and also the longer the contact time is. Accordingly, charges are well injected into the surface portion of the photosensitive member and the photosensitive member is well charged. However, in order to achieve a sufficient charge injection performance even when the nip is narrowed, the contact charging member may preferably have, in its applied electric field range, a resistivity within the range of $R1/R2 \leqq 1{,}000$ where the maximum resistivity and minimum resistivity ascribable to applied electric fields are represented by R1 and R2, respectively. This is because any abrupt change in resistance in the step where the photosensitive member is charged at the nip may cause the charge injection into the photosensitive member not to follow, so that the surface to be charged may pass the nip and may be insufficiently charged.

At the voltage applied to the contact charging member, the charge of toner can not be well effectively adjusted to the normal charge polarity of toner in the case of AC charging, and the charge of toner can be adjusted to the normal charge polarity of toner in the case of DC charging but the charge of toner tends to become excess, leaving a possibility of adversely affecting the development. On the other hand, in the present invention, the constitution which makes use of the photosensitive member and the contact charging member as described above makes it possible to adjust the charge of the transfer residual toner to the normal charge polarity of toner and also to properly control the charge quantity. Thus, it has become possible to provide an image-forming method that can well collect the transfer residual toner and can carry out stable development repeatedly.

In the present invention, the triboelectricity produced between the contact charging member and the photosensitive member may preferably have the same polarity as the charge polarity of the photosensitive member. According to findings the present inventors have reached, the charged electric potential of the photosensitive member in the step of charging by charge injection corresponds to its injection performance to which the triboelectricity produced between the contact charging member and the photosensitive member has been added. If the triboelectricity produced between the contact charging member and the photosensitive member has a polarity reverse to the charge polarity of the photosensitive member, the potential of the photosensitive member decreases for the portion of the triboelectricity, so that a potential difference is produced between the contact charging member and the photosensitive member surface. The decrease in potential of the photosensitive member, ascribable to the triboelectricity is up to about tens of V. This electric field, however, may make any transfer residual toner on the contact charging member not be well collected and retained and, when the contact charging member comprises magnetic particles or the like, may cause their transfer to the photosensitive member to cause faulty images such as positive ghost and fog.

In the present invention, the contact charging member may preferably be moved at a difference in peripheral speed with respect to the photosensitive member. Setting the moving speed of the surface of the contact charging member and the moving speed of the photosensitive member different from each other makes it possible to keep a long lifetime of the photosensitive member and simultaneously achieve a long lifetime of the charging roller (contact charging member) while ensuring charging stability over a long period time, so that the charging can be made highly stable and the image-forming system itself can be made highly long-life. More specifically, the toner tends to adhere to the surface of the contact charging member and the toner having adhered thereto tends to inhibit charging. By setting the moving speed of the photosensitive member surface and the moving speed of the contact charging member surface different from each other, the surface of the contact charging member can be supplied substantially in a greater quantity (surface quantity) to the same photosensitive member surface. This can be effective against the inhibition of charging. Namely, when the transfer residual toner comes to the charged portion, some toner attracted to the photosensitive member at a small force moves to the contact charging member because of the electric field to cause a local change in the resistance of the contact charging member surface, so that its discharge path may be shut off to make it hard for the photosensitive member to have its potential, resulting in occurrence of faulty charging. Such a problem can be effectively eliminated.

From the viewpoint of the cleaning-at-development, the difference in peripheral speed between the contact charging member and the photosensitive member can be expected to be also effective for improving efficiency when the part of the contact charging member surface to which the toner has adhered is physically taken off the photosensitive member surface and the toner is collected by the aid of the electric field. Thus, the transfer residual toner can be charge-controlled in a higher efficiency so that it can be collected at development in an improved efficiency.

Setting the difference in peripheral speed between the photosensitive member surface and the contact charging member surface may cause wear or contamination of the photosensitive member surface or contact charging member surface because of the effect of mutual friction. In order to prevent this, the photosensitive member surface may have a contact angle to water of 85 degrees or more, and preferably Such a photosensor more. Such a photosensitive member is effective.

In the case when the moving speed of the photosensitive member surface is set different from the moving speed of the contact charging member surface, the part of contact between the photosensitive member and the roller (contact charging member) has an absolute value of v/V where the moving speed of the photosensitive member surface is represented by V and the moving speed of the contact charging member surface by v. This can bring about stable characteristics in the charging performance and the transfer residual toner can be collected at development in an improved efficiency.

The contact charging member may have any shape of a blade and a brush. In order to properly set the difference in peripheral speed, it is considered advantageous for it to have the-shape of a rotatable roller, belt or brush roller.

As a roller type contact charging member, materials therefor are disclosed in, e.g., Japanese Patent Application Laid-Open No. 1-211799. As a conductive substrate therefor, metals such as iron, copper and stainless steel, carbon-dispersed resins and metal- or metal-oxide-dispersed resins may be used.

As the contact charging member, an elastic roller may be used, which may be constituted of a conductive substrate and provided thereon an elastic layer, a conductive layer and a resistance layer.

The elastic layer may be formed of a rubber such as chloroprene rubber, isoprene rubber, EPDM rubber, polyurethane rubber, epoxy rubber or butyl rubber or sponge, or a thermoplastic elastomer such as a styrene-butadiene thermoplastic elastomer, a polyurethane thermoplastic elastomer, a polyester thermoplastic elastomer or an ethylene-vinyl acetate thermoplastic elastomer.

The conductive layer may preferably have a volume resistivity of $10^7$ Ω.cm or below, and preferably $10^6$ Ω.cm or below. For example, metal-deposited film, a conductive-particle-dispersed resin or a conductive resin may be used. As specific examples, the metal-deposited film may include deposited films of metals such as aluminum, indium, nickel, copper and iron. As examples of the conductive-particle-dispersed resin, it may include those prepared by dispersing conductive particles such as carbon, aluminum, nickel or titanium oxide particles in a resin such as urethane, polyester, a vinyl acetate-vinyl chloride copolymer or polymethyl methacrylate. The conductive resin may include quaternary ammonium salt-containing polymethyl methacrylate, polyvinyl aniline, polyvinyl pyrrole, polyacetylene and polyethyleneimine.

The resistance layer is, e.g., a layer having a volume resistivity of $10^6$ to $10^{12}$ Ω.cm, and a semiconductive resin, a conductive-particle-dispersed insulating resin or the like may be used. As the semiconductive resin, resins such as ethyl cellulose, nitro cellulose, methoxymethylated nylon, ethoxymethylated nylon, copolymer nylon, polyvinyl pyrrolidone and casein may be used. As examples of the conductive-particle-dispersed insulating resin, it may include those prepared by dispersing a small quantity of conductive particles such as carbon, aluminum, indium oxide or titanium oxide particles in an insulating resin such as urethane, polyester, a vinyl acetate-vinyl chloride copolymer or polymethyl methacrylate.

One of the preferred embodiments of the present invention is that a rotatable brush roll is used as the contact charging member. The part coming into contact with the photosensitive member is formed of extra-fine fibers. Thus, points of contact with the photosensitive member can be made greatly large in number. This is advantageous for imparting a more uniform charged electric potential to the photosensitive member.

What is preferably used as a fiber aggregate that forms the brush may include an aggregate comprised of extra-fine fiber-generation conjugate fibers, an aggregate comprised of fibers chemically treated with an acid, alkali or organic solvent, a raised fiber-entangled material and an electrostatic flock material.

The charging mechanism that is fundamental in the present invention is considered that a conductive charging layer comes into contact with the charge injection layer at the photosensitive member surface to cause injection of charges from the conductive charging layer into the charge injection layer. Accordingly, the performance required for the contact charging member is to provide the surface of the charge injection layer with a sufficient density and a proper resistance pertaining to the transfer of charges.

Accordingly, the effect of making the contact with the charge injection layer more frequent can be obtained and uniform and sufficient charging can be carried out by a method in which the extra-fine fiber-generation conjugate fibers are used to make fiber density higher, a method in which the number of fibers is made larger by treating fibers by chemical etching, or a method in which a flexible fiber end is provided for the surface by using a member prepared by raising a fiber-entangled material or using the electrostatic flock material. Namely, the brush so constituted as to have a higher fiber density, to have contact points in a larger number and to make the fiber end come into contact with the charge injection layer may preferably be used in the present invention.

The aggregate comprised of extra-fine fiber-generation conjugate fibers may preferably be those in which extra-fine fibers have been generated by a physical or chemical means. The raised fiber-entangled material may preferably be those in which the fiber-entangled material is formed of extra-fine fiber-generation conjugate fibers. The extra-fine fiber-generation conjugate fibers may more preferably be generated by a physical or chemical means and be raised.

The electrostatic flock material may preferably be those in which its constituent fibers have been chemically treated with an acid, alkali or organic solvent. As another preferable form of the electrostatic flock material, it may have a form in which its constituent fibers are extra-fine fiber-generation conjugate fibers whose extra-fine fibers have been generated by a physical or chemical means.

One of the preferred embodiments of the present invention is that magnetic particles are used in the contact charging member. In a more preferred embodiment, the magnetic particles are conductive magnetic particles having been resistance-controlled to have a volume resistivity in the range of from $10^4$ Ω.cm to $10^9$ Ω.cm.

The magnetic particles may preferably have an average particle diameter of from 5 to 200 μm. Those having an average particle diameter smaller than 5 μm tend to cause adhesion of the magnetic brush to the photosensitive member. Those having an average particle diameter larger than 200 μm can not make ears of the magnetic brush rise densely on the roller to tend to make poor the performance of charge injection into the photosensitive member. The magnetic particles may more preferably have an average particle diameter of from 10 to 100 μm. When those having particle diameters within this range are used, the transfer residual toner on the photosensitive member can be more efficiently scraped off, can be more efficiently electrostatically incorporated into the magnetic brush and can be temporarily held in the magnetic brush in order to more surely control the charging of the toner. The magnetic particles may still more preferably have an average particle diameter of from 10 to 50 μm.

The average particle diameter of the whole may be measured using an optical microscope or a scanning electron microscope, by sampling at least 100 particles at random to calculate volume particle size distribution on the basis of their horizontal-direction maximum chord length, and their 50% average particle diameter may be used as the average particle diameter. Alternatively, using a laser diffraction particle size distribution measuring device HEROS (manufactured by Nippon Denshi K.K.), particles of from 0.05 μm to 200 μm may be 32-logarithmically divided to measure diameter, and their 50% average particle diameter may be used as the average particle diameter.

Use of the magnetic particles having such particle diameters brings about a great increase in the number of points of contact with the photosensitive member, and is advantageous for imparting a more uniform charged electric potential to the photosensitive member. Moreover, magnetic particles directly coming into contact with the photosensitive member are replaced one after another as the magnetic brush is rotated, thus there is an additional advantage that any lowering of charge injection performance that may be caused by contamination of magnetic particle surfaces can be greatly lessened.

A holding member that holds the magnetic particles and the photosensitive member may preferably be set to leave a gap between them in the range of from 0.2 to 2 mm. If they are set at a gap smaller than 0.2 mm, the magnetic particles can not pass the gaps with ease, so that the magnetic particles may not be smoothly transported over the holding member to tend to cause faulty charging, or the magnetic particles may excessively stagnate at the nip to tend to cause their adhesion to the photosensitive member. A gap larger than 2 mm is not preferable because it is difficult to form wide nips between the photosensitive member and the magnetic particles. They may more preferably be set at a gap of from 0.2 to 1 mm, and particularly preferably from 0.3 to 0.7 mm.

In the present invention, it is preferable for the contact charging member to have a magnet for holding the magnetic particles and to be so set that magnetic flux density B (T: tesla) of a magnetic field generated by the magnet and maximum magnetization σB ($Am^2/kg$) of the magnetic particles within the magnetic flux density B have values that may satisfy the following relationship:

$$B \cdot \sigma B \geqq 4.$$

If the above relationship is not satisfied, the magnetic force acting on the magnetic particles is so small that the contact charging member can not have a sufficient power of holding the magnetic particles, and the magnetic particles may move to the photosensitive member to become lost.

As the magnetic particles according to the present invention, in order to cause ears to rise by magnetism and to bring the resulting magnetic brush into contact with the photosensitive member to effect charging, materials therefor may include alloy or compounds containing elements exhibiting ferromagnetism, as exemplified by cobalt and nickel, and ferrites whose resistivity has been adjusted by oxidation or reduction, as exemplified by a ferrite compositionally adjusted and a Zn—Cu ferrite treated by hydrogen reduction. In order to set the resistivity of the ferrite within the above range in the applied electric field range as previously described, the resistivity can be achieved also by adjusting the composition of metals. An increase in metals other than divalent iron commonly results in a decrease in resistivity, and tends to cause an abrupt decrease in resistivity.

The triboelectricity of the magnetic particles used in the present invention may preferably have a polarity not reverse to the charge polarity of the photosensitive member. As previously stated, the potential of the photosensitive member decreases for the portion of the triboelectricity, and such decrease causes a force directed to the movement of the magnetic particles to the photosensitive member, bringing about a severer condition for holding the magnetic particles on the contact charging member. The polarity of triboelectricity of the magnetic particles can be controlled with ease by coating the surfaces of the magnetic particles to provide surface layers.

Such magnetic particles having surface layers, used in the present invention, are in such a form that surfaces of the magnetic particles are coated with deposited films, conductive resin films, or conductive pigment-dispersed resin films. Each surface layer need not necessarily completely cover up each magnetic particle, and the magnetic particle may be partly uncovered so long as the effect of the present invention can be obtained. Namely, the surface layer may be formed discontinuously.

From the viewpoint of productivity, cost and so forth, the magnetic particles may preferably be coated with conductive pigment-dispersed resin films. From the viewpoint of controlling electric-field dependence of resistivity, the magnetic particles may preferably be coated with resin films comprising a high-resistivity binder resin with an electron-conducting conductive pigment dispersed therein.

As a matter of course, the magnetic particles having been thus coated must have the resistivity set within the range previously described. Also, from the viewpoint of broadening the scope of tolerance of the abrupt decrease in resistivity on the side of the high electric field and tolerance of leak images that may occur depending on the size and depth of scratches on the photosensitive member, the parent magnetic particles may preferably have a resistivity set within the above range.

As a binder resin used to coat the magnetic particles, it may include styrenes such as styrene and chlorostyrene; monoolefins such as ethylene, propylene, butylene and isobutylene; vinyl esters such as vinyl acetate, vinyl propionate, vinyl benzoate and vinyl lactate; a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone; and homopolymers or copolymers of these. In particular, as typical binder resins, the resin may include polystyrene, styrene-alkyl acrylate copolymers, a styrene-acrylonitrile copolymer, a styrene-butadiene copolymer, a styrene-maleic anhydride copolymer, polyethylene and polypropylene, in view of dispersibility of conductive fine particles, film forming properties as coat layers, productivity and so forth. It may further include polycarbonate, phenol resins, polyesters, polyurethanes, epoxy resins, polyolefins, fluorine resins, silicone resins and polyamides. Especially from the viewpoint of the prevention of toner contamination, it is more preferable to contain a resin having a small critical surface tension, as exemplified by polyolefin resins, fluorine resins and silicone resins.

In addition, from the viewpoint of keeping a broad tolerance for preventing the abrupt decrease in resistivity on the side of the high electric field and the leak images caused by scratches on the photosensitive member, the resin coated on the magnetic particles may preferably be a fluorine resin or silicone resin having a high-voltage resistance.

The fluorine resin may include, e.g., solvent-soluble copolymers obtained by copolymerizing vinyl fluoride, vinylidene fluoride, trifluoroethylene, chlorotrifluoroethylene, dichlorodifluoroethylene, tetrafluoroethylene or hexafluoropropylene with other monomers.

The silicone resin may include, e.g., KR271, KR282, KR311, KR255 and KR155 (straight silicone varnish), KR211, KR212, KR216, KR213, KR217 and KR9218 (modifying silicone varnish), SA-4, KR206 and KR5206 (silicone alkyd varnish), ES1001, ES1001N, ES1002T and ES1004 (silicone epoxy varnish), KR9706 (silicone acrylic varnish), and KR5203 and KR5221 (silicone polyester varnish), all available from Shin-Etsu Silicone Co., Ltd.; and SR2100, SR2101, SR2107, SR2110, SR2108, SR2109, SR2400, SR2410, SR2411, SH805, SH806A and SH8401, available from Toray Silicone Co., Ltd.

Figure 4:
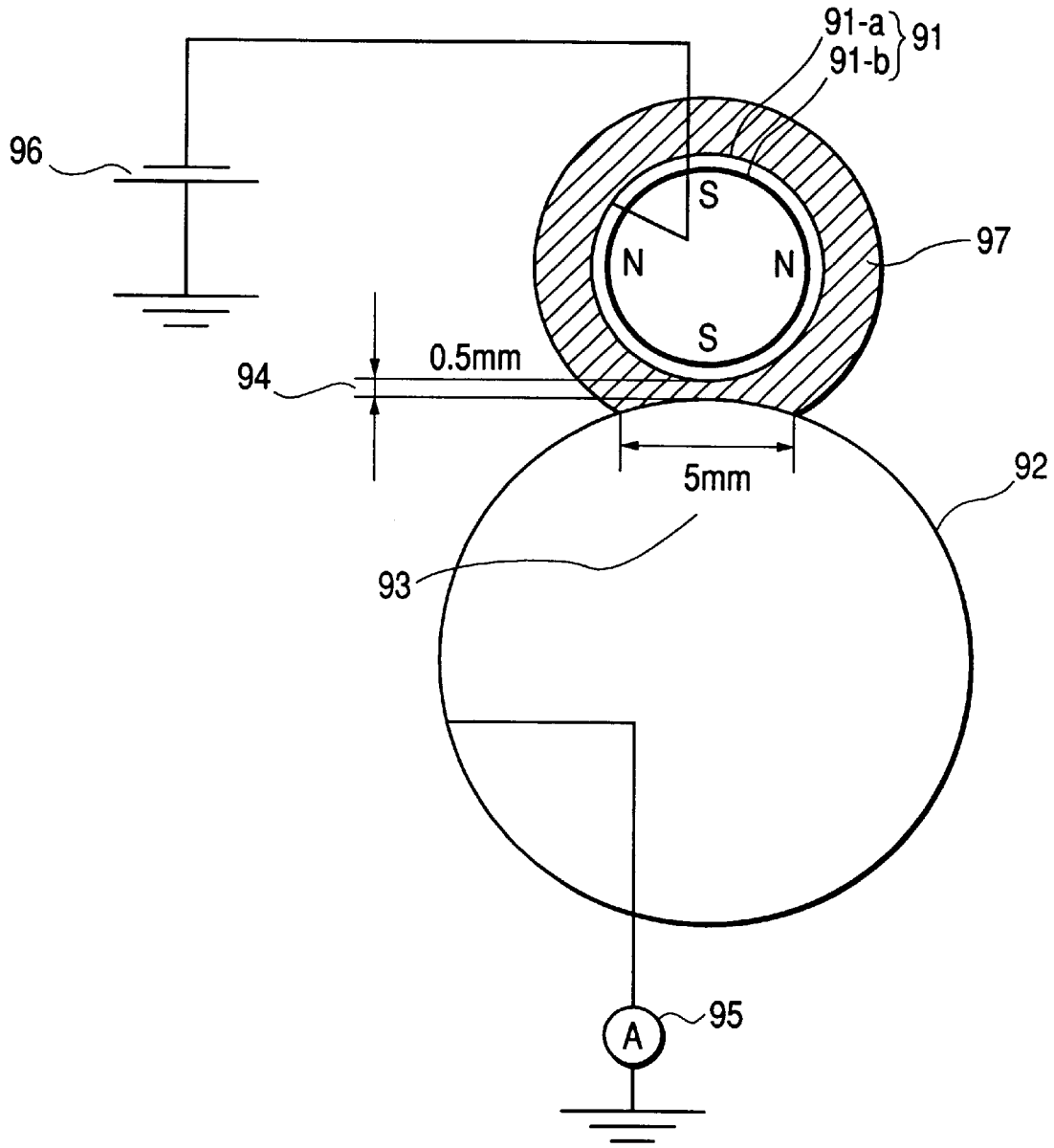
FIG. 4 is a dynamic resistance of schematic illustration of an apparatus used to measure dynamic resistance of magnetic particles serving as a charging member.

The dynamic resistance of the magnetic particles is measured with a device as shown in FIG. 4. More specifically, around a magnetic particle holding member, magnet-built-in sleeve 91 set to leave a gap 94 of 0.5 mm between it and a conductive substrate aluminum drum 92, magnetic particles 97 are so put as to form a nip 93 of 5 mm between them and the aluminum drum. The sleeve (as the contact charging member) and the aluminum drum (as the photosensitive member) are rotated at speed and in the rotational direction which are set when actually images are formed, and a DC voltage is applied to the contact charging member, where electric currents flowing through the system are measured to determine its resistance, and further the dynamic resistance is calculated from the gap 94, the nip 93 and the width at which the magnetic particles come into peripheral contact with the aluminum drum.

In the present invention, the charge injection layer of the photosensitive member may be constituted of an inorganic layer of a metal-deposited film or a conductive-powder-dispersed resin layer formed of a binder resin with conductive fine particles dispersed therein. The deposited film is formed by vacuum deposition, and the conductive-powder-dispersed resin layer is formed by coating a conductive-powder-dispersed resin solution by a suitable coating process such as dip coating, spray coating, roll coating or beam coating. The charge injection layer may also be constituted of a mixture or copolymer of an insulating binder with an ion-conductive resin having high light-transmitting properties, or may be constituted of a medium-resistance, photoconductive resin alone. In the case of the resin layer with the conductive fine particles dispersed therein, the conductive fine particles may preferably be added in an amount of from 2 to 250 parts by weight, and more preferably from 2 to 190 parts by weight, based on 100 parts by weight of the binder resin. If they are in an amount less than 2 parts by weight, the desired volume resistivity may be attained with difficulty. If they are in an amount more than 250 parts by weight, the charge injection layer may have so low a film strength as to be tend to be scraped off and tend to result in a short lifetime of the photosensitive member. Also, the layer may have so low a resistance that faulty images due to the flow of latent image potential tend to occur.

The binder of the charge injection layer may be the same as a binder of its underlying layer. In such an instance, however, the coating surface of the charge transport layer may be disordered when the charge injection layer is formed by coating, and hence the coating process must be especially selected.

In the present invention, the charge injection layer may preferably contain lubricant particles. The reason therefor is that the friction between the photosensitive member and the charging member can be lessened at the time of charging and hence the charging nip can be expanded to bring about an improvement in charging performance. In particular, as the lubricant particles, it is preferable to use fluorine resins, silicone resins or polyolefin resins, having a low critical surface tension. More preferably, tetrafluoroethylene resin (PTFE) may be used. In this instance, the lubricant particles may be added in an amount of from 2 to 50 parts by weight, and preferably from 5 to 40 parts by weight, based on 100 parts by weight of the binder resin. If they are less than 2 parts by weight, the lubricant particles are not in a sufficient quantity and hence the charging performance can not be sufficiently improved, and, if they are more than 50 parts by weight, the resolution of images and the sensitivity of the photosensitive member may greatly lower.

The charge injection layer in the present invention may preferably have a layer thickness of from 0.1 to 10 $\mu$mm, and particularly preferably from 1 to 7 $\mu$mm.

The present invention is a technique in which the contact charging member having a medium resistance is used to inject electric charges into the surface portion of the photosensitive member having a medium-resistance surface resistance. Preferably, the charges are not injected into trap levels possessed by the photosensitive member surface material, but the charges are supplied to the conductive fine particles of the charge injection layer formed of a light-transmitting insulating binder having conductive fine particles dispersed therein.

Stated specifically, the present invention is based on the theory that, using the contact charging member, charges are supplied to a minute capacitor set up using the charge transport layer as a dielectric and the aluminum substrate and the conductive fine particles in the charge injection layer as both electrodes. In this instance, the conductive fine particles are electrically independent from one another and form a kind of minute float electrodes. Hence, in a macroscopic view, the photosensitive member surface is seen as if it is charged to a uniform potential, but actually is in such a condition that minute and numberless charged conductive fine particles cover the photosensitive member surface. Therefore, electrostatic latent images can be retained even when imagewise exposure is carried out using a laser, because the individual conductive fine particles are electrically independent from one another.

Thus, the conductive fine particles are substituted for the trap levels present at the surfaces of conventional photosensitive members even in a small quantity, and hence the charge injection performance and charge retentivity can be improved.

Herein, the volume resistivity of the charge injection layer is measured in the following way: A charge injection layer is formed on a polyethylene terephthalate (PET) film on the surface of which a conductive film has been vacuum-deposited. Its resistivity is measured using a volume resistivity measureing apparatus (4140B PAMATER, manufactured by Hullet Packard Co.) in an environment of 23° C./65% RH under application of a voltage of 100 V.

As having been described above, the toner for developing electrostatic latent images according to the present invention may hardly cause filming on the photosensitive member or contamination of the surfaces of toner carrying materials or members such as carriers and sleeves, without damaging the properties excellent in low-temperature fixing performance and anti-offset properties, and has superior many-sheet running performance.

In Examples and Comparative Examples, the units "part" and "parts" of the materials are based on weight unless otherwise mentioned.

EXAMPLE 1

To 700 parts of deionized water, was added 450 parts of aqueous 0.1M-$Na_3PO_4$ solution. The mixture was heated to 50° C., and stirred at 10,000 rpm with a TK Homomixer (manufactured by Tokushu Kika Kogyo K.K.). Thereto, 70 parts of aqueous 1.0M-$CaCl_2$ solution was added gradually to obtain an aqueous medium containing calcium phosphate.

| (Monomer) | |
|---|---|
| Styrene | 170 parts |
| n-Butyl acrylate | 30 parts |
| (Colorant) C.I. Pigment Blue 15:3 | 10 parts |
| (Charge control agent) Dialkylsalicylic acid-metal compound | 2 parts |

-continued

| | |
|---|---|
| (Polar resin) Saturated polyester<br>(Acid value: 10: Peak molecular weight: 15,000) | 20 parts |
| (Release agent) Behenyl stearate<br>(DSC maximum absorption peak: 68° C.) | 30 parts |
| (Crosslinking agent) Divinylbenzene | 0.2 parts |
| (Low molecular material) Low molecular polystyrene<br>(Weight-average molecular weight (Mw): 2,800,<br>Molecular weight distribution (Mw/Mn): 5.2) | 6 parts |

The above formulation was heated to 50° C., and stirred at 9,000 rpm with a TK Homomixer (manufactured by Tokushu Kika Kogyo K.K.) to form a homogeneous dispersion. Therein one part of 2,2'-azobis(2,4-dimethylvaleronitrile), a polymerization initiator, was dissolved to prepare a polymerizable monomer composition.

The polymerizable monomer composition was added to the above aqueous medium. The mixture was stirred at 55° C. in a nitrogen atmosphere at 9500 rpm with a TK Homomixer to form a particle dispersion of the polymerizable monomer composition.

The dispersion was stirred at 55° C. for one hour with a paddle stirrer, heated to 60° C. in one hour, allowed to react for 4 hours, heated at a rate of 40° C./hr up to 80° C., and allowed to react for 4 hours. During the polymerization reaction, nitrogen was bubbled every one hour into the aqueous medium to adjust the dissolved oxygen concentration within the range from 0.5 to 1.0 mg/L.

After the polymerization reaction, the remaining monomer is distilled off under reduced pressure. After cooling, hydrochloric acid was added to dissolve the calcium phosphate. The polymerization product was collected by filtration, washed with water, and dried to obtain cyan-colored particles (cyan toner) having a weight-average particle diameter of 7.0 $\mu$m.

To 100 parts of the resulting cyan toner, hydrophobic silica having a BET specific surface area of 200 $m^2/g$ was added externally to obtain Cyan Toner A. 5 Parts of this Cyan Toner A was mixed with 95 parts of an acrylate-coated ferrite carrier to obtain a two-component developer. This two-component developer was evaluated for image fixation and running performance or durability by Evaluation Machine A shown later. The physical properties and the evaluation results of the toner are shown in Table 1 and Table 2.

EXAMPLE 2

Cyan Toner A prepared in Example 1 was evaluated for running performance by Evaluation Machine B shown later. The results are shown in Table 1 and Table 2.

Comparative Example 1

Cyan Toner B and a two-component developer were prepared in the same manner as in Example 1 except that the amount of the polymerization initiator, 2,2'-azobis(2,4-dimethylvaleronitrile), was changed to 3 parts. Evaluation was made for fixation and running performance by Evaluation Machine A shown later. The physical properties of the toner and the evaluation results are shown in Table 1 and Table 2.

Comparative Example 2

Cyan Toner B prepared in Comparative Example 1 was evaluated for running performance by Evaluation Machine B shown later. The results are shown in Table 1 and Table 2.

Comparative Example 3

Cyan Toner C and a two-component developer were prepared in the same manner as in Example 1 except that the amount of the polymerization initiator, 2,2'-azobis(2,4-dimethylvaleronitrile), was changed to 5 parts, and the low molecular polystyrene as the low molecular material was not added. Evaluation was made for fixation and running performance by Evaluation Machine A shown later. The physical properties of the toner and the evaluation results are shown in Table 1 and Table 2.

Comparative Example 4

Cyan Toner C prepared in Comparative Example 3 was evaluated for running performance by Evaluation Machine B shown later. The results are shown in Table 1 and Table 2.

Comparative Example 5

Cyan Toner D and a two-component developer were prepared in the same manner as in Example 1 except that the low molecular polystyrene as the low molecular material was not added. Evaluation was made for fixation and running performance by Evaluation Machine A shown later. The physical properties of the toner and the evaluation results are shown in Table 1 and Table 2.

Comparative Example 6

Cyan Toner D prepared in Comparative Example 5 was evaluated for running performance by Evaluation Machine B shown later. The results are shown in Table 1 and Table 2.

Comparative Example 7

Cyan Toner E and a two-component developer were prepared in the same manner as in Example 1 except that the low molecular polystyrene as the low molecular material was added in an amount of 15 parts. Evaluation was made for fixation and running performance by Evaluation Machine A shown later. The physical properties of the toner and the evaluation results are shown in Table 1 and Table 2.

Comparative Example 8

Cyan Toner E prepared in Comparative Example 7 was evaluated for running performance by Evaluation Machine B shown later. The results are shown in Table 1 and Table 2.

Comparative Example 9

A polymerizable monomer composition was prepared in the same manner as in Example 1 except that the amount of the polymerization initiator, 2,2'-azobis( 2,4-dimethylvaleronitrile), was changed to 3 parts by weight, and the low molecular polystyrene as the low molecular material was not added. The temperature during formation of the dispersion of the polymerizable monomer composition was changed to 60° C. The polymerization was conducted with stirring by a paddle stirrer in the same manner as in Example 1 except that the temperature was elevated to 80° C. in one hour, the reaction was allowed to proceed for 10 hours, and nitrogen bubbling into the aqueous medium was not conducted, whereby Cyan Toner F and a two-component developer were obtained. During the polymerization reaction, the dissolved oxygen concentration in the aqueous medium was 1.5 mg/L. Evaluation was made for fixation and running performance with Evaluation Machine A. The physical properties of the toner and the evaluation results are shown in Table 1 and Table 2.

Comparative Example 10

Cyan Toner F prepared in Comparative Example 9 was evaluated for running performance by Evaluation Machine B shown later. The results are shown in Table 1 and Table 2.

Comparative Example 11

| | |
|---|---|
| (Monomer) | |
| Styrene | 170 parts |
| 2-Ethylhexyl acrylate | 30 parts |
| (Colorant) C.I. Pigment Blue 15:3 | 10 parts |
| (Charge control agent) Dialkylsalicylic acid-metal compound | 2 parts |
| (Release agent) Paraffin wax (DSC maximum absorption peak: 70° C.) | 30 parts |
| (Polymerization initiator) | |
| 2,2'-Azobis(2,4-dimethylvaleronitrile) | 10 parts |
| Dimethyl 2,2'-azobisisobutyrate | 1 part |

The above formulation was heated to 60° C., and stirred at 9,000 rpm with a TK Homomixer (manufactured by Tokushu Kika Kogyo K.K.) for dissolution and uniform dispersion to form polymerizable monomer composition.

Cyan Toner G and a two-component developer were prepared in the same manner as in Example 1 except that the polymerizable monomer composition was replaced by the above one; the temperature of the aqueous medium during the formation of particle dispersion was changed to 60° C.; the formation of particle dispersion was conducted for one hour; the reaction was allowed to proceed with stirring with a paddle stirrer at 60° C. for 7 hours; the dispersion was heated to 80° C. in 0.5 hours and the reaction was continued for further 4 hours; and the nitrogen was not bubbled into the aqueous medium during the polymerization. During the polymerization reaction, the dissolved oxygen concentration the aqueous medium was 5 mg/L. Evaluation was made for fixation and running performance with Evaluation Machine A. The physical properties of the toner and the evaluation results are shown in Table 1 and Table 2.

Comparative Example 12

Cyan Toner G prepared in Comparative Example 11 was evaluated for running performance by Evaluation Machine B shown later. The results are shown in Table 1 and Table 2.

EXAMPLE 3

To 800 parts of deionized water, was added 500 parts of aqueous 0.1M-$Na_3PO_4$ solution. The mixture was heated to 50° C., and stirred at 10,000 rpm with a TK Homomixer (manufactured by Tokushu Kika Kogyo K.K.). Thereto, 70 parts by weight of aqueous 1.0M-$CaCl_2$ solution was added gradually to obtain an aqueous medium containing calcium phosphate.

| | |
|---|---|
| (Monomer) | |
| Styrene | 185 parts |
| n-Butyl acrylate | 15 parts |
| (Colorant) C.I. Pigment Yellow 17 | 15 parts |
| (Charge control agent) Dialkylsalicylic acid-metal compound | 2 parts |
| (Polar resin) Saturated polyester (Acid value: 15: Peak molecular weight: 20,000) | 15 parts |
| (Release agent) Ester wax (DSC maximum absorption peak: 70° C.) | 30 parts |
| (Crosslinking agent) Divinylbenzene | 0.5 parts |
| (Low molecular material) Low molecular polystyrene (Weight-average molecular weight (Mw): 3,500, Molecular weight distribution (Mw/Mn): 4.5) | 6 parts |

The above formulation was heated to 50° C., and stirred at 9,000 rpm with a TK Homomixer (manufactured by Tokushu Kika Kogyo K.K.) for dissolution and uniform dispersion. Therein, one part of 2,2'-azobis(2,4-dimethylvaleronitrile), a polymerization initiator, was dissolved to prepare a polymerizable monomer composition.

The polymerizable monomer composition was added to the above aqueous medium. The mixture was stirred at 55° C. in a nitrogen atmosphere at 9500 rpm with a TK Homomixer to form a particle dispersion of the polymerizable monomer composition.

The dispersion was allowed to react at 55° C. for one hour by stirring with a paddle stirrer, heated to 60° C. in an hour, allowed to react for 4 hours, heated at a rate of 40° C./hr up to 80° C., and allowed to react for further 4 hours. During the polymerization reaction, nitrogen was bubbled every one hour into the aqueous medium to adjust the dissolved oxygen concentration in the range from 0.5 to 1.0 mg/L.

After the polymerization reaction, the remaining monomer is distilled off under reduced pressure. After cooling, hydrochloric acid was added to dissolve the calcium phosphate. The polymerization product was collected by filtration, washed with water, and dried to obtain yellow-colored particles (yellow toner) having weight-average particle diameter of 7.2 $\mu$m.

To 100 parts of the yellow-colored toner particles, hydrophobic silica having a BET specific surface area of 200 $m^2/g$ was added externally to obtain Yellow Toner H. 5 Parts of this Yellow Toner H was mixed with 95 parts of an acrylate-coated ferrite carrier to obtain a two-component developer. This two-component developer was evaluated for fixation and running performance by Evaluation Machine A shown later. The physical properties of the toner and the evaluation results the toner are shown in Table 1 and Table 2.

EXAMPLE 4

Yellow Toner H prepared in Example 3 was evaluated for running performance by Evaluation Machine B shown later. The results are shown in Table 1 and Table 2.

Comparative Example 13

Yellow Toner I and a two-component developer were prepared in the same manner as in Example 3 except that the amount of the ester wax as the release agent was changed to 90 parts by weight. Evaluation was made for fixation and running performance by Evaluation Machine A shown later. The physical properties of the toner and the evaluation results are shown in Table 1 and Table 2.

Comparative Example 14

Yellow Toner I prepared in Comparative Example 13 was evaluated for running performance by Evaluation Machine B shown later. The results are shown in Table 1 and Table 2.

Comparative Example 15

Yellow Toner J and a two-component developer were prepared in the same manner as in Example 3 except that the ester wax as the release agent was not added. Evaluation was made for fixation and running performance by Evaluation Machine A shown later. The physical properties of the toner and the evaluation results are shown in Table 1 and Table 2.

Comparative Example 16

Yellow Toner J prepared in Comparative Example 15 was evaluated for running performance by Evaluation Machine B shown later. The results are shown in Table 1 and Table 2.

EXAMPLE 5

To 700 parts of deionized water, was added 450 parts of aqueous 0.1M-$Na_3PO_4$ solution. The mixture was heated to 50° C., and stirred at 10,000 rpm with a TK Homomixer (manufactured by Tokushu Kika Kogyo K.K.). Thereto, 70 parts by weight of aqueous 1.0M-$CaCl_2$ solution was added gradually to obtain an aqueous medium containing calcium phosphate.

| (Monomer) | |
|---|---|
| Styrene | 170 parts |
| n-Butyl acrylate | 30 parts |
| (Colorant) C.I. Pigment Blue 15:3 | 10 parts |
| (Charge control agent) Dialkylsalicylic acid-metal compound | 2 parts |
| (Polar resin) Saturated polyester (Acid value: 10, Peak molecular weight: 15,000) | 20 parts |
| (Release agent) Behenyl stearate (DSC maximum absorption peak: 68° C.) | 30 parts |
| (Crosslinking agent) Divinylbenzene | 0.2 parts |
| (Low molecular material) Low molecular polystyrene (Weight-average molecular weight (Mw): 2,800) (Molecular weight distribution (Mw/Mn): 5.2) | 6 parts |

The above formulation was heated to 50° C., and stirred at 9,000 rpm with a TK Homomixer (manufactured by Tokushu Kika Kogyo K.K.) for dissolution and uniform dispersion. Therein, 4 parts of 2,2'-azobis(2,4-dimethylvaleronitrile), a polymerization initiator, was dissolved to prepare a polymerizable monomer composition.

The polymerizable monomer composition was added to the above aqueous medium. The mixture was stirred at 55° C. in a nitrogen atmosphere at 9500 rpm with a TK Homomixer to form a particle dispersion of the polymerizable monomer composition.

The dispersion was stirred at 55° C. for one hour with a paddle stirrer, heated to 60° C. in an hour, allowed to react for 4 hours, heated at a rate of 5° C./hr up to 80° C., and allowed to react for 4 hours. During the polymerization reaction, nitrogen was bubbled every one hour into the aqueous medium to adjust the dissolved oxygen concentration within the range from 0.5 to 1.0 mg/L.

After the polymerization reaction, the remaining monomer is distilled off under reduced pressure. After cooling, hydrochloric acid was added to dissolve the calcium phosphate. The polymerization product was collected by filtration, washed with water, and dried to obtain cyan-colored particles (cyan toner) having weight-average particle diameter of 7.0 $\mu$m.

To 100 parts of the obtained cyan-colored toner particles, hydrophobic silica having a BET specific surface area of 200 $m^2/g$ was added externally to obtain Cyan Toner K. 5 Parts of this Cyan Toner K was mixed with 95 parts of an acrylate-coated ferrite carrier to obtain a two-component developer. This two-component developer was evaluated for fixation and running performance by Evaluation Machine A shown later. The physical properties and the evaluation results the toner are shown in Table 1 and Table 2.

REFERENCE EXAMPLE 6

In a four-neck flask, were placed 180 parts of nitrogen-purged water and 20 parts of aqueous 0.2 wt % polyvinyl alcohol solution. Thereto, were mixed 77 parts of styrene, 23 parts of n-butyl acrylate, 3 parts of benzoyl peroxide, and 0.01 part of divinylbenzene with stirring to form a liquid suspension. After purging the flask with nitrogen, the liquid suspension was heated to 80° C., and polymerization reaction was allowed to proceed at this temperature for 10 hours.

The formed polymer was washed with water, and vacuum-dried at 65° C. to obtain a resin. By a fixed vessel type dry mixer, were mixed 88 parts of the above resin, 2 parts of a metal-containing azo dye, 5 parts of carbon black, 8 parts of paraffin wax, and 2 parts of low molecular polystyrene (weight-average molecular weight (Mw): 2,800, molecular weight distribution (Mw/Mn): 5.2). The dry-blended mixture was melt-blended by a double-screw extruder with evacuation by a pump from the vent hole.

The melt-blended matter was crushed by a hammer mill to obtain a crushed toner composition of 1-mm mesh undersize. The crushed toner composition was disintegrated to a volume-average particle size ranging from 20 to 30 $\mu$m by a mechanical disintegrator, and further pulverized by a jet mill utilizing particle collision in swirling motion. The pulverized toner composition was modified by shearing thermally and mechanically by a surface modifying machine, and was classified by a multi-stage classifier to obtain a particulate black toner having a weight-average particle diameter of 6.9 $\mu$m.

To 98.6 parts of this particulate black toner, was added 1.4 parts of colloidal silica to obtain pulverized Black Toner L. 5 Parts of this Black Toner L was mixed with 95 parts of an acrylate-coated ferrite carrier to obtain a two-component developer. The two-component developer was evaluated for fixation and running performance by Evaluation Machine A. The properties of the toner and the evaluation results are shown in Table 1 and Table 2.

REFERENCE EXAMPLE 7

In a four-neck flask, were placed 180 parts of nitrogen-purged water and 20 parts of aqueous 0.2 wt % polyvinyl alcohol solution. Thereto, were mixed 77 parts of styrene, 23 parts of n-butyl acrylate, 1.5 parts of 2,2'-azobis(2,4-dimethylvaleronitrile), and 0.01 part of divinylbenzene with stirring to form a liquid suspension. After purging the flask with nitrogen, the liquid suspension was heated to 70° C., and polymerization reaction was allowed to proceed at this temperature for 10 hours.

The formed polymer was washed with water, and vacuum-dried at 65° C. to obtain a resin. By a fixed vessel type dry mixer, were mixed 88 parts of the above resin, 2 parts of a compound of salicylic acid, 5 parts of quinacridone, 9 parts of paraffin wax, and 1 part of low molecular polystyrene (weight-average molecular weight (Mw): 3,500, molecular weight distribution (Mw/Mn): 4.5). The dry-blended mixture was melt-blended by a double-screw extruder with evacuation by a pump from the vent hole.

The melt-blended matter was crushed by a hammer mill to obtain a crushed toner composition of 1-mm mesh undersize. The crushed toner composition was disintegrated to a volume-average particle size ranging from 20 to 30 $\mu$m by a mechanical disintegrator, and further pulverized by a jet mill utilizing particle collision in swirling motion. The pulverized toner composition was modified by shearing thermally and mechanically by a surface modifying machine, and was classified by a multi-stage classifier to obtain a particulate magenta toner having a weight-average particle diameter of 7.5 μm.

To 98.6 parts of this particulate magenta toner, was added 1.4 parts of colloidal silica to obtain pulverized Magenta Toner M. 5 Parts of this Magenta Toner M was mixed with 95 parts of acrylate-coated ferrite carrier to obtain a two-component developer. The two-component developer was evaluated for fixation and running performance by Evaluation Machine A. The properties of the toner and the evaluation results are shown in Table 1 and Table 2.

Evaluation Methods

Evaluation Machine A

A commercial full-color copying machine, CLC-500 (manufactured by Canon K.K.) was modified to have a developing device suitable for using a non-magnetic one-component developer and a peripheral process therefor.

An unfixed image was formed on a recording medium with this modified machine. The unfixed image on the recording medium was fixed at a fixation speed of 150 mm/sec by a fixing device of commercial NP-6650 (manufactured by Canon K.K.) modified such that the fixation temperature is changeable by 5° C. from 120° C. to 220° C. The recording medium was commercial copying paper, Canon New Dry Paper (basis weight: 54 g/m$^2$, supplied by Canon Sales Co., Ltd.).

Evaluation Machine B

Figure 5:
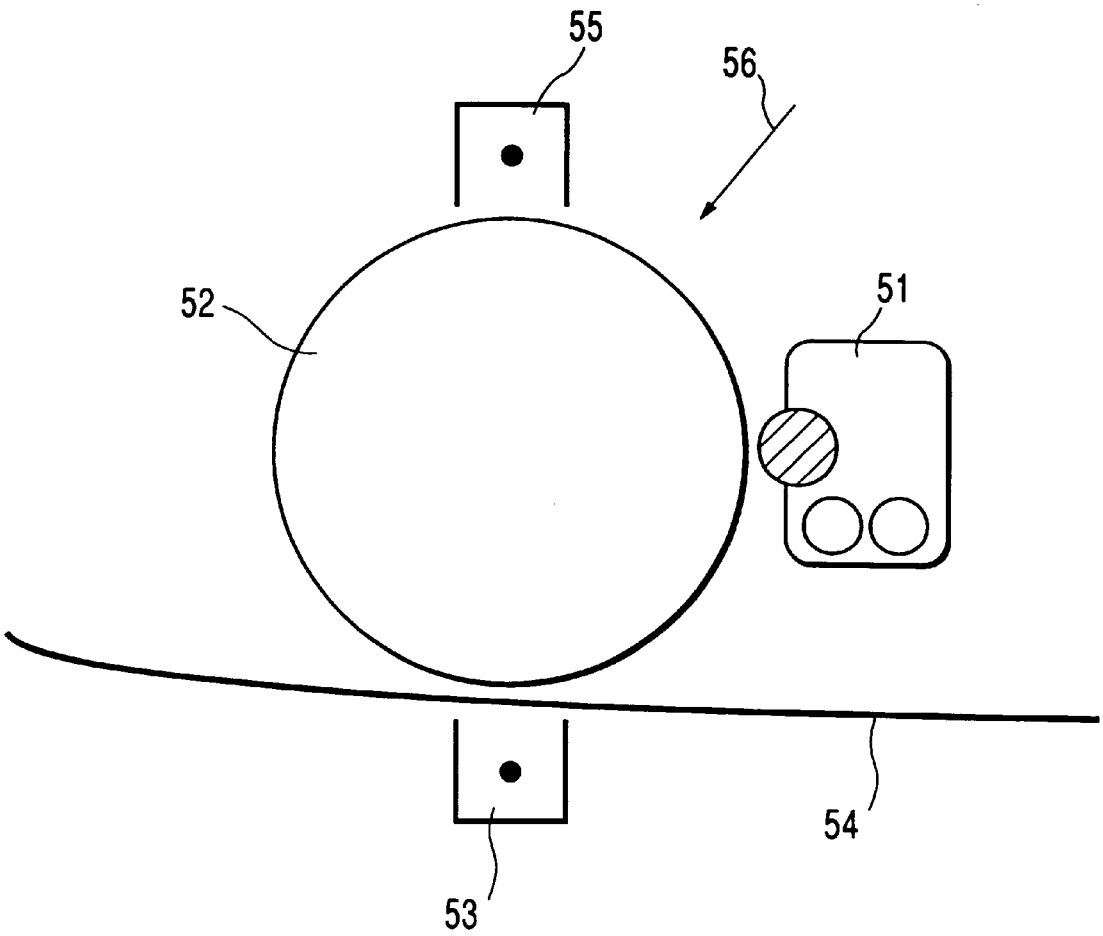
FIG. 5 is a schematic illustration of a developing assembly used to evaluate running performance in Examples.

An unfixed image was formed on a recording medium by a commercial copying machine, NP-6030 (manufactured by Canon K.K.), modified as shown in FIG. 5 for development with a non-magnetic one-component developer. The unfixed image on the recording medium was fixed at a fixation speed of 150 mm/sec by a fixing device of commercial NP-6650 (manufactured by Canon K.K.) modified such that the fixation temperature is changeable by 5° C. from 120° C. to 220° C. The recording medium was a commercial copying paper sheet, Canon New Dry Paper (basis weight: 54 g/m$^2$, supplied by Canon Sales Co., Ltd.). In FIG. 5, numeral 52 is a photosensitive drum as a latent image bearing member. A corona charger 55 performs primary charging on the surface of the photosensitive drum 52. A light exposure 56 is used to form an electrostatic latent image on the surface of the primarily charged photosensitive drum 52. A developing device 51 employs a non-magnetic one-component developer containing a toner for developing the electrostatic latent image formed on the photosensitive drum 52. The toner image is transferred onto a recording medium 54 as a transfer medium. A corona transfer device 53 serves to transfer the toner image from the photosensitive member 52 onto the recording medium 54. The developing device 51 has a structure shown in FIG. 12. The development was conducted under the conditions below.

Development Conditions

- Development sleeve: Stainless steel sleeve blast-treated with glass beads of #600
- Gap β between development sleeve and photosensitive drum: 500 μm
- Elastic blade: Polyurethane rubber blade having a nylon resin layer on the surface
- Developer layer thickness on development sleeve: 70 μm
- Development bias: AC electric field with peak voltage of 2 KV
- Process speed: 150 m/sec The evaluation was conducted by use of the above Evaluation Machines A and B regarding the evaluation items below.

Evaluation Item

Fogging

The fogging was measured by a reflection type densitometer (Reflectometer Odel TC-6DS, manufactured by Tokyo Denshoku Co., Ltd.). The degree of fogging is represented by Ds-Dr, difference between Ds (the lowest value of reflection density in the white area after printing) and Dr (the average value of reflection density before printing). At the fogging quantity of not more than 2%, the image is satisfactory in practical use without substantial fogging, and at the fogging quantity of 5% or higher, the image is obscure with remarkable fogging.

The evaluation standards are as below respectively for Evaluation Machine A and Evaluation Machine B.

Evaluation Standards for Evaluation Machine A

- a: Fogging less than 2% at 20,000th sheet printing
- b: Fogging 2% or more at 20,000th sheet printing
- c: Fogging 2% or more at 15,000th sheet printing
- d: Fogging 2% or more at 10,000th sheet printing
- e: Fogging 2% or more at 5,000th sheet printing Evaluation Standards for Evaluation Machine B

- a: Fogging less than 2% at 3,000th sheet printing
- b: Fogging 2% or more at 3,000th sheet printing
- c: Fogging 2% or more at 1,000th sheet printing
- d: Fogging 2% or more at 500th sheet printing
- e: Fogging 2% or more at 100th sheet printing Toner Fusion Staining or contamination of the carrier, the sleeve, and the photosensitive member by toner fusion was examined visually. Occurrence of the toner fusion was evaluated according to the standards below.

Evaluation Standards for Evaluation Machine A

- a: No toner fusion at 20,000th sheet printing
- b: Toner fusion occurs at 20,000th sheet printing
- c: Toner fusion occurs at 15,000th sheet printing
- d: Toner fusion occurs at 10,000th sheet printing
- e: Toner fusion occurs at 5,000th sheet printing Evaluation Standards for Evaluation Machine B

- a: No toner fusion at 3,000th sheet printing
- b: Toner fusion occurs at 3,000th sheet printing
- c: Toner fusion occurs at 1,000th sheet printing
- d: Toner fusion occurs at 500th sheet printing
- e: Toner fusion occurs at 100th sheet printing Toner Charging The quantity of charging, or charge quantity of the toner was measured as below.

In the test with Evaluation Machine A, the toner containing the carrier was taken out from the modified CLC-500 machine at the start and the end of the running or durability test. The quantity of charging of the toner was measured with the measurement apparatus below according to the method below and the calculation method below.

In the test with Evaluation Machine B, the toner and the carrier were left standing for a whole day and night under ordinary temperature and humidity. The quantity of charging of the toner was measured with the measurement apparatus according to the method below and the calculation method below.

Figure 6:
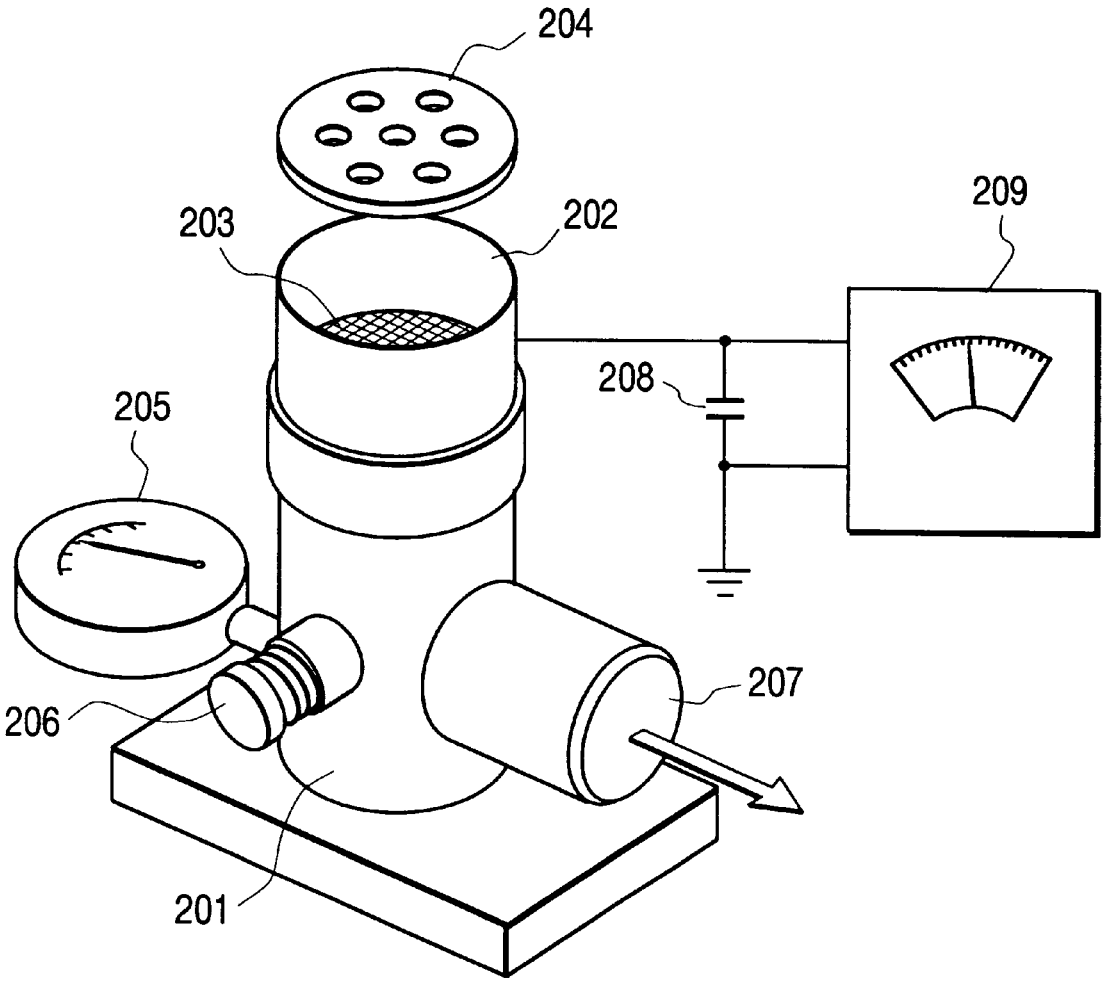
FIG. 6 is an illustration of a device used to measure the quantity of triboelectricity of toners.

FIG. 6 shows the apparatus for measuring the triboelectric charge quantity of the toner. The toner to be measured for triboelectric charging is mixed with a carrier at the mixing ratio by weight of 1:19. This mixture is placed in a polyethylene bottle of 50 to 100 mL, and is shaken by hand for 5 to 10 minutes. About 0.5 to 1.5 g of the mixture (developer) is transferred to the metallic measurement vessel 202 having 500-mesh screen 203 at the bottom, and the measurement vessel is closed with the metallic cover plate 204 . The total weight $W_1$ (g) of the measurement vessel 202 is weighed. Then the measurement vessel is sucked from the sucking hole 207 with a sucker 201 (at least the portion thereof in contact with the measurement vessel being made of an insulating material), and the air flow rate is controlled to keep the pressure reading of the manometer 205 at 250 mmAq by means of the air adjusting valve 206. In this state, the sucking is continued enough, preferably for 2 minutes, to remove the toner by suction. The reading of the potentiometer 209 in this state is denoted by V (volts). The numeral 208 indicates a condenser having a capacity of C ($\mu$F). The total weight $W_2$ (g) of the measurement vessel is weighed after the suction. The quantity of the triboelectric charge (mC/kg) of the toner is calculated according to the equation below:

$$\text{Triboelectric charge of toner (mC/kg)}=(C\times Vv)/(W_1-W_2)$$

Image Density

Image densities of printed solid images of 5 mm square and 500 mm round are measured by a MacBeth Densitometer (manufactured by MacBeth Co.)

Fixation Beginning Temperature

The fixation is conducted by changing the fixation temperature by 5° C. from 120° C. The resulting fixed image is rubbed with a silbon paper sheet to-and-fro ten times with application of a load of about 100 g. The temperature at which the drop ratio (%) of the reflection density caused by exfoliation of the image becomes 10% or less is regarded to be the fixation beginning temperature.

Offset Temperature

The fixation temperature is changed stepwise by 10° C. from 120° C. A solid image of 5 cm×5 cm (toner quantity: 0.5–0.6 mg/cm$^2$) is formed at the middle of the top end portion of a copying paper sheet. This sheet is passed through the fixing device. When the toner of the solid image is peeled and re-transferred onto the rear end portion of the paper sheet in the passing direction, the temperature at that time is defined as the offset temperature.

EXAMPLE 8

Yellow Toner N and a two-component developer were prepared in the same manner as in Example 1 except that C.I. Pigment Yellow 17 was used as the colorant in place of C.I. Pigment Blue 15:3 in Example 1.

Magenta Toner O and a two-component developer were prepared in the same manner as in Example 1 except that a quinacridone pigment was used as the colorant in place of C.I. Pigment Blue 15:3 in Example 1.

Black Toner P and a two-component developer were prepared in the same manner as in Example 1 except that carbon black was used as the colorant in place of C.I. Pigment Blue 15:3 in Example 1.

A full-color image was formed by Evaluation Machine A with four two-component developers including the two-component developers of Yellow Toner N, Magenta Toner O, and Black Toner P prepared above, and Cyan Toner A prepared in Example 1. The formed image was fixed well with satisfactory color tone and gradation without staining or contamination of the charging member.

EXAMPLE 9

A full color image was formed with four color toners, Cyan Toner A, Yellow Toner N, Magenta Toner O, and Black Toner P, used in Example 8 by means of an image-forming apparatus shown in FIG. 9. As the charging member, a charging roller was used which was constituted of an electroconductive sleeve of 16 mm diameter and a polyurethane-based elastic layer formed thereon. The photosensitive member surface was primarily charged under the charging conditions below.

Charging Conditions

- Charging bias: Constant current control with AC current of 1900 $\mu$A
- Rotation direction of charging roller relative to photosensitive member and difference in peripheral speed: Driven by the photosensitive drum (no difference in peripheral speed)
- Surface potential of photosensitive member: −500 V A digital electrostatic latent image was formed on the surface of the primarily charged photosensitive member by projection of a laser beam.

Digital toner image formation was conducted on the photosensitive member by reversal development under the following development conditions by means of a development apparatus as shown in FIG. 12 of non-contact development type empolying a non-magnetic one-component developer. The development was conducted four times in the order of colors of yellow, magenta, cyan, and black.

Development Conditions

- Development sleeve: Stainless steel sleeve blast-treated with glass beads of #600
- Gap β between development sleeve and photosensitive drum: 500 $\mu$m
- Elastic blade: Polyurethane rubber blade having a nylon resin layer on the surface
- Developer layer thickness on development sleeve: 70 $\mu$m
- Development bias: AC electric field with peak voltage of 2 KV
- Process speed: 150 m/sec The toner images developed on the photosensitive member were transferred electrostatically onto an intermediate transfer member four times in the order of the yellow toner image, magenta toner image, cyan toner image, and black toner image (first transfer step), and the full color image composed of the four color toners was transferred electrostatically by use of a transfer member in one operation onto a recording medium (second transfer step) under the following transfer conditions.

The intermediate transfer member was an intermediate transfer drum constituted of an electroconductive drum of 186 mm diameter and an elastic layer formed on the drum surface.

In the first transfer step, a transfer bias of 100–200 V was applied to the intermediate transfer drum. The transfer member in the second transfer step was an electroconductive rubber roller of 16 mm diameter.

Transfer Conditions in Second Transfer Step

- Transfer bias: DC voltage of 1 KV
- Contact pressure of transfer roller to intermediate transfer medium: 1 kgf The full color image formed from four color toners transferred on the recording medium was fixed by heating by means of a heating roller type fixation device having a heating roller capable of changing the fixation temperature by 5° C. and a pressing roller with an elastic layer coming to pressure contact with the heating roller.

As a result, an excellent full-color image was obtained with high anti-offset properties in a broad fixation temperature range.

Charging Member Production Example 1

Figure 2:
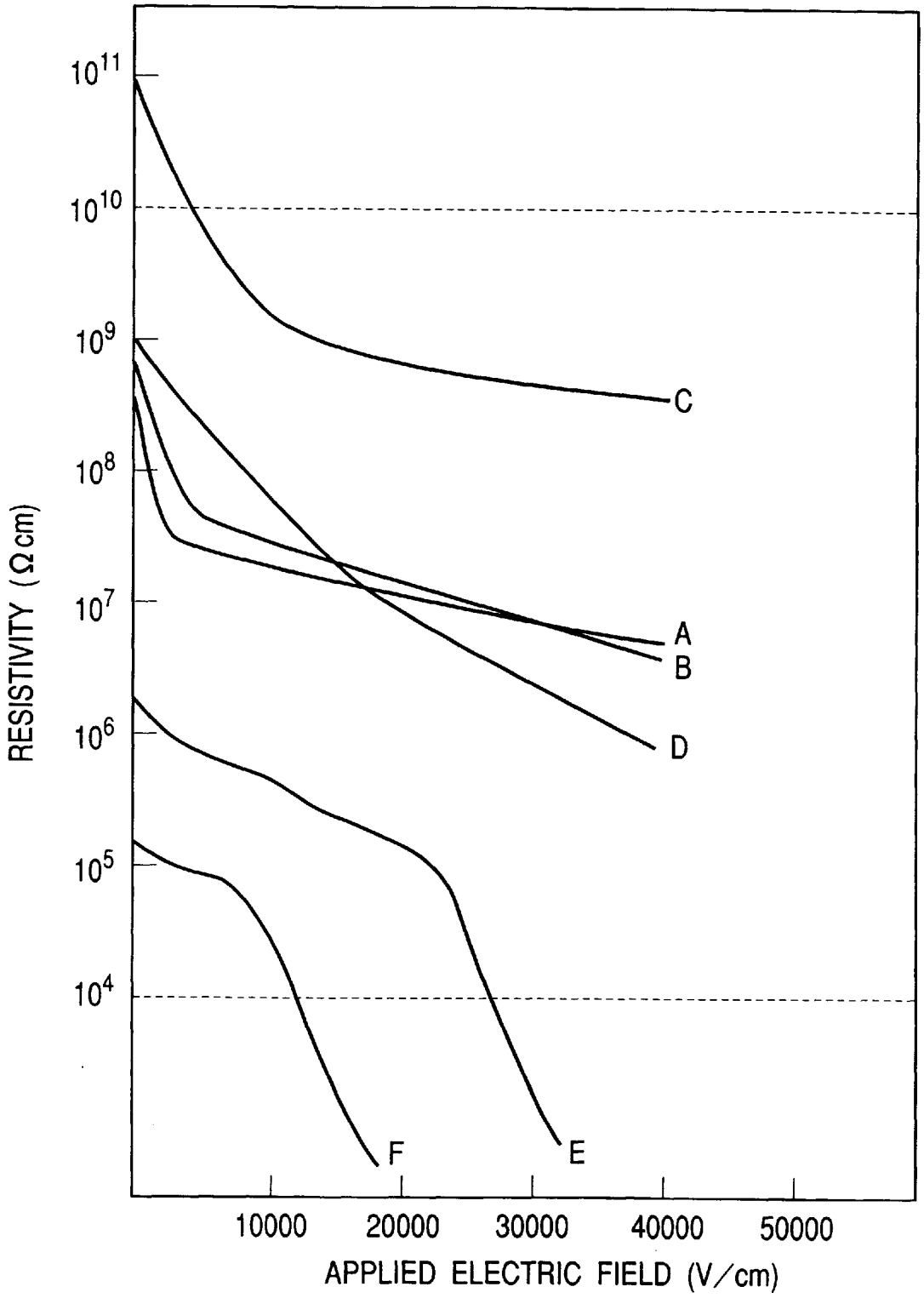
FIG. 2 is a graph showing an applied-voltage dependence of the resistivity of magnetic particles in Charging Member Production Examples 1 to 8.

Zn—Cu ferrite was provided, as magnetic particles, which had an average particle diameter of 25 μm, and had a composition of $(Fe_2O_3)_{2.3}(CUO)_1(ZnO)_1$. The dependency of the resistivity thereof on the applied electric field is as shown in FIG. 2 by the symbol A. The volume resistivity of the magnetic particles was measured by resistance tester employing an aluminum drum. The 20-V1 (V/cm) at that time was $10^7$ to $10^8$ Ωcm, and R1/R2 was 10.

Charging Member Production Example 2

The surface of the magnetic particles provided in Charging Member Production Example 1 was coated by an electroconductive resin composed of a silicone resin and 1% of carbon black dispersed therein. The resistivity was measured in the same manner as above. The dependency of the resistivity thereof on the applied electric field is shown in FIG. 2 by the symbol B. The 20-V1 (V/cm) was $10^7$ to $10^9$ Ωcm, and R1/R2 was 100.

Charging Member Production Example 3

Magnetic particles were prepared by oxidation treatment of the Zn—Cu ferrite provided in Charging Member Production Example 1. The resistivity was measured in the same manner as above. The dependency of the resistivity thereof on the applied electric field is shown in FIG. 2 by the symbol C. At that time, the 20-V1 (V/cm) was $10^9$ to $10^{11}$ Ωcm, and R1/R2 was 1000.

Charging Member Production Example 4

Magnetic particles were prepared by oxidation treatment of the Zn—Cu ferrite provided in Charging Member Production Example 1, and coating the surface thereof with an electroconductive resin composed of a silicone resin and 3% of carbon black dispersed therein. The resistivity was measured in the same manner as above. The dependency of the resistivity thereof on the applied electric field is shown in FIG. 2 by the symbol D. The 20-V1 (V/cm) at that time was $10^6$ to $10^9$ Ωcm, and R1/R2 was 1000.

Charging Member Production Example 5

Mn—Zn ferrite was provided, as magnetic particles, which had an average particle diameter of 45 μm and had a composition of $(Fe_2O_3)_{2.4}(MnO)_1(ZnO)_{1.1}$. The surface of the magnetic particles was coated with a silicone resin. The resistivity was measured in the same manner as above. The dependency of the resistivity thereof on the applied electric field is shown in FIG. 2 by the symbol E. The 20-V1 (V/cm) was $10^2$ to $10^6$ Ωcm, and R1/R2 was 1000.

Charging Member Production Example 6

Mn—Zn ferrite was provided, as magnetic particles, which had an average particle diameter of 45 μm and had a composition of $(Fe_2O_3)_{2.4}(MnO)_1(ZnO)_{1.1}$. The resistivity was measured in the same manner as above. The dependency of the resistivity thereof on the applied electric field is shown in FIG. 2 by the symbol F. The 20-V1 (V/cm) was $10^2$ to $10^5$ Ωcm, and R1/R2 was 100.

Charging Member Production Example 7

A plain weave sheet was prepared from orange type split fibers composed of polyethylene terephthalate and nylon 6 (filament number of 8, average fiber diameter of 1 μm), and nylon 6 fiber (monofilament, 20 μm). The split fiber was opened by ejection of high pressure water, and treated for raising with sand paper.

The raised fiber sheet was immersed in aqueous 15 wt % ferric chloride solution for one hour. Then the sheet was placed in a closed vessel saturated with a pyrrole monomer vapor to allow polymerization to proceed for 3 hours to form polypyrrole on the fiber surface. After the reaction, the sheet was washed with pure water and ethanol sufficiently, and was dried at 100° C. The raised portion of the dried fiber sheet was brushed with a rigid brush to make uniform the hairing.

The raised fiber sheet was worked in a rectangle sheet of 1 cm width, and was wound around an electroconductive urethane sponge roller (outside diameter of 12 mm) formed on a stainless steel core metal of 6 mm diameter.

Photosensitive Member Production Example 1

A photosensitive member employing an organic photoconductive substance for negative charging (hereinafter referred to as an "OPC photosensitive member) was produced by forming five functional layers shown below on an aluminum cylinder of 30 mm diameter.

The first layer is an electroconductive layer of about 20 μm thick composed of a resin and particulate electroconductive material dispersed therein. This layer serves to cover defects of the aluminum cylinder and to prevent moire caused by reflection of laser exposure.

The second layer is a positive charge injection preventive layer (subbing layer) with a medium resistivity of about $10^6$ Ωcm composed of 6-66-610-12 nylon and methoxymethylated nylon having a thickness of about 1 μm. This layer serves to prevent the positive charges injected from the aluminum support from cancelling the negative charges given on the photosensitive member surface.

The third layer is a charge-generating layer of about 0.3 μm thick composed of a resin and a disazo pigment dispersed therein. This layer generates positive-negative charge pairs on exposure to laser light.

The fourth layer is a charge-transporting layer of 25 μm thick composed of a polycarbonate resin and hydrazone dispersed therein. This layer is a p-type semiconductor and transports only the positive charges generated in the charge-generating layer to the surface of the photosensitive member. The negative charges on the photosensitive member surface cannot move in the fourth layer.

The fifth layer is a charge-injecting layer which is characteristic to the present invention. This layer is composed of a photosetting acrylic resin, and ultrafine particulate $SnO_2$ and particulate tetrafluoroethylene resin with a particle diameter of about 0.25 μm. The particulate tetrafluoroethylene resin serves to increase the time of contact of the contact charging member with the photosensitive member for performing uniform charging. Specifically, 167 parts of particulate $SnO_2$ with a particle diameter of about 0.03 μm having a resistance lowered by doping of antimony, 20 parts of particulate tetrafluoroethylene resin, and 1.2 parts of a dispersant are added to 100 parts of the resin. A coating liquid having the above formulation is applied by spray coating in a thickness of about 2.5 μm to form the charge-injecting layer.

The surface layer of the resulting photosensitive member had a volume resistivity of $5\times10^{12}$ Ωcm which is lower than that of $1\times10^{15}$ Ωcm of the simple charge-transporting layer. The photosensitive member surface showed a water contact angle of 93°. This photosensitive member is called "photosensitive member 1".

The contact angle was measured by using pure water by means of a contact angle tester, CA-DS (manufactured by Kyowa Kaimen Kagaku K.K.).

Photosensitive Member Production Example 2

The first layer and the subbing layer of the photosensitive member were formed in the same manner as in Photosensitive Member Production Example 1. A charge-generating layer was formed to be mainly composed of a butyral resin containing a titanyl phthalocyanine pigment having an absorption band in the long wavelength region dispersed therein (layer thickness: 0.7 μm). A charge-transporting layer was formed from a hole-carrying triphenylamine compound dissolved in a polycarbonate resin in a ratio of 10:10 by weight (layer thickness: 18 μm). Further thereon, a charge-injecting layer was formed as below. The same materials were dissolved in a ratio of 5:10 by weight. Thereto, 120 parts of particulate $SnO_2$ having been treated for lower resistivity (particle diameter: 0.03 μm) was added based on 100 parts of the resin. Further thereto, powdery polytetrafluoroethylene (particle diameter 0.1 μm) was added in an amount of 30% by weight based on the total solid matter. The resulting mixture was dispersed uniformly, and was applied on the charge-transporting layer to form a charge-injection layer (layer thickness: 3 μm). The resistivity of the surface of the photosensitive member was $2\times10^{13}$ Ωcm. The contact angle to water of the surface thereof was 101°. This photosensitive member is referred to as "Photosensitive Member 2".

Photosensitive Member Production Example 3

Photosensitive Member 3 was produced in the same manner as in Photosensitive Member Production Example 2 except that the powdery polytetrafluoroethylene was not added in the charge-injecting layer (surface layer of the photosensitive member). The contact angle to water of the surface of the photosensitive member was 78°. Photosensitive Member Characteristics The photosensitive member characteristics are measured under the process conditions of a practical apparatus. In the measurement, a surface electrometer probe is placed directly behind the light exposure site. The potential of the photosensitive member without light exposure is represented by Vd. The exposure light intensity is changed gradually, and the surface potential of the photosensitive member is recorded. The intensity of exposure light at which the potential of the photosensitive member is decreased to half of the dark portion potential (Vd), i.e., Vd/2, is called half-life exposure intensity. The potential at which exposure is carried out with a light quantity of 30 times the half-life exposure intensity is defined as the residual potential, Vr.

A laser beam printer, LBP-860 (manufactured by Canon K.K.), was employed as an electrophotography apparatus to evaluate the characteristics of the photosensitive members produced in Photosensitive Member Production Examples. In the evaluation, the process speed was 47 mm/s. The formation of latent image was a digital latent image by on-off of 300 dpi. In Examples, the charging member for the photosensitive member was replaced by a magnetic brush roll charging member, and DC voltage was applied.

The photosensitive member characteristics were measured by monitoring the potential by changing the light quantity of the laser beam. The laser beam was allowed to scan continuously in a secondary scanning direction for entire surface exposure.

Figure 3:
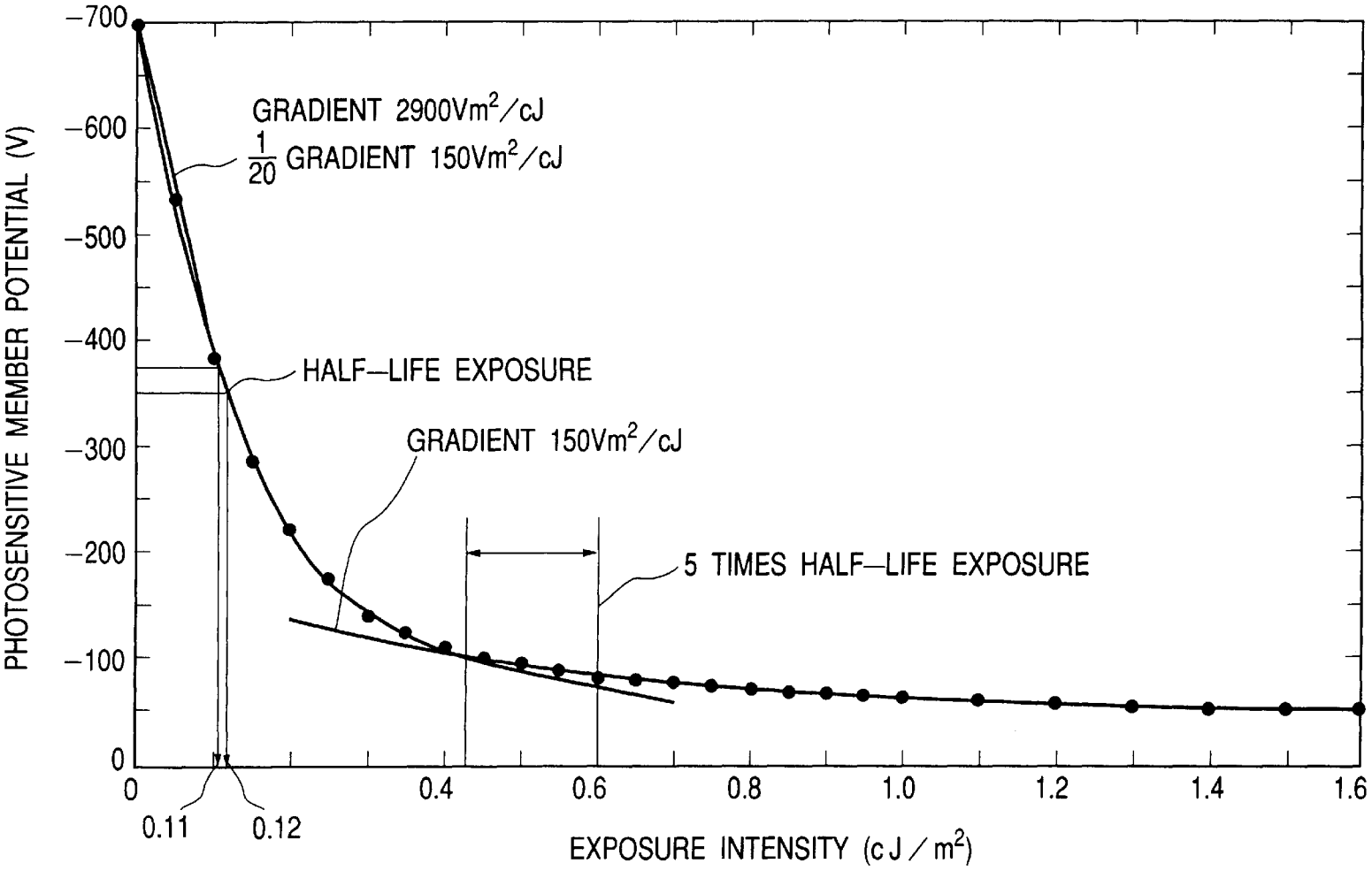
FIG. 3 is a graph showing photosensitive member performance of Photosensitive Member Production Example 1.

In the measurement of the photosensitive member of Photosensitive Member Production Example 1, the dark area potential was −700 V, the light quantity to decrease the dark area potential by half, the half-life light quantity of photosensitive member was 0.38 $cJ/m^2$, the residual potential Vr was −55 V, the gradient of the line connecting Vd and (Vd+Vr)/2 was 920 $Vm^2/cJ$, and the 1/20 gradient was 45 $m^2/cJ$. The contact point of the photosensitive characteristics curve with the 1/20 gradient was 1.55 $cJ/m^2$, which is five times the half-life light quantity, 1.90 $cJ/m^2$. FIG. 3 shows the graph of the photosensitive member characteristics. The same measurements were conducted for the photosensitive members of Photosensitive Member Production Examples 2 and 3. Table 3 shows the measurement results.

EXAMPLE 10

| | |
|---|---|
| Styrene | 170 parts |
| n-Butyl acrylate | 30 parts |
| Carbon black | 10 parts |
| Di-t-butylsalicylic acid-Al compound | 3 parts |
| Saturated polyester (Acid value: 10, peak molecular weight: 9,100) | 10 parts |
| Ester wax (Mw: 450, Mn: 400, Mw/Mn: 1.13, DSC maximum endothermic peak: 68° C., viscosity: 6.1 mPa·s, Vickers hardness: 1.2, SP value: 8.3) | 40 parts |
| Divinylbenzene | 0.5 parts |

The above formulation was heated to 55° C., and dissolved and dispersed uniformly at 10,000 rpm by means of TK Homomixer (manufactured by Tokushu Kika Kogyo K.K.). Therein, 4 parts of 2,2'-azobis(2,4-dimethylvaleronitrile), a polymerization initiator, was dissolved to prepare a polymerizable monomer composition.

Separately, to 710 parts of deionized water, was added 450 parts of aqueous 0.1M-$Na_3PO_4$ solution. The mixture was heated to 60° C., and stirred at 1,300 rpm with a TK Homomixer (manufactured by Tokushu Kika Kogyo K.K.). Thereto, 68 parts by weight of aqueous 1.0M-$CaCl_2$ solution was added gradually to obtain an aqueous medium containing $Ca_3(PO_4)_2$.

The above polymerizable monomer composition was added to this aqueous medium. Further thereto, 2 parts of polyethylene was added. The mixture was stirred at 55° C. in a nitrogen atmosphere for 20 minutes at 10,000 rpm with a TK Homomixer to form a particle dispersion of the polymerizable monomer composition.

The dispersion was stirred with a paddle stirrer at 55° C. for one hour to allow the reaction to proceed, heated to 60° C. in one hour, allowed to react for 4 hours, heated at a rate of 40° C./hr up to 80° C., and allowed to polymerize for 4 hours. During the polymerization reaction, nitrogen was bubbled every one hour into the aqueous medium to adjust the dissolved oxygen concentration in the range from 0.5 to 1.0 mg/L.

After the polymerization reaction, the reaction mixture was cooled. Hydrochloric acid was added thereto to dissolve the calcium phosphate. The polymerization product was collected by filtration, washed with water, and dried to obtain black polymerization particles (black toner) having weight-average particle diameter of 6.8 μm.

To 100 parts of the black toner, were added 1.0 parts of fine powdery silica having been treated for hydrophobicity with silicone oil, and 1.0 parts of fine particulate hydrophobic titanium oxide. The mixture was blended by a Henschel mixer to obtain Black Toner AA.

Black Toner AA was mixed with a ferrite carrier (average particle diameter: 50 μm) in a mixing ratio of 7:100 to obtain Two-Component Developer AA.

Table 4 shows the properties of Black Toner AA.

A digital copying machine GP55 (manufactured by Canon K.K.) was employed as the electrophotography apparatus. This copying machine was modified to run at a process speed higher by a factor of 1.5, and to form digital latent images by on-off of 300 dpi.

The magnetic particles prepared in Charging Member Production Example 1 was used as the contact charging means. The magnetic particles were caused to ear as a magnetic brush by means of an electroconductive sleeve having a magnet roll in the inside. The sleeve is made of a non-magnetic aluminum sleeve, the surface of which is subjected to blast treatment. This electroconductive sleeve was set to keep the gap between the sleeve surface and the photosensitive member surface to be about 500 $\mu$m. The magnetic particles are formed into a magnetic brush with a charging nip of about 5 mm wide in the photosensitive member surface by causing the particles to ear on the electroconductive sleeve with the aid of the magnetic constraining force of the magnet roll. The sleeve was rotated to slide in a direction reverse to the rotation of the photosensitive member at a speed of 200% for uniform contact between the photosensitive member surface and the magnetic brush.

Here, the peripheral speed difference is defined by the equation below:

$$(\text{Peripheral speed difference})=(|V-v|/|V|)\times 100$$

where V is the peripheral speed of the photosensitive member at the contact portion between the charging member and the photosensitive member, and v is the peripheral speed of the charging member.

The magnetic flux density (B) of the magnet roll was 0.09T. The pole showing the maximum magnetic flux density was fixed to the position opposed to the photosensitive member. The magnetization ($\sigma_B$) of the magnetic particles of Charging Member Production Example 1 was about 58 ($Am^2/kg$) at 0.09T, and $B\cdot\sigma_B$ was 5.22.

In the case where the magnetic brush is fixed, since the magnetic brush itself lacks in restoring force, the magnetic brush cannot keep the nip when it is displaced by swinging or decentering of the photosensitive member and may cause charging failure. Therefore, it is preferred to bring successively new magnetic brush surface into contact. Therefor, in this Example, the charging is carried out by means of a charging device which is constituted so as to be rotated in a reverse direction at 2 times speed. Additionally, the development portion of the process cartridge was modified as below. The stainless steel sleeve as the toner feeder was replaced by a rubber roller (16 mm diameter) with a medium resistance composed of foamed polyurethane as the toner carrier to contact with the photosensitive member. The toner carrier rotates in the same direction at the portion in contact with the photosensitive member at a peripheral speed of 180% relative to that of the photosensitive member.

For applying the toner to the toner carrier, an applying roller is provided and is brought into contact with the toner carrier at the development portion. Further, a stainless steel blade coated with a resin is provided to control the toner coat layer on the toner carrier. The voltage of DC component only (−300 V) is applied during the development.

With the modified GP 55 copying machine, continuous copying test of 50,000 sheets was conducted using a two-component developer. Thereby, image quality, running performance or durability, and staining of the charging member were evaluated.

Image Quality

After continuous copying of 50,000 sheets (images with a printing area ratio of 5.24%), the reproducibility of the gradation was examined by visual observation. The image quality was evaluated according to the evaluation standards below.

Evaluation Standard

A: Excellent

B: Very good

C: Good

D: Slightly Poor

E: Poor

Running Performance, or Durability

Copying was conducted with the above modified GP55 copying machine by continuously feeding 50,000 paper sheets (copying of images with a solid print portion of 5 mm diameter and having a print area ratio of 5.24%). The change of the image density was evaluated according to the evaluation standards below. The image density was measured for the solid print portion of 5 mm diameter by means of a MacBeth Densitometer (manufactured by MacBeth Co.).

Evaluation Standards

A: 1.50<(Image density)

B: 1.20<(Image density)≦1.50

C: 1.10<(Image density)≦1.20

D: 1.00<(Image density)≦1.10

C: (Image density)≦1.00

Staining or Contamination of Charging Member

Copying was conducted with the above modified GP55 copying machine by continuously feeding 50,000 paper sheets (copying of images having a print area ratio of 5.24%). The surface of the charging member was examined visually, and the staining was evaluated according to the standards below.

Evaluation Standards

A: No staining

B: About 30% of surface area stained

C: About 50% of surface area stained

D: About 70% of surface area stained

E: Entire surface stained

Unfixed images were formed with the above modified GP55 copying machine. The unfixed images were fixed on a recording medium by the separate fixing device. The fixation performance was evaluated by measuring the fixation beginning temperature and the offset temperature.

The unfixed image formed on the recording medium was fixed at a fixation speed of 150 mm/sec by a fixing device of a commercial NP-6650 (manufactured by Canon K.K.) modified such that the fixation temperature is changeable by 5° C. from 120° C. to 220° C. The recording medium was a commercial copying paper sheet, Canon New Dry Paper (basis weight: 54 $g/m^2$, supplied by Canon Sales Co., Ltd.).

The evaluation was made regarding the items below.

Fixation Beginning Temperature

The Fixation is conducted by changing the fixation temperature by 5° C. from 120° C. The resulting fixed image is rubbed with a silbon paper sheet to-and-fro ten times with application of a load of about 100 g. The temperature at which the drop ratio (%) of the reflection density caused by exfoliation of the image becomes 10% or less is regarded to be the fixation beginning temperature.

Offset Temperature

The fixation temperature is changed stepwise by 10° C. from 120° C. A solid image of 5 cm×5 cm (toner quantity: 0.5–0.6 $mg/cm^2$) is formed at the middle of the top end portion of a copying paper sheet. This sheet is passed through the fixing device. When the toner of the solid image is peeled and re-transferred onto the rear end portion of the paper sheet in the passing direction, the temperature at that time is defined as the offset temperature.

Further, the storability of Black Toner A was evaluated.

Storability

5 Grams of Black Toner A was placed in a cylindrical polyethylene cup and was stored under the environmental conditions of temperature of 30° C. and humidity of 80% RH for one week. The polyethylene cup was tilted at an angle of 45°, and was rotated round the bottle cylinder axis by 360°. The state of the toner was examined visually, and evaluated according to the evaluation standards below.

Evaluation Standards

A: Toner loosened rapidly

B: About 70% of toner loosened

C: About 50% of toner loosened

D: About 30% of toner loosened

E: Toner not loosened at all

Table 6 shows the evaluation results.

EXAMPLE 11

| | |
|---|---|
| Styrene | 170 parts |
| 2-Ethylhexyl acrylate | 30 parts |
| Copper phthalocyanine pigment | 15 parts |
| Di-t-butylsalicylic acid-Cr compound | 3 parts |
| Saturated polyester | 10 parts |
| (Acid value: 10, peak molecular weight: 9,100) | |
| Ester wax | 30 parts |
| (Mw: 500, Mn: 400, Mw/Mn: 1.25, DSC maximum endothermic peak: 70° C., viscosity: 6.5 mPa·s, Vickers hardness: 1.1, SP value: 8.6) | |
| Divinylbenzene | 0.2 parts |

Cyan polymerization particles (cyan toner) of a weight-average particle diameter of 6.3 μm was prepared in the same manner as in Example 10 except that the above formulation was used.

The cyan toner was mixed with fine powdery silica having been treated for hydrophobicity with silicone oil in the same manner as in Example 10 to obtain Cyan Toner BB. Table 3 shows the properties of Cyan Toner BB. Cyan Toner BB was mixed with ferrite carrier in the same manner as in Example 10 to prepare Two-Component Developer BB.

The obtained Two-Component Developer BB was evaluated in the same manner as in Example 10 except that Two-Component Developer BB was used in place of Two-Component Developer AA. Table 6 shows the evaluation results.

Comparative Example 17

| | |
|---|---|
| Styrene | 170 parts |
| 2-Ethylhexyl acrylate | 30 parts |
| Carbon black pigment | 15 parts |
| Monoazo type Fe complex | 3 parts |
| Saturated polyester | 10 parts |
| (Acid value: 10, peak molecular weight: 9,100) | |
| Paraffin wax | 30 parts |
| (Mw: 570, Mn: 380, Mw/Mn: 1.50, DSC maximum endothermic peak: 69° C., viscosity: 6.8 mPa·s, Vickers hardness: 0.7, SP value: 8.3) | |
| Divinylbenzene | 0.28 parts |

With the above formulation, a polymerizable monomer composition was prepared in the same manner as in Example 10. The polymerizable monomer composition was introduced into an aqueous medium prepared in the same manner as in Example 10. Black polymerization particles (black toner) of a weight-average particle diameter of 7.4 μm were obtained through the same steps as in Example 10 except that the polyethylene was not added.

The black toner was mixed with fine powdery silica having been treated for hydrophobicity with silicone oil in the same manner as in Example 10 to obtain Black Toner CC. Table 3 shows the properties of Black Toner CC. Black Toner CC was mixed with ferrite carrier in the same manner as in Example 10 to prepare Two-Component Developer CC.

The obtained Two-Component Developer CC was evaluated in the same manner as in Example 10 except that Two-Component Developer CC was used in place of Two-Component Developer AA. Table 6 shows the evaluation results.

Comparative Example 18

| | |
|---|---|
| Styrene | 170 parts |
| 2-Ethylhexyl acrylate | 30 parts |
| Quinacridone pigment | 15 parts |
| Di-t-butylsalicylic acid-Cr compound | 3 parts |
| Saturated polyester | 10 parts |
| (Acid value: 10, peak molecular weight: 9,100) | |
| Carnauba wax | 30 parts |
| (Mw: 900, Mn: 530, Mw/Mn: 1.70, DSC maximum endothermic peak: 65° C., viscosity: 6.3 mPa·s, Vickers hardness: 6.8, SP value: 8.7) | |
| Divinylbenzene | 0.20 parts |

Magenta polymerization particles (magenta toner) of a weight-average particle diameter of 6.6 μm was prepared in the same manner as in Example 10 except that the above formulation was used.

The magenta toner was mixed with fine powdery silica having been treated for hydrophobicity with silicone oil in the same manner as in Example 10 to obtain Magenta Toner DD. Table 3 shows the properties of Magenta Toner DD. Magenta Toner DD was mixed with ferrite carrier in the same manner as in Example 10 to prepare Two-Component Developer DD.

The obtained Two-Component Developer DD was evaluated in the same manner as in Example 10 except that Two-Component Developer DD was used in place of Two-Component Developer AA. Table 6 shows the evaluation results.

Comparative Example 19

A polymerizable monomer composition was prepared in the same manner as in Example 10 except that the amount of the polymerization initiator, 2,2'-azobis(2,4-dimethylvaleronitrile), was changed to 3 parts. The formation of dispersion of the polymerizable monomer composition was conducted while changing the temperature of the aqueous medium to 60° C. without adding polyethylene. After the formation of the dispersion, the polymerization was conducted with stirring by a paddle stirrer in the same manner as in Example 10 except that the temperature was elevated to 80° C. in one hour, the reaction was conducted for 10 hours, and nitrogen bubbling into the aqueous medium was not conducted, whereby black polymerization particles (black toner) was obtained.

The black toner was mixed with fine powdery silica having been treated for hydrophobicity with silicone oil to obtain Black Toner EE. Table 3 shows the properties of Black Toner EE. Black Toner EE was mixed with ferrite carrier in the same manner as in Example 10 to prepare Two-Component Developer EE.

The obtained Two-Component Developer EE was evaluated in the same manner as in Example 10 except that Two-Component Developer EE was used in place of Two-Component Developer AA. Table 6 shows the evaluation results.

Comparative Example 20

| | |
|---|---|
| (Monomer) | |
| Styrene | 170 parts |
| 2-Ethylhexyl acrylate | 30 parts |
| (Colorant) Carbon black | 10 parts |
| (Charge control agent) Di-t-butylsalicylic acid-Al compound | 3 parts |
| (Release agent) Paraffin wax (DSC maximum absorption peak: 70° C.) | 30 parts |
| (Polymerization initiator) | |
| 2,2'-Azobis(2,4-dimethylvaleronitrile) | 10 parts |
| Dimethyl 2,2'-azobisisobutyrate | 1 part |

The above formulation was heated to 60° C., and stirred at 9,000 rpm with a TK Homomixer (manufactured by Tokushu Kika Kogyo K.K.) for dissolution and dispersion to form a polymerizable monomer composition.

Black polymerization particles (black toner) were prepared in the same manner as in Example 10 except that the polymerizable monomer composition was replaced with the above one; the temperature of the aqueous medium during the formation of particle dispersion was changed to 60° C.; the polyethylene was not added in the particle dispersion step; the formation of particle dispersion was conducted for one hour; the reaction was conducted with stirring with a paddle stirrer at 60° C. for 7 hours; heated to 80° C. in 0.5 hours and the reaction was continued for further 4 hours; and the nitrogen was not bubbled into the aqueous medium during the polymerization.

The resulting black toner was mixed with fine powdery silica having been treated for hydrophobicity with silicone oil in the same manner as in Example 10 to obtain Black Toner FF. Table 3 shows the properties of Black Toner FF. Black Toner FF was mixed with a ferrite carrier in the same manner as in Example 10 to prepare Two-Component Developer FF.

The obtained Two-Component Developer FF was evaluated in the same manner as in Example 10 except that Two-Component Developer FF was used in place of Two-Component Developer AA. Table 6 shows the evaluation results.

EXAMPLE 12

| | |
|---|---|
| Styrene | 170 parts |
| n-Butyl acrylate | 30 parts |
| Quinacridone pigment | 15 parts |
| Di-t-butylsalicylic acid-Cr compound | 3 parts |
| Saturated polyester (Acid value: 10, peak molecular weight: 9,100) | 10 parts |
| Diester wax (Mw: 480, Mn: 410, Mw/Mn: 1.17, melting point: 73° C., viscosity: 10.5 mPa·s, Vickers hardness: 1.0, SP value: 9.1) | 30 parts |
| Divinylbenzene | 0.18 parts |

Magenta polymerization particles (magenta toner) of a weight-average particle diameter of 6.9 μm was prepared in the same manner as in Example 10 by preparing a polymerizable monomer composition from the above formulation and adding it to an aqueous medium prepared in Example 10 except that the polyethylene was not added and the period of time for the polymerization at 80° C. was changed from 4 hours to 6 hours.

The magenta toner was mixed with fine powdery silica having been treated for hydrophobicity with silicone oil in the same manner as in Example 10 to obtain Magenta Toner GG. Table 3 shows the properties of Magenta Toner GG. Magenta Toner GG was mixed with a ferrite carrier in the same manner as in Example 10 to prepare Two-Component Developer GG.

The obtained Two-Component Developer GG was evaluated in the same manner as in Example 10 except that Two-Component Developer GG was used in place of Two-Component Developer AA. Table 6 shows the evaluation results.

EXAMPLE 13

| | |
|---|---|
| Styrene | 170 parts |
| 2-Ethylhexyl acrylate | 30 parts |
| Copper phthalocyanine pigment | 15 parts |
| Di-t-butylsalicylic acid Al compound | 3 parts |
| Saturated polyester (Acid value: 10, peak molecular weight: 9,100) | 10 parts |
| Ester wax (Mw: 450, Mn: 400, Mw/Mn: 1.25, melting point: 70° C., viscosity: 6.5 mPa·s, Vickers hardness: 1.1, SP value: 8.6) | 30 parts |
| Divinylbenzene | 0.20 parts |

Cyan polymerization particles (cyan toner) of a weight-average particle diameter of 6.8 μm was prepared in the same manner as in Example 10 except that the above formulation was used.

The resulting cyan toner was mixed with fine powdery silica having been treated for hydrophobicity with silicone oil in the same manner as in Example 10 to obtain Cyan Toner HH. Table 3 shows the properties of Cyan Toner HH. Cyan Toner HH was mixed with a ferrite carrier in the same manner as in Example 10 to prepare Two-Component Developer HH.

The obtained Two-Component Developer HH was evaluated in the same manner as in Example 10 except that Two-Component Developer HH was used in place of Two-Component Developer AA. Table 6 shows the evaluation results.

EXAMPLE 14

Evaluation was made by use of a copying machine modified as in Example 10 except that the magnetic particulate matter or particles produced in Charging Member Production Example 3 as shown in Table 5 was used in place of the magnetic particulate matter used as the charging member in Example 10, and Photosensitive Member 3 produced in Photosensitive Member Production Example 3 was used in place of Photosensitive Member 1 as shown in Table 5. The evaluation results are shown in Table 6.

Comparative Examples 21, and 22

Evaluation was made by use of a copying machine modified as in Example 10 except that the magnetic particulate matter produced in Charging Member Production Example 2 or 4 as shown in Table 5 was used in place of the magnetic particulate matter used as the charging member in Example 10, and Two-Component Developers CC, DD used in Comparative Examples 17, 18. The evaluation results are shown in Table 6 was used.

EXAMPLE 15

Evaluation was made in the same manner as in Example 10 by use of a copying machine modified as in Example 10 except that the magnetic particulate matter produced in Charging Member Production Example 2 as shown in Table 5 was used in place of the magnetic particulate matter used for the charging member in Example 10, and Two-Component Developer BB used in Example 11 was used. The evaluation results are shown in Table 6.

EXAMPLES 16 AND 17

Evaluation was made in the same manner as in Example 10 except that the magnetic particulate matter produced in any of Charging Member Production Examples 5 and 6 was used in place of the magnetic particulate matter used for the charging member in Example 10. The evaluation results are shown in Table 6.

EXAMPLE 18

Two-Component Developer AA produced in Example 10 was evaluated in the same manner as in Example 10 except that the copying machine was modified as below.

The charging member employed in Example 10 was replaced by a fur brush roll produced in Charging Member Production Example 7. This fur brush was placed so as to form a charging nip of about 5 mm wide between the brush and the photosensitive member during the image formation. The fur brush roll was rotated to cause sliding of the surface in the direction reverse to the rotation direction of the photosensitive member at a speed of 250% with uniform contact maintained between the photosensitive member and the fur brush. The photosensitive member was replaced by Photosensitive Member 2 produced in Photosensitive Member Production Example 2.

Table 6 shows the evaluation results.

EXAMPLE 19

Yellow Toner II and a two component developer were prepared in the same manner as in Example 10 except that C.I. Pigment Yellow 17 was used as the colorant in place of carbon black in Example 10.

Magenta Toner JJ and a two component developer were prepared in the same manner as in Example 10 except that a quinacridone pigment was used as the colorant in place of carbon black in Example 10.

Cyan Toner KK and a two component developer were prepared in the same manner as in Example 10 except that C.I. Pigment Blue 15:3 was used as the colorant in place of carbon black in Example 10.

A full color image was formed by means of a full color image forming apparatus as shown in FIG. 7 employing four two-component developers including a two-component developer having Yellow Toner II, a two-component developer having Magenta Toner JJ, and a two-component developer having Cyan Toner KK prepared above, and a two-component developer having Black Toner AA prepared in Example 10.

As for the image forming apparatus shown in FIG. 7, the two-component developer having Yellow Toner II was used in the first image forming unit Pa, the two-component developer having Magenta Toner JJ was used in the second image forming unit Pb; the two-component developer having Cyan Toner KK was used in the third image forming unit Pc; and the two-component developer having Black Toner AA was used in the fourth image forming unit Pd.

In the image forming units Pa, Pb, Pc, and Pd, the magnetic particles used in Charging Member Production Example 1 were used as the charging member. The magnetic particles were caused to ear as a magnetic brush by means of an electroconductive sleeve having a magnet roll in the inside. The sleeve is made of a non-magnetic aluminum sleeve, the surface of which is subjected to the blast treatment. This electroconductive sleeve was set to keep the gap between the sleeve surface and the photosensitive member surface to be about 500 $\mu$m. The magnetic particles are formed into a magnetic brush with a charging nip of about 5 mm wide in the photosensitive member surface by causing the particles to ear on the electroconductive sleeve with the aid of the magnetic constraining force of the magnet roll. The sleeve was rotated to slide in a direction reverse to the rotation of the photosensitive member at a speed of 200% for uniform contact between the photosensitive member surface and the magnetic brush.

Here, the peripheral speed difference is defined by the equation below:

$$(\text{Peripheral speed difference})=(|V-v|/|V|)\times 100$$

where V is the peripheral speed of the photosensitive member at the contact portion between the charging member and the photosensitive member, and v is the peripheral speed of the charging member.

The magnetic flux density (B) of the magnet roll was 0.09T. The pole showing the maximum magnetic flux density was fixed to the position opposed to the photosensitive member. The magnetization ($\sigma_B$) of the magnetic particles of Charging Member Production Example 1 was about 58 ($Am^2/kg$) at 0.09T, and $B\cdot\sigma_B$ was 5.22.

In the case where the magnetic brush is fixed, since the magnetic brush itself lacks in restoring force, the nip of the magnetic brush cannot be secured when it is displaced by swinging or decentering of the photosensitive member, which may cause charging failure. Therefore, it is preferred to bring successively new magnetic brush surface into contact. Therefore, in this Example, the charging is carried out by means of a charging device which is constituted so as to be rotated in a reverse direction at 2 times speed.

The photosensitive member prepared in Photosensitive Member Production Example 1 was used as the photosensitive member, and a charging bias voltage of AC component of peak voltage 2 KV is applied to the conductive sleeve, and the primary charging of 500 V was conducted on the photosensitive member surface.

The primarily charged surface of the photosensitive member is exposed to a laser light to form a digital electrostatic latent image with a residual potential of 350 V.

In this example, a developing apparatus is used which employs dry type two component contact developing system using a two component developer as shown in FIG. 10, and reverse development of the digital electrostatic latent image on the photosensitive member was carried out under the following development conditions to form a toner image.

Development Conditions

- Development sleeve: SUS sleeve blast-treated with glass beads of #600
- Gap β between development sleeve and photosensitive drum: 550 $\mu$m
- Elastic blade: Polyurethane rubber blade having a nylon resin layer on the surface
- Developer layer thickness on development sleeve: 70 $\mu$m
- Development bias: AC electric field with peak voltage of 2 KV
- Process speed: 180 m/sec The toner images developed on the photosensitive members were electrostatically transferred to a recording medium one after another. As a result, a full color image having four color toners was electrostatically transferred to a recording medium.

Transfer Conditions

Transfer bias: Transfer bias was made higher successively from the first image forming unit toward the fourth image forming unit, and DC voltage of 0.8 to 1.2 KV was applied.

The full color image formed from the four color toners transferred to the recording medium was fixed by heating by means of a fixation device mentioned below. The fixation was carried out by a heat roll fixing device having a heating roller as set to a desired temperature and a pressing roller with an elastic layer coming to pressure contact with the heating roller. As a result, good toner characteristics were obtained, for example, excellent anti-offset properties and a broad fixing temperature region. Further, the color exhibited by multiple layers of toner formed had satisfactory color mixing properties and superior chroma to achieve the formation of full color image of improved quality.

As described above, the toner for developing. electrostatic images according to the present invention hardly causes filming on the photosensitive member or contamination of the surfaces of the toner carrying members such as carriers and sleeves and exhibits superior running performance on many sheets, without damaging low-temperature fixing properties and anti-offset properties.

TABLE 1

| | Toner Properties | | | | | | | | | | | |
|---|---|---|---|---|---|---|---|---|---|---|---|---|
| | | | Molecular weight distribution by GPC | | | | | | | | | |
| | Toner | | LMW | HMW | (L/T) | (M/T) | (H/T) | | | Mw/Mn of MW 800– | Whole polymer | |
| | Type | Process | peak | peak | ×100 | ×100 | ×100 | Hb/Ha | Hc/Ha | 3000 | Mw | Mn |
| Example | | | | | | | | | | | | |
| 1 | A | Polymn | 1,300 | 32,000 | 4 | 21 | 7 | 1.21 | 0.07 | 1.23 | 160,000 | 10,000 |
| 2 | A | Polymn | 1,300 | 32,000 | 4 | 21 | 7 | 1.21 | 0.07 | 1.23 | 160,000 | 10,000 |
| Comparative Example | | | | | | | | | | | | |
| 1 | B | Polymn | 1,200 | 25,000 | 17 | 19 | 6 | 1.20 | 0.17 | 1.25 | 170,000 | 22,000 |
| 2 | B | Polymn | 1,200 | 25,000 | 17 | 19 | 6 | 1.20 | 0.17 | 1.25 | 170,000 | 22,000 |
| 3 | C | Polymn | 1,200 | 22,000 | 19 | 26 | 3 | 1.18 | 0.16 | 1.27 | 192,000 | 22,000 |
| 4 | C | Polymn | 1,200 | 22,000 | 19 | 26 | 3 | 1.18 | 0.16 | 1.27 | 192,000 | 22,000 |
| 5 | D | Polymn | 1,100 | 32,000 | 0 | 28 | 7 | 1.21 | 0 | — | 179,000 | 10,400 |
| 6 | D | Polymn | 1,100 | 32,000 | 0 | 28 | 7 | 1.21 | 0 | — | 179,000 | 10,400 |
| 7 | E | Polymn | 1,100 | 32,000 | 19 | 20 | 7 | 1.21 | 0.13 | 1.35 | 98,000 | 9,700 |
| 8 | E | Polymn | 1,100 | 32,000 | 19 | 20 | 7 | 1.21 | 0.13 | 1.35 | 98,000 | 9,700 |
| 9 | F | Polymn | 1,250 | 28,000 | 0 | 8 | 1 | 1.26 | 0 | — | 71,000 | 17,800 |
| 10 | F | Polymn | 1,250 | 28,000 | 0 | 8 | 1 | 1.26 | 0 | — | 71,000 | 17,800 |
| 11 | G | Polymn | 1,000 | 19,000 | 9 | 7 | 1 | 2.64 | 0.23 | 1.34 | 70,000 | 6,500 |
| 12 | G | Polymn | 1,000 | 19,000 | 9 | 7 | 1 | 2.64 | 0.23 | 1.34 | 70,000 | 6,500 |
| Example | | | | | | | | | | | | |
| 3 | H | Polymn | 1,300 | 37,000 | 2 | 22 | 20 | 0.80 | 0.03 | 1.50 | 112,000 | 19,400 |
| 4 | H | Polymn | 1,300 | 37,000 | 2 | 22 | 20 | 0.80 | 0.03 | 1.50 | 112,000 | 19,400 |
| Comparative Example | | | | | | | | | | | | |
| 13 | I | Polymn | 1,300 | 37,000 | 17 | 30 | 14 | 0.50 | 0.09 | 1.52 | 100,000 | 9,500 |
| 14 | I | Polymn | 1,300 | 37,000 | 17 | 30 | 14 | 0.50 | 0.09 | 1.52 | 100,000 | 9,500 |
| 15 | J | Polymn | 1,300 | 37,000 | 11 | 21 | 29 | 11.2 | 1.20 | 8.30 | 148,000 | 11,600 |
| 16 | J | Polymn | 1,300 | 37,000 | 11 | 21 | 29 | 11.2 | 1.20 | 8.30 | 148,000 | 11,600 |
| Reference Example | | | | | | | | | | | | |
| 5 | K | Polymn | 1,200 | 36,000 | 12 | 19 | 21 | 1.05 | 0.08 | 1.54 | 143,000 | 10,400 |
| 6 | L | Pulvzn | 1,900 | 17,000 | 6 | 21 | 26 | 1.23 | 0.09 | 2.10 | 111,000 | 9,800 |
| 7 | M | Pulvzn | 2,300 | 19,000 | 7 | 26 | 24 | 1.20 | 0.08 | 3.10 | 105,000 | 10,200 |

| | Toner Type | Toluene-insoluble matter content (wt parts) | Releasing agent content (wt parts) | DSC Endothermic peak | Core/shell structure | Weight-average particle diameter (μm) |
|---|---|---|---|---|---|---|
| Example | | | | | | |
| 1 | A | 33.4 | 15 | 68 | Observed | 7.0 |
| 2 | A | 33.4 | 15 | 68 | Observed | 7.0 |
| Comparative Example | | | | | | |
| 1 | B | 41.2 | 15 | 68 | Observed | 6.8 |
| 2 | B | 41.2 | 15 | 68 | Observed | 6.8 |
| 3 | C | 38.1 | 15 | 68 | Observed | 6.8 |

TABLE 1-continued

| | | | | | | |
|---|---|---|---|---|---|---|
| 4 | C | 38.1 | 15 | 68 | Observed | 6.8 |
| 5 | D | 31.1 | 15 | 68 | Observed | 7.3 |
| 6 | D | 31.1 | 15 | 68 | Observed | 7.3 |
| 7 | E | 40.3 | 15 | 68 | Observed | 7.4 |
| 8 | E | 40.3 | 15 | 68 | Observed | 7.4 |
| 9 | F | 36.2 | 15 | 68 | Observed | 7.1 |
| 10 | F | 36.2 | 15 | 68 | Observed | 7.1 |
| 11 | G | 0 | 15 | 70 | Observed | 6.6 |
| 12 | G | 0 | 15 | 70 | Observed | 6.6 |
| Example | | | | | | |
| 3 | H | 37.7 | 30 | 70 | Observed | 7.2 |
| 4 | H | 37.7 | 30 | 70 | Observed | 7.2 |
| Comparative Example | | | | | | |
| 13 | I | 38.4 | 90 | 70 | None | 7.7 |
| 14 | I | 38.4 | 90 | 70 | None | 7.7 |
| 15 | J | 40.4 | 0 | 70 | Observed | 6.9 |
| 16 | J | 40.4 | 0 | 70 | Observed | 6.9 |
| Reference Example | | | | | | |
| 5 | K | 32.4 | 15 | 68 | Observed | 7.0 |
| 6 | L | 34.5 | 10 | 69 | None | 6.9 |
| 7 | M | 39.9 | 10 | 69 | None | 7.5 |

(Remark)
Process: Toner production process,
Polymn: Polymerization,
Pulvzn: Pulverization,
LMW peak: Peak position in low molecular region,
HMW peak: peak position in high molecular region

35

TABLE 2

| | | Evaluation Results | | | | | | | | |
|---|---|---|---|---|---|---|---|---|---|---|
| | | Fixation | | Durability | | | | | | |
| | | Fixation | | | | | Initial stage | | Final stage | |
| | Toner | beginning temperature | Offset temperature | Evaluation machine | Fogging | Toner fusion | Toner charging | Image density | Toner charging | Image density |
| Example | | | | | | | | | | |
| 1 | A | 140° C. | >220° C. | A | a | a | −32 | 1.51 | −32 | 1.51 |
| 2 | A | 140° C. | >220° C. | B | a | a | −29 | 1.49 | −29 | 1.46 |
| Comparative Example | | | | | | | | | | |
| 1 | B | 145° C. | 220° C. | A | b | c | −30 | 1.46 | −29 | 1.41 |
| 2 | B | 145° C. | 220° C. | B | b | c | −28 | 1.45 | −24 | 1.37 |
| 3 | C | 135° C. | 220° C. | A | b | b | −26 | 1.48 | −22 | 1.45 |
| 4 | C | 135° C. | 220° C. | B | b | c | −27 | 1.42 | −25 | 1.39 |
| 5 | D | 135° C. | 180° C. | A | c | c | −33 | 1.50 | −27 | 1.39 |
| 6 | D | 135° C. | 180° C. | B | c | c | −30 | 1.45 | −23 | 1.33 |
| 7 | E | 135° C. | >220° C. | A | b | d | −26 | 1.45 | −22 | 1.41 |
| 8 | E | 135° C. | >220° C. | B | b | c | −26 | 1.44 | −22 | 1.41 |
| 9 | F | 135° C. | 210° C. | A | b | b | −25 | 1.47 | −21 | 1.45 |
| 10 | F | 135° C. | 210° C. | B | c | b | −23 | 1.45 | −20 | 1.44 |
| 11 | G | 140° C. | 220° C. | A | c | b | −26 | 1.51 | −24 | 1.46 |
| 12 | G | 140° C. | 220° C. | B | c | b | −26 | 1.51 | −23 | 1.48 |
| Example | | | | | | | | | | |
| 3 | H | 135° C. | >220° C. | A | a | a | −34 | 1.53 | −34 | 1.53 |
| 4 | H | 135° C. | >220° C. | B | a | a | −30 | 1.49 | −30 | 1.48 |
| Comparative Example | | | | | | | | | | |
| 13 | I | 135° C. | >220° C. | A | e | e | −30 | 1.47 | −24 | 1.41 |
| 14 | I | 135° C. | >220° C. | B | e | e | −26 | 1.41 | −21 | 1.33 |
| 15 | J | 160° C. | 185° C. | A | c | e | −26 | 1.53 | −23 | 1.29 |

TABLE 3

| | Photosensitive member No. | | |
|---|---|---|---|
| | Photo-sensitive member 1 | Photo-sensitive member 2 | Photo-sensitive member 3 |
| Dark area potential (Vd) | −700 V | −700 V | −700 V |
| Residual Potential (Vr) | −55 V | −60 V | −50 V |
| (Vd + Vr)/2 | −378 V | −380 V | −375 V |
| Gradient of Vd and (Vd + Vr)/2 | 920 $Vm^2/cJ$ | 2900 $Vm^2/cJ$ | 3200 $Vm^2/cJ$ |
| 1/20 Gradient | 45 $Vm^2/cJ$ | 150 $Vm^2/cJ$ | 150 $Vm^2/cJ$ |
| Contact point with 1/20 | 1.55 $cJ/m^2$ | 0.43 $cJ/m^2$ | 0.43 $cJ/m^2$ |
| (Half-life light quantity) × 5 | 1.90 $cJ/m^2$ | 0.60 $cJ/m^2$ | 0.60 $cJ/m^2$ |
| Contant angle to water | 930 | 1010 | 780 |
| Volume resistivity of surface | $5 \times 10^{12}$ Ωcm | $2 \times 10^{13}$ Ωcm | $1 \times 10^{13}$ Ωcm |

TABLE 5-continued

| | Contact charging member No. | Photo-sensitive member No. | $B \cdot \sigma_B$ | Two-component developer |
|---|---|---|---|---|
| 17 | 1 | 1 | 5.22 | CC |
| 18 | 1 | 1 | 5.22 | DD |
| 19 | 1 | 1 | 5.22 | EE |
| 20 | 1 | 1 | 5.22 | FF |
| Example | | | | |
| 12 | 1 | 1 | 5.22 | GG |
| 13 | 1 | 1 | 5.22 | HH |
| 14 | 3 | 3 | 4.77 | AA |
| Comparative Example | | | | |
| 21 | 2 | 1 | 5.31 | CC |
| 22 | 4 | 1 | 5.40 | DD |
| Example | | | | |

TABLE 4

| Toner Properties | | | | | | | | | | | |
|---|---|---|---|---|---|---|---|---|---|---|---|
| | | Molecular weight distribution by GPC | | | | | | | | | |
| Toner | | LMW | HMW | (L/T) | (M/T) | (H/T) | | | Mw/Mn of MW 800– | Whole polymer | |
| Kind | Process | peak | peak | ×100 | ×100 | ×100 | Hb/Ha | Hc/Ha | 3000 | Mw | Mn |
| AA | Polymn | 1,200 | 31,000 | 3 | 34 | 18 | 1.15 | 0.03 | 1.23 | 160,000 | 10,000 |
| BB | Polymn | 1,100 | 25,000 | 6 | 33 | 12 | 1.08 | 0.07 | 1.25 | 170;000 | 22,000 |
| CC | Polymn | 1,250 | 28,000 | 26 | 21 | 22 | 1.19 | 0.31 | 1.18 | 145,000 | 10,600 |
| DD | Polymn | 1,300 | 34,000 | 36 | 24 | 26 | 1.53 | 0.25 | 1.21 | 165,000 | 98,000 |
| EE | Polymn | 1,200 | 26,000 | 8 | 28 | 28 | 0.19 | 1.20 | 1.18 | 112,000 | 194,000 |
| FF | Polymn | 1,000 | 19,000 | 9 | 9 | 7 | 0.01 | 2.64 | 1.34 | 70,000 | 65,000 |
| GG | Polymn | 1,000 | 32,000 | 4 | 30 | 16 | 1.21 | 0.05 | 1.44 | 100,400 | 70,000 |
| HH | Polymn | 1,000 | 32,000 | 2 | 26 | 21 | 0.89 | 0.05 | 1.39 | 180,000 | 10,500 |

| Toner Type | Toluene-insoluble matter content (wt parts) | Release agent content (wt part) | DSC Endothermic peak | Core/shell structure | Weight-average particle diameter (μm) |
|---|---|---|---|---|---|
| AA | 33.4 | 15 | 68 | Observed | 6.8 |
| BB | 34.2 | 15 | 70 | Observed | 6.3 |
| CC | 31.1 | 15 | 69 | Observed | 7.4 |
| DD | 36.2 | 15 | 65 | Observed | 6.6 |
| EE | 32.3 | 15 | 68 | Observed | 6.7 |
| FF | 19.9 | 15 | 70 | Observed | 6.6 |
| GG | 21.3 | 15 | 73 | Observed | 6.9 |
| HH | 20.1 | 15 | 70 | Observed | 6.8 |

(Remark)
Process: Toner production process,
Polymn: Polymerization,
Pulvzn: Pulverization,
LMW peak: Peak position in low molecular region,
HMW peak: peak position in high molecular region

TABLE 5

| | Contact charging member No. | Photo-sensitive member No. | $B \cdot \sigma_B$ | Two-component developer |
|---|---|---|---|---|
| Example | | | | |
| 10 | 1 | 1 | 5.22 | AA |
| 11 | 1 | 1 | 5.22 | BB |
| Comparative Example | | | | |

TABLE 5-continued

| | Contact charging member No. | Photo-sensitive member No. | $B \cdot \sigma_B$ | Two-component developer |
|---|---|---|---|---|
| 15 | 2 | 1 | 5.31 | BB |
| 16 | 5 | 1 | 4.68 | AA |
| 17 | 6 | 1 | 5.04 | AA |
| 18 | 7 | 2 | 5.22 | AA |

TABLE 6

| | Image Evaluation Results | | | | | | |
|---|---|---|---|---|---|---|---|
| | Fixability | | | | | | |
| | Fixation beginning temperature | Offset temperature | Image quality | Durability | Staining of members | storability | Fogging (%) |
| Example | | | | | | | |
| 10 | 135° C. | 220° C. | B | B | B | B | 0.2–0.7 |
| 11 | 135° C. | 220° C. | B | B | B | B | 0.4–0.8 |
| Comparative Example | | | | | | | |
| 17 | 140° C. | 210° C. | C | C | D | C | 0.6–1.1 |
| 18 | 135° C. | 200° C. | C | D | E | C | 1.8–2.0 |
| 19 | 140° C. | 220° C. | B | B | C | C | 1.3–1.6 |
| 20 | 140° C. | 220° C. | C | B | C | B | 1.0–1.2 |
| Example | | | | | | | |
| 12 | 135° C. | >220° C. | B | B | A | B | 0.4–0.8 |
| 13 | 135° C. | >220° C. | B | C | B | B | 0.5–1.0 |
| 14 | 135° C. | 220° C. | B | B | B | C | 0.8–1.1 |
| Comparative Example | | | | | | | |
| 21 | 160° C. | 190° C. | E | B | C | D | 1.6–2.3 |
| 22 | 160° C. | 185° C. | E | C | C | E | 1.5–1.8 |
| Example | | | | | | | |
| 15 | 135° C. | 220° C. | B | B | A | B | 0.7–1.2 |
| 16 | 135° C. | 210° C. | B | B | C | B | 0.5–1.0 |
| 17 | 135° C. | 220° C. | B | A | B | B | 0.8–0.9 |
| 18 | 140° C. | 220° C. | A | A | B | B | 0.6–0.8 |

What is claimed is:

1. A toner for developing electrostatic images, comprising: a binder resin, a colorant and a release agent, said release agent present in an amount from 3 to 40 parts by weight based on 100 parts by weight of said binder resin, wherein;

tetrahydrofuran-soluble matter of said toner, in its molecular-weight distribution as measured by gel permeation chromatography, has at least one peak in the region of molecular weight from 1,000 to less than 2,000 and at least one peak in the region of molecular weight from 2,000 to 300,000, and has a weight-average molecular weight Mw from 100,000 to 1,500,000, where a molecular-weight integral value T in the region of molecular weight of 800 or more, a molecular-weight integral value L in the region of molecular weight from 2,000 to 5,000 and a molecular-weight integral value H in the region of molecular weight of 300,000 or more satisfy the following relationship:

$$1 \leqq (L/T) \times 100 \leqq 15,$$

$$5 \leqq (H/T) \times 100 \leqq 25.$$

2. The toner according to claim 1, wherein, in the molecular-weight distribution as measured by gel permeation chromatography of tetrahydrofuran-soluble matter of said toner, the molecular-weight integral value T in the region of molecular weight of 800 or more, the molecular-weight integral value L in the region of molecular weight of from 2,000 to 5,000 and the molecular-weight integral value H in the region of molecular weight of 300,000 or more satisfy the following relationship:

$$1 \leqq (L/T) \times 100 \leqq 7,$$

$$3 \leqq (H/T) \times 100 \leqq 30.$$

3. The toner according to claim 1, wherein, in the molecular-weight distribution as measured by gel permeation chromatography of tetrahydrofuran-soluble matter of said toner, the molecular-weight integral value T in the region of molecular weight of 800 or more, the molecular-weight integral value L in the region of molecular weight of from 2,000 to 5,000 and the molecular-weight integral value H in the region of molecular weight of 300,000 or more satisfy the following relationship:

$$1 \leqq (L/T) \times 100 \leqq 7,$$

$$5 \leqq (H/T) \times 100 \leqq 25.$$

4. The toner according to claim 1, wherein, in the molecular-weight distribution as measured by gel permeation chromatography of tetrahydrofuran-soluble matter of said toner, the molecular-weight integral value T in the region of molecular weight of 800 or more and a molecular-weight integral value M in the region of molecular weight of 100,000 or more satisfy the following relationship:

$$10 \leqq (M/T) \times 100 \leqq 50.$$

5. The toner according to claim 1, wherein, in the molecular-weight distribution as measured by gel permeation chromatography of tetrahydrofuran-soluble matter of said toner, the molecular-weight integral value T in the region of molecular weight of 800 or more and a molecular-weight integral value M in the region of molecular weight of 100,000 or more satisfy the following relationship:

$$15 \leqq (M/T) \times 100 \leqq 40.$$

6. The toner according to claim 1, wherein, in the molecular-weight distribution as measured by gel permeation chromatography of tetrahydrofuran-soluble matter of said toner, a height Ha of the top peak in the region of molecular weight of from 1,000 to less than 2,000 and a height Hb of the top peak in the region of molecular weight of from 2,000 to 300,000 satisfy the following relationship:

$$0.70 \leqq Hb/Ha \leqq 1.30.$$

7. The toner according to claim 1, wherein, in the molecular-weight distribution as measured by gel permeation chromatography of tetrahydrofuran-soluble matter of said toner, a height Ha of the top peak in the region of molecular weight of from 1,000 to less than 2,000 and a height Hb of the top peak in the region of molecular weight of from 2,000 to 300,000 satisfy the following relationship:

$$0.75 \leqq Hb/Ha \leqq 1.25.$$

8. The toner according to claim 1, wherein, in the molecular-weight distribution as measured by gel permeation chromatography of tetrahydrofuran-soluble matter of said toner, a height Hc at a molecular weight minimum value present between the top peak in the region of molecular weight of from 1,000 to less than 2,000 and the top peak in the region of molecular weight of from 2,000 to 300,000 and a height Ha of the top peak in the region of molecular weight of from 1,000 to less than 2,000 satisfy the following relationship:

$$0.01 \leqq Hc/Ha \leqq 0.15.$$

9. The toner according to claim 1, wherein, in the molecular-weight distribution as measured by gel permeation chromatography of tetrahydrofuran-soluble matter of said toner, a height Hc at a molecular weight minimum value present between the top peak in the region of molecular weight of from 1,000 to less than 2,000 and the top peak in the region of molecular weight of from 2,000 to 300,000 and a height Ha of the top peak in the region of molecular weight of from 1,000 to less than 2,000 satisfy the following relationship:

$$0.01 \leqq Hc/Ha \leqq 0.10.$$

10. The toner according to claim 1, wherein, in the molecular-weight distribution as measured by gel permeation chromatography of tetrahydrofuran-soluble matter, said tetrahydrofuran-soluble matter has a number-average molecular weight Mn of from 8,200 to 700,000.

11. The toner according to claim 1, wherein, in the molecular-weight distribution as measured by gel permeation chromatography of tetrahydrofuran-soluble matter, said tetrahydrofuran-soluble matter has a weight-average molecular weight/number-average molecular weight Mw/Mn of from 4 to 15.

12. The toner according to claim 1, wherein, in the molecular-weight distribution as measured by gel permeation chromatography of tetrahydrofuran-soluble matter, said tetrahydrofuran-soluble matter has a weight-average molecular weight/number-average molecular weight Mw/Mn of not more than 3.0 in the region of molecular weight of from 800 to 3,000.

13. The toner according to claim 1, wherein the resin component of said toner contains a toluene-insoluble matter in an amount of from 2% by weight and 30% by weight based on the weight of the resin component.

14. The toner according to claim 1, wherein the resin component of said toner contains a toluene-insoluble matter in an amount of from 3% by weight and 25% by weight based on the weight of the resin component.

15. The toner according to claim 1, wherein said release agent comprises a member selected from the group consisting of a polymethylene wax, an amide wax, a higher fatty acid, a long-chain alcohol, an ester wax, a graft compound of any of these and a block compound of any of these.

16. The tone r according to claim 1, wherein said release agent comprises an ester wax.

17. The toner according to claim 1, wherein said release agent comprises a wax having a maximum endothermic peak in the region of from 40° C. to 120° C. as measured by differential scanning calorimetry.

18. The toner according to claim 1, wherein said release agent comprises a wax having a maximum endothermic peak in the region of from 40° C. to 90° C. as measured by differential scanning calorimetry.

19. The toner according to claim 1, wherein said toner has toner particles having a core/shell structure wherein the core surface of said release agent is covered with a shell formed of a shell resin.

20. The toner according to claim 1, wherein said toner has toner particles obtained by polymerizing a polymerizable monomer composition containing at least a polymerizable monomer, the colorant and the release agent, in the presence of a polymerization initiator in a liquid medium.

21. The toner according to claim 1, wherein said toner has toner particles obtained by polymerizing a polymerizable monomer composition containing at least a polymerizable monomer, the colorant, the release agent and a polar resin, in the presence of a polymerization initiator in a liquid medium.

22. The toner according to claim 1, wherein said toner has toner particles obtained by polymerizing a polymerizable monomer composition containing at least a polymerizable monomer, the colorant and the release agent, in the presence of a polymerization initiator in an aqueous medium.

23. The toner according to claim 1, wherein said toner has toner particles obtained by polymerizing a polymerizable monomer composition containing at least a polymerizable monomer, the colorant, the release agent and a polar resin, in the presence of a polymerization initiator in an aqueous medium;

said toner particles having a core/shell structure wherein the core surface of the release agent is covered with a shell formed of a shell resin.

24. The toner according to claim 23, wherein said polar resin comprises a polyester resin.

25. The toner according to claim 1, wherein said toner has a weight-average particle diameter of from 4 μm to 10 μm.

26. The toner according to claim 1, wherein said toner has a weight-average particle diameter of from 5 μm to 8 μm.

27. The toner according to claim 1, wherein said toner is used as a one-component developer.

28. The toner according to claim 1, wherein said toner is blended with carrier particles and is used as a two-component developer.

29. An image-forming method comprising the steps of;

electrostatically charging the surface of a latent image bearing member for holding thereon an electrostatic latent image;

forming an electrostatic latent image on the surface of the latent image bearing member thus charged;

developing the electrostatic latent image by the use of a toner to form a toner image, wherein;

said toner comprises a binder resin, a colorant and a release agent, said release agent present in an amount from 3 to 40 parts by weight based on 100 parts by weight of said binder resin, and, tetrahydrofuran-soluble matter of the toner, in its molecular-weight distribution as measured by gel permeation chromatography, has at least one peak in the region of molecular weight from 1,000 to less than 2,000 and at least one peak in the region of molecular weight from 2,000 to 300,000, and has a weight-average molecular weight Mw from 100,000 to 1,500,000, where a molecular-weight integral value T in the region of molecular weight of 800 or more, a molecular weight integral value L in the region of molecular weight from 2,000 to 5,000 and a molecular-weight integral value H in the region of molecular weight of 300,000 or more satisfy the following relationship:

$$1 \leqq (L/T) \times 100 \leqq 15,$$

$$5 \leqq (H/T) \times 100 \leqq 25$$

transferring to a recording medium the toner image formed by development; and fixing to the recording medium the toner image thus transferred.

30. The image-forming method according to claim 29, wherein, in the molecular-weight distribution as measured by gel permeation chromatography of tetrahydrofuran-soluble matter of said toner, the molecular-weight integral value T in the region of molecular weight of 800 or more, the molecular-weight integral value L in the region of molecular weight of from 2,000 to 5,000 and the molecular-weight integral value H in the region of molecular weight of 300,000 or more satisfy the following relationship:

$$1 \leqq (L/T) \times 100 \leqq 7,$$

$$3 \leqq (H/T) \times 100 \leqq 30.$$

31. The image-forming method according to claim 29, wherein, in the molecular-weight distribution as measured by gel permeation chromatography of tetrahydrofuran-soluble matter of said toner, the molecular-weight integral value T in the region of molecular weight of 800 or more, the molecular-weight integral value L in the region of molecular weight of from 2,000 to 5,000 and the molecular-weight integral value H in the region of molecular weight of 300,000 or more satisfy the following relationship:

$$1 \leqq (L/T) \times 100 \leqq 7,$$

$$5 \leqq (H/T) \times 100 \leqq 25.$$

32. The image-forming method according to claim 29, wherein, in the molecular-weight distribution as measured by gel permeation chromatography of tetrahydrofuran-soluble matter of said toner, the molecular-weight integral value T in the region of molecular weight of 800 or more and a molecular-weight integral value M in the region of molecular weight of 100,000 or more satisfy the following relationship:

$$10 \leqq (M/T) \times 100 \leqq 50.$$

33. The image-forming method according to claim 29, wherein, in the molecular-weight distribution as measured by gel permeation chromatography of tetrahydrofuran-soluble matter of said toner, the molecular-weight integral value T in the region of molecular weight of 800 or more and a molecular-weight integral value M in the region of molecular weight of 100,000 or more satisfy the following relationship:

$$15 \leqq (M/T) \times 100 \leqq 40.$$

34. The image-forming method according to claim 29, wherein, in the molecular-weight distribution as measured by gel permeation chromatography of tetrahydrofuran-soluble matter of said toner, a height Ha of the top peak in the region of molecular weight of from 1,000 to less than 2,000 and a height Hb of the top peak in the region of molecular weight of from 2,000 to 300,000 satisfy the following relationship:

$$0.70 \leqq Hb/Ha \leqq 1.30.$$

35. The image-forming method according to claim 29, wherein, in the molecular-weight distribution as measured by gel permeation chromatography of tetrahydrofuran-soluble matter of said toner, a height Ha of the top peak in the region of molecular weight of from 1,000 to less than 2,000 and a height Hb of the top peak in the region of molecular weight of from 2,000 to 3 00,000 satisfy the following relationship:

$$0.75 \leqq Hb/Ha \leqq 1.25.$$

36. The image-forming method according to claim 29, wherein, in the molecular-weight distribution as measured by gel permeation chromatography of tetrahydrofuran-soluble matter of said toner, a height Hc at a molecular weight minimum value present between the top peak in the region of molecular weight of from 1,000 to less than 2,000 and the top peak in the region of molecular weight of from 2,000 to 300,000 and a height Ha of the top peak in the region of molecular weight of from 1,000 to less than 2,000 satisfy the following relationship:

$$0.01 \leqq Hc/Ha \leqq 0.15.$$

37. The image-forming method according to claim 29, wherein, in the molecular-weight distribution as measured by gel permeation chromatography of tetrahydrofuran-soluble matter of said toner, a height Hc at a molecular weight minimum value present between the top peak in the region of molecular weight of from 1,000 to less than 2,000 and the top peak in the region of molecular weight of from 2,000 to 300,000 and a height Ha of the top peak in the region of molecular weight of from 1,000 to less than 2,000 satisfy the following relationship:

$$0.01 \leqq Hc/Ha \leqq 0.10.$$

38. The image-forming method according to claim 29, wherein, in the molecular-weight distribution as measured by gel permeation chromatography of tetrahydrofuran-soluble matter, said tetrahydrofuran-soluble matter has a number-average molecular weight Mn of from 8,200 to 700,000.

39. The image-forming method according to claim 29, wherein, in the molecular-weight distribution as measured by gel permeation chromatography of tetrahydrofuran-soluble matter, said tetrahydrofuran-soluble matter has a weight-average molecular weight/number-average molecular weight Mw/Mn of from 4 to 15.

40. The image-forming method according to claim 29, wherein, in the molecular-weight distribution as measured by gel permeation chromatography of tetrahydrofuran-soluble matter, said tetrahydrofuran-soluble matter has a weight-average molecular weight/number-average molecular weight Mw/Mn of not more than 3.0 in the region of molecular weight of from 800 to 3,000.

41. The image-forming method according to claim 29, wherein the resin component of said toner contains a toluene-soluble matter in an amount of from 2% by weight and 30% by weight based on the weight of the resin component.

42. The image-forming method according to claim 29, wherein the resin component of said toner contains a toluene-soluble matter in an amount of from 3% by weight and 25% by weight based on the weight of the resin component.

43. The image-forming method according to claim 29, wherein said release agent comprises a member selected from the group consisting of a polymethylene wax, an amide wax, a higher fatty acid, a long-chain alcohol, an ester wax, a graft compound of any of these and a block compound of any of these.

44. The image-forming method according to claim 29, wherein said release agent comprises an ester wax.

45. The image-forming method according to claim 29, wherein said release agent comprises a wax having a maximum endothermic peak in the region of from 40° C. to 120° C. as measured by differential scanning calorimetry.

46. The image-forming method according to claim 29, wherein said release agent comprises a wax having a maximum endothermic peak in the region of from 40° C. to 90° C. as measured by differential scanning calorimetry.

47. The image-forming method according to claim 29, wherein said toner has toner particles having a core/shell structure wherein the core surface of said release agent is covered with a shell formed of a shell resin.

48. The image-forming method according to claim 29, wherein said toner has toner particles obtained by polymerizing a polymerizable monomer composition containing at least a polymerizable monomer, the colorant and the release agent, in the presence of a polymerization initiator in a liquid medium.

49. The image-forming method according to claim 29, wherein said toner has toner particles obtained by polymerizing a polymerizable monomer composition containing at least a polymerizable monomer, the colorant, the release agent and a polar resin, in the presence of a polymerization initiator in a liquid medium.

50. The image-forming method according to claim 29, wherein said toner has toner particles obtained by polymerizing a polymerizable monomer composition containing at least a polymerizable monomer, the colorant and the release agent, in the presence of a polymerization initiator in an aqueous medium.

51. The image-forming method according to claim 29, wherein said toner has toner particles obtained by polymerizing a polymerizable monomer composition containing at least a polymerizable monomer, the colorant, the release agent and a polar resin, in the presence of a polymerization initiator in an aqueous medium;

said toner particles having a core/shell structure wherein the core surface of the release agent is covered with a shell formed of a shell resin.

52. The image-forming method according to claim 51, wherein said polar resin comprises a polyester resin.

53. The image-forming method according to claim 29, wherein said toner has a weight-average particle diameter of from 4 μm to 10 μm.

54. The image-forming method according to claim 29, wherein said toner has a weight-average particle diameter of from 5 μm to 8 μm.

55. The image-forming method according to claim 29, wherein said toner is used as a one-component developer.

56. The image-forming method according to claim 29, wherein said toner is blended with carrier particles and is used as a two-component developer.

57. The image-forming method according to claim 29, wherein the surface of said latent image bearing member is charged by applying a charging bias voltage in the state where a contact charging member comes into contact with the surface of said latent image bearing member.

58. The image-forming method according to claim 29, wherein said latent image bearing member is a photosensitive member; the surface of said photosensitive member has a volume resistivity of from $10^8$ Ω.cm to $10^{15}$ Ω.cm, and the surface of said photosensitive member has a contact angle to water of 85 degrees or more.

59. The image-forming method according to claim 57, wherein the surface of said photosensitive member has a volume resistivity of from $10^8$ Ω.cm to $10^{15}$ Ω.cm; the surface of said photosensitive member has a contact angle to water of 85 degrees or more; and said contact charging member has, at its voltage-applied part and at its part coming into contact with said photosensitive member and as measured by dynamic resistance measurement made by bringing the contact charging member into contact with a conductor rotary-member substrate, a volume resistivity within the range of from $10^4$ Ω.cm to $10^{10}$ Ω.cm in the applied electric field range of from 20 to V1 (V/cm) when an electric field which is higher between $|V-VD|/d$ and $|V|/d$ is regarded as the V1 (V/cm) where V is a voltage applied to the contact charging member, VD is a potential on the surface of the photosensitive member at the time of its rush into the nip between the photosensitive member and the contact charging member, and d is a distance between the voltage-applied part of the contact charging member and the photosensitive member.

60. The image-forming method according to claim 59, wherein the volume resistivity of said contact charging member has, in the applied electric field range of from 20 to V1 (V/cm) when an electric field which is higher between $|V|VD-/d$ and $|V|/d$ is regarded as the V1 (V/cm), a dependence on the applied electric field within the range of $R1/R2 \leqq 1{,}000$ where its maximum resistivity is represented by R1 and its minimum resistivity by R2.

61. The image-forming method according to claim 57, wherein said contact charging member has magnetic particles.

62. The image-forming method according to claim 61, wherein said magnetic particles have a volume resistivity of from $10^4$ Ω.cm to $10^9$ Ω.cm.

63. The image-forming method according to claim 62, wherein said magnetic particles have an average particle diameter of from 5 μm to 200 μm.

64. The image-forming method according to claim 61, wherein said contact charging member has a magnet for holding said magnetic particles, and is so set that magnetic flux density B (T: tesla) of a magnetic field generated by the magnet and maximum magnetization σB ($Am^2/kg$) of the magnetic particles within the magnetic flux density B have values that satisfy the following relationship:

$$B \cdot \sigma B \geqq 4.$$

65. The image-forming method according to claim 61, wherein said magnetic particles have surface layers containing a conductive resin or containing conductive particles and a binder resin.

66. The image-forming method according to claim 58, wherein the surface of said photosensitive member is made to have the contact angle to water of 85 degrees or more by forming on the surface a resin layer containing a lubricating powder.

UNITED STATES PATENT AND TRADEMARK OFFICE

CERTIFICATE OF CORRECTION

PATENT NO. : 6,013,406

DATED : January 11, 2000

INVENTOR(S) : YUJI MORIKI ET AL.

It is certified that error appears in the above-identified patent and that said Letters Patent is hereby corrected as shown below:

ON THE TITLE PAGE:

[56] References Cited, under FOREIGN PATENT DOCUMENTS:

"56-099345 8/1991" should read --56-099345 8/1981--; and
"51-023354 8/1996" should read --51-023354 8/1976--.

COLUMN 2:

Line 29, "of.a" should read --of a--.

COLUMN 4:

Line 61, "can" should read --can be--.

COLUMN 10:

Line 21, "wherein;" should read --wherein,--; and
Line 41, "of;" should read --of:--.

COLUMN 12:

Line 15, "difficulty" should read --difficult--;
Line 26, "are cancelled" should read --cancel--; and
Line 40, "are" should be deleted; and
"cancelled" should read --cancel--.

UNITED STATES PATENT AND TRADEMARK OFFICE

CERTIFICATE OF CORRECTION

PATENT NO. : 6,013,406

DATED : January 11, 2000

INVENTOR(S) : YUJI MORIKI ET AL.

It is certified that error appears in the above-identified patent and that said Letters Patent is hereby corrected as shown below:

COLUMN 13:

Line 6, "be" should be deleted;
Line 7, "cancelled" should read --cancel--; and
Line 16, "be cancelled" should read --cancel--.

COLUMN 14:

Line 64, "are cancelled" should read --cancel--.

COLUMN 17:

Line 53, "compound s" should read --compounds--; and
Line 65, "obtain ed" should read --obtained--.

COLUMN 22:

Line 2, "a little vary" should read --vary a little--.

COLUMN 24:

Line 31, "from" should read --form--.

COLUMN 26:

Line 22, "destatitizing" should read--destaticizing--; and
Line 44, "destatitized" should read --destaticized--.

UNITED STATES PATENT AND TRADEMARK OFFICE

CERTIFICATE OF CORRECTION

PATENT NO. : 6,013,406

DATED : January 11, 2000

INVENTOR(S) : YUJI MORIKI ET AL.

It is certified that error appears in the above-identified patent and that said Letters Patent is hereby corrected as shown below:

COLUMN 27:

Line 33, "bruch," should read --brush,--.

COLUMN 38:

Line 44, "preferably" should read --preferably 90 degrees or more--;
Line 45, "Such a photosensor more." should be deleted; and
Line 61, "the-shape" should read --the shape--.

COLUMN 43:

Line 36, "be" (first occurrence) should be deleted.

COLUMN 44:

Line 37, "PAMATER," should read --pMATER,--.

COLUMN 50:

Line 2, "results" should read --results of--.

COLUMN 53:

Line 23, "(mC/kg)=(CxV$\nu$)/($W_1$-$W_2$)" should read --(mC/kg)=(CxV)/($W_1$-$W_2$)--.

UNITED STATES PATENT AND TRADEMARK OFFICE

CERTIFICATE OF CORRECTION

PATENT NO. : 6,013,406

DATED : January 11, 2000

INVENTOR(S) : YUJI MORIKI ET AL.

It is certified that error appears in the above-identified patent and that said Letters Patent is hereby corrected as shown below:

COLUMN 56:

Line 5, "hairing." should read --nap.--.

COLUMN 57:

Line 27, "78°. Photosensi-" should read--78°. ¶Photosensi---.

COLUMN 59:

Line 1, "ear" should read--form an ear--; and
Line 10, "ear" should read--form an ear--.

COLUMN 66:

Line 18, "ear" should read--form an ear--.

COLUMN 71:

Table 3, "930 1010 780" should read --93° 101° 78°--.

COLUMN 77:

Line 52, "tone r" should read--toner--.

UNITED STATES PATENT AND TRADEMARK OFFICE

CERTIFICATE OF CORRECTION

PATENT NO. : 6,013,406

DATED : January 11, 2000

INVENTOR(S) : YUJI MORIKI ET AL.

It is certified that error appears in the above-identified patent and that said Letters Patent is hereby corrected as shown below:

COLUMN 78:

Line 35, "of;" should read--of:--; and
Line 42, "wherein;" should read--wherein,--.

COLUMN 79:

Line 66, "3 00,000" should read--300,000--.

COLUMN 82:

Line 22, "IVIVD-/d" should read --IVIVDI/d--.

Signed and Sealed this

Tenth Day of April, 2001

Nicholas P. Godici

*Attest:*

NICHOLAS P. GODICI

*Attesting Officer*

*Acting Director of the United States Patent and Trademark Office*